US012220058B2

(12) United States Patent
Leng

(10) Patent No.: US 12,220,058 B2
(45) **Date of Patent: *Feb. 11, 2025**

(54) SOFA BED

(71) Applicant: NEW-TEC INTEGRATION (XIAMEN) CO., LTD., Xiamen (CN)

(72) Inventor: Luhao Leng, Xiamen (CN)

(73) Assignee: NEW-TEC INTEGRATION (XIAMEN) CO., LTD., Xiamen (CN)

( * ) Notice: Subject to any disclaimer, the term of this patent is extended or adjusted under 35 U.S.C. 154(b) by 365 days.

This patent is subject to a terminal disclaimer.

(21) Appl. No.: 17/732,251

(22) Filed: Apr. 28, 2022

(65) Prior Publication Data

US 2022/0346558 A1 Nov. 3, 2022

(30) Foreign Application Priority Data

Apr. 29, 2021 (CN) ..... 202110473435.8

(51) Int. Cl.
*A47C 17/175* (2006.01)
*A47C 7/54* (2006.01)

(52) U.S. Cl.
CPC ..... *A47C 17/1753* (2013.01); *A47C 7/54* (2013.01)

(58) Field of Classification Search
CPC ..... A47C 17/1753; A47C 7/54; A47C 23/002; A47C 17/86; A47C 17/162; A47C 19/021; A47C 19/12
See application file for complete search history.

(56) References Cited

U.S. PATENT DOCUMENTS 66,390 A * 7/1867 Read ..... A47C 23/063 5/245
85,938 A * 1/1869 Kirkpatrick ..... A47C 23/007 267/180
89,651 A * 5/1869 Gerard ..... A47C 23/063 5/245
90,303 A * 5/1869 Read ..... A47C 23/05 5/264.1
105,853 A * 7/1870 Shepard ..... A47C 23/05 5/245

(Continued)

FOREIGN PATENT DOCUMENTS

DE 19944561 C1 11/2000
GB 229850 A 3/1925

(Continued)

*Primary Examiner* — Myles A Throop
(74) *Attorney, Agent, or Firm* — Perkins Coie LLP

(57) ABSTRACT

A sofa bed has a seat portion, a backrest portion and a hinge mechanism including a first section, a second section and a third section sequentially and pivotably connected. The first section is fixed to a side of the seat portion. The second section is fixed to a side of the backrest portion. A protruding portion is provided at a position where the first section is connected with the second section. Each of the armrest frames is formed with a slideway for receiving and guiding the protruding portion. An end of the third section opposite to the second section is pivotally connected to the armrest. The first section and the second section are be lockable to place the main body frame into a sofa configuration. The sofa bed can be easily switched between sofa and bed positions.

14 Claims, 65 Drawing Sheets

(56) References Cited

U.S. PATENT DOCUMENTS 143,854 A * 10/1873 Smith et al. ..... A47C 27/066 5/261
179,007 A * 6/1876 Evans ..... A47C 23/30 5/230
1,257,389 A 2/1918 Platt
1,407,135 A 2/1922 Ebbs
2,100,543 A * 11/1937 Hamilton ..... A47C 7/347 87/8
3,844,612 A 10/1974 Borggren et al.
3,966,337 A 6/1976 Crawford
3,968,528 A 7/1976 Poerink
4,038,711 A * 8/1977 Golembeck ..... A47C 23/05 5/239
4,079,995 A 3/1978 Beckley
4,183,154 A 1/1980 Dykes
4,217,669 A 8/1980 Fefferman
4,357,062 A 11/1982 Everett
4,654,902 A 4/1987 Shrock et al.
4,870,353 A * 9/1989 Cook ..... G01R 1/07328 324/763.01
4,956,884 A * 9/1990 Hwang ..... A47C 23/0431 267/179
5,303,432 A 4/1994 Fitts
5,305,705 A * 4/1994 Gagliano ..... E01F 9/688 116/63 P
5,428,778 A 6/1995 Brookes
5,528,778 A * 6/1996 Shrock ..... A47C 17/1756 5/47
5,924,681 A * 7/1999 Bullard ..... F16F 1/12 267/89
5,924,682 A * 7/1999 Bullard ..... A47C 23/32 267/103
6,030,040 A 2/2000 Schmid et al.
6,113,082 A * 9/2000 Fujino ..... F16F 1/025 267/110
6,209,154 B1 * 4/2001 Huang ..... A47C 17/162 297/354.13
6,349,431 B1 2/2002 Meade et al.
6,357,062 B1 3/2002 Woll et al.
6,539,564 B1 4/2003 Hsia
7,013,508 B2 3/2006 Wu
7,188,380 B1 3/2007 Wang
7,811,026 B1 * 10/2010 Kulp ..... E01F 9/654 116/63 C
7,908,693 B2 3/2011 DeMoss
9,259,093 B2 * 2/2016 Leng ..... A47C 17/1756
9,586,453 B2 * 3/2017 Mizukoshi ..... F16F 1/122
9,689,123 B2 * 6/2017 Chi ..... E01F 9/654
10,213,026 B2 2/2019 Rohr
10,427,387 B2 10/2019 Leng
D871,123 S 12/2019 Schachter
10,512,337 B2 * 12/2019 Leng ..... A47C 17/1756
10,772,429 B1 9/2020 Holbrook et al.
10,869,559 B2 12/2020 Leng
11,019,937 B2 6/2021 Leng
2003/0005519 A1 1/2003 Grossman et al.
2006/0016383 A1 * 1/2006 Flamingo ..... E01F 9/688 116/63 C
2007/0271696 A1 * 11/2007 Tan ..... A47C 17/1655 5/37.1
2010/0180379 A1 7/2010 Leng
2015/0196128 A1 7/2015 Leng
2017/0303682 A1 10/2017 Giovannetti
2017/0347792 A1 12/2017 Bergmann et al.
2018/0035816 A1 2/2018 Leng
2018/0199728 A1 * 7/2018 Leng ..... A47C 27/001
2019/0090652 A1 3/2019 Leng
2019/0350374 A1 11/2019 Tsai
2021/0037988 A1 2/2021 Leng
2022/0225780 A1 * 7/2022 Leng ..... A47C 7/347
2022/0225781 A1 7/2022 Leng
2023/0200553 A1 * 6/2023 Leng ..... A47C 27/065 5/720

FOREIGN PATENT DOCUMENTS

GB 324139 A 1/1930
JP 2002238700 A * 8/2002
WO 2004084678 A1 10/2004
WO 2021073598 A1 4/2021
WO 2021073601 A1 4/2021

* cited by examiner

A-A

B-B

SOFA BED

FIELD

The present invention relates to the field of furniture and in particular, to a sofa bed.

BACKGROUND

Sofa beds have become a popular type of furniture product. Conventional sofa beds have drawbacks. For example, the switching a conventional sofa bed between two states is not smooth enough, and can be difficult for one person to do. Additionally, conventional sofa beds may not be stable enough in the sofa state where an angle between the seat and the backrest might change, which affects comfort. Moreover conventional sofa beds can only be folded in a single manner and thus may not satisfy the user's various demands. Therefore, improvements in sofa beds are needed.

SUMMARY

A sofa bed is easily switchable between two in-use states and easy to operate. An angle between a seat portion and a backrest portion can be locked to improve reliability. The switching operation can be achieved quickly and easily by allowing a pin to slide in a sliding groove in an extension direction having a transverse component and a vertical component.

In order to achieve the switching of the main body frame between the sofa configuration and the bed configuration, a hinge in the form of three sections is provided at the connection between the backrest portion and the seat portion. A bottom supporting structure of the sofa bed is further provided with a supporting pipe, which can not only support the main body frame when the sofa bed is used as a sofa, but also support the main body frame when the sofa bed is used as a bed. The main body frame may include a bed plate frame and a steel mesh plate, which can be engaged and disengaged well and ingeniously. Moreover, the armrest frame may also be detached and folded for the purpose of easy storage and transportation.

Furthermore, the sofa bed may be provided with a plurality of detachable elastic modules, and the mounting of the elastic modules is relatively simple and easy to operate. Thus, the user can manually mount the elastic modules to obtain a sofa bed with better comfort.

In order to mount the elastic modules, the main body frame is set to be foldable in half, and the slideway for mounting the elastic modules is opened at the fold-in-half position to allow the elastic modules to enter into the slideway. The opening will be closed when the main body frame is flattened, thereby preventing the elastic modules from disengaging. The elastic modules may also be configured to be pressed directly from top to bottom onto the rail. Such an arrangement may prevent adjacent elastic modules from interfering with each other.

According to one aspect of the present invention, there is provided a sofa bed, comprising:

a plurality of elastic modules each comprising a conical spring and a spring bracket that accommodates and holds the conical spring;

a main body frame formed with a plurality of slide rails configured to engage with a bottom portion of the spring bracket so that the plurality of elastic modules can slide on the slide rails;

an armrest frame respectively disposed on both sides of the main body frame in a longitudinal direction of the main body frame;

wherein the main body frame is configured to be folded along a fold-in-half line perpendicular to an extending direction of the slide rail so as to switch between a folded state and an in-use state, wherein the slide rail forms a slide rail opening at the fold-in-half line when the main body frame is in the folded state, and the slide rail opening is closed when the main body frame is in the in-use state;

wherein the slide rails on the main body frame are configured such that when the main body frame is in the folded state, the plurality of elastic modules can be mounted on the slide rails from the outer side of the main body frame via the slide rail openings and slide toward ends of the slide rails, so that the plurality of elastic modules are densely arranged on a side of the main body frame facing towards a user.

In an embodiment according to the disclosure, the main body frame is formed as a rectangular structure, and the slide rails are plural and all extend in the longitudinal direction of the main body frame.

In an embodiment according to the disclosure, the fold-in-half line is located at a middle position in the longitudinal direction of the main body frame.

In an embodiment according to the disclosure, at most an even number of the elastic modules can be mounted on each of the sliding rails.

In an embodiment according to the disclosure, the fold-in-half line is offset with respect to a middle position in the longitudinal direction of the main body frame.

In an embodiment according to the disclosure, an odd number of the elastic modules can be mounted on each of the slide rails at most, and wherein after the main body frame is folded along the fold-in-half line, the number of elastic modules that can be mounted at most on each side rail of a first portion of two portions of the main body frame which are folded in half is one larger than the number of elastic modules that can be mounted at most on each side rail of a second portion of the two portions.

In an embodiment according to the disclosure, the main body frame comprises at least two folded portions, each of which comprises:

a unit frame;

a plurality of parallel rail beams extending between two transversely extending beams of the unit frame, each adjacent pair of the rail beams forming the slide rail;

wherein in any two folded portions adjacent in the longitudinal direction among the at least two folded portions, a respective transversely extending beams abutted against each other and are capable of pivoting relative to each other about a transversely-extending axis to achieve the folding of the two adjacent folded portions towards each other.

In an embodiment according to the disclosure, the spring bracket of each of the elastic modules comprises a base having a spring mounting seat, wherein each spring mounting seat has a spring fixing portion for fixing an end of the conical spring.

In an embodiment according to the disclosure, the spring bracket of each of the elastic modules further comprises:

an end cap disposed opposite to a corresponding spring mounting seat and cooperating with the corresponding spring mounting seat to hold the conical spring, wherein the end cap abuts against the other end of the conical spring opposite to an end of the conical spring fixed in the spring mounting seat; and one or more sets of flexible straps, each set of flexible straps including a plurality of flexible straps spaced from one another and evenly arranged between a corresponding pair of the spring mounting seat and end cap, the flexible straps being located outside the conical spring when the one conical spring is retained between the corresponding pair of the spring mounting seat and end cap.

In an embodiment according to the disclosure, each of the elastic modules further comprises a cover covering the conical spring of the elastic module.

In an embodiment according to the disclosure, the conical spring is mounted in the spring bracket with a predetermined initial compressive force.

In an embodiment according to the disclosure, the main body frame comprises a seat portion and a backrest portion disposed adjacently in a transverse direction, and the seat portion and the backrest portion are configured to be folded and flattened about a hinge mechanism, thereby allowing the main body frame to switch between a bed configuration and a sofa configuration, wherein the seat portion and the backrest portion each comprise at least two folded portions arranged in the longitudinal direction.

In an embodiment according to the disclosure, each of the armrest frames is formed with a slideway facing the hinge mechanism, so that a movement of the hinge mechanism is guided by the hinge mechanism, wherein the sofa bed is configured to lock the backrest portion relative to the seat portion at a predetermined angle when the backrest portion and the seat portion pivoting relative to each other about the hinge mechanism, and the armrest frame is connected with the main body frame through the hinge mechanism, so that in a locked state, a partial structure of the hinge mechanism can drive the main body frame to displace under the guidance of the slideway.

In an embodiment according to the disclosure, the hinge mechanism comprises:

a seat portion connecting rod attached to a transverse side edge of the seat portion and extending along the transverse side edge;

a backrest portion connecting rod attached to a transverse edge of the backrest portion on the same side as the transverse side edge of the seat portion and extending along the transverse edge of the backrest portion;

a pivot connecting the seat portion connecting rod with the backrest portion connecting rod such that the backrest portion and the seat portion can pivot relative to each other.

BRIEF DESCRIPTION OF THE DRAWINGS

Reference may be made to preferred embodiments shown in the figures to enable better understanding of the above and other objects, features, advantages and functions of the present invention. The same reference numerals in the figures denote the same parts. Those skilled in the art should appreciate that the figures are intended to schematically illustrate the preferred embodiments of the present invention, and not intended to impose any limitations to the scope of the present invention. All parts in the figures are not drawn to scale.

DETAILED DESCRIPTION OF EMBODIMENTS

Specific embodiments of the present prevention will now be described in detail with reference to the figures. What are described here are only preferred embodiments according to the present invention. Those skilled in the art can implement other embodiments of the present invention on the basis of the preferred embodiments, and said other embodiments also fall within the scope of the present invention.

Figure 1:
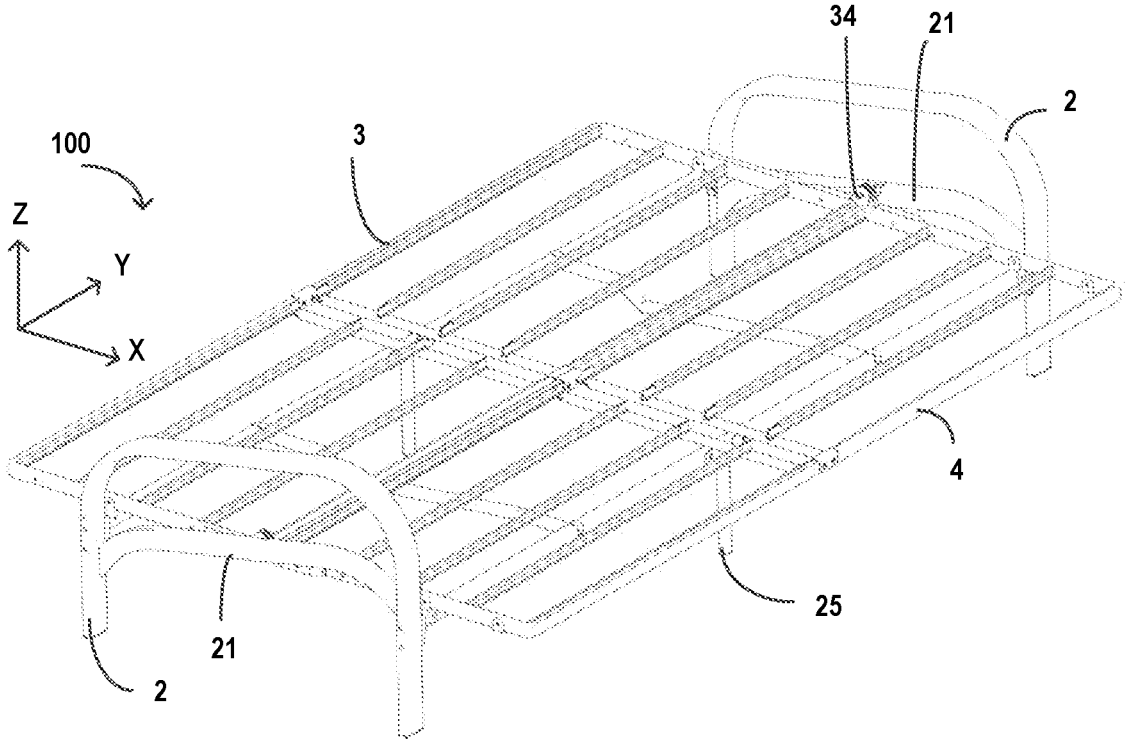
FIG. 1 is a perspective schematic view of a main body frame of a sofa bed according to a preferred embodiment of the present invention when it is used in a bed configuration.
Figure 2:
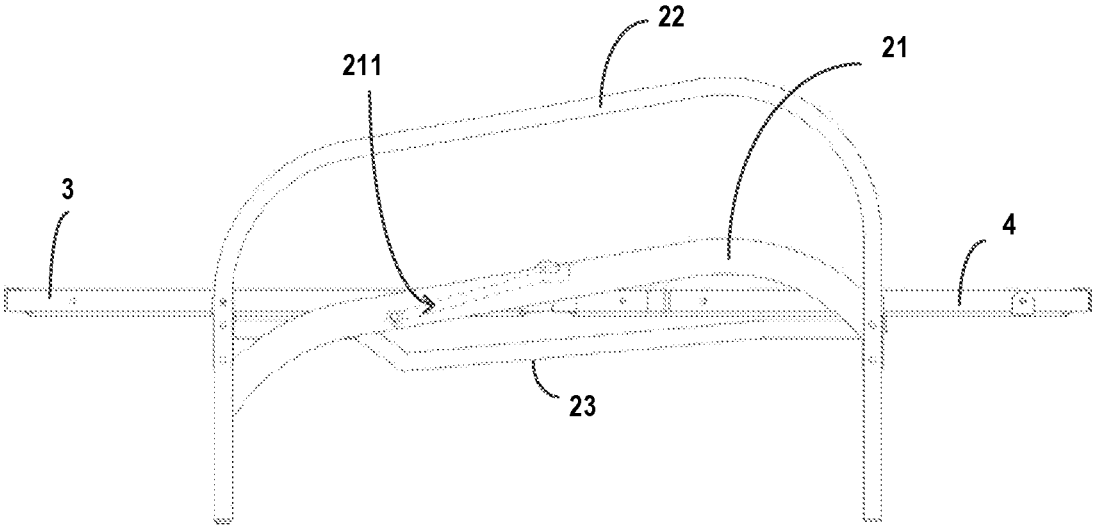
FIG. 2 is a side view of FIG. 1.
Figure 3:
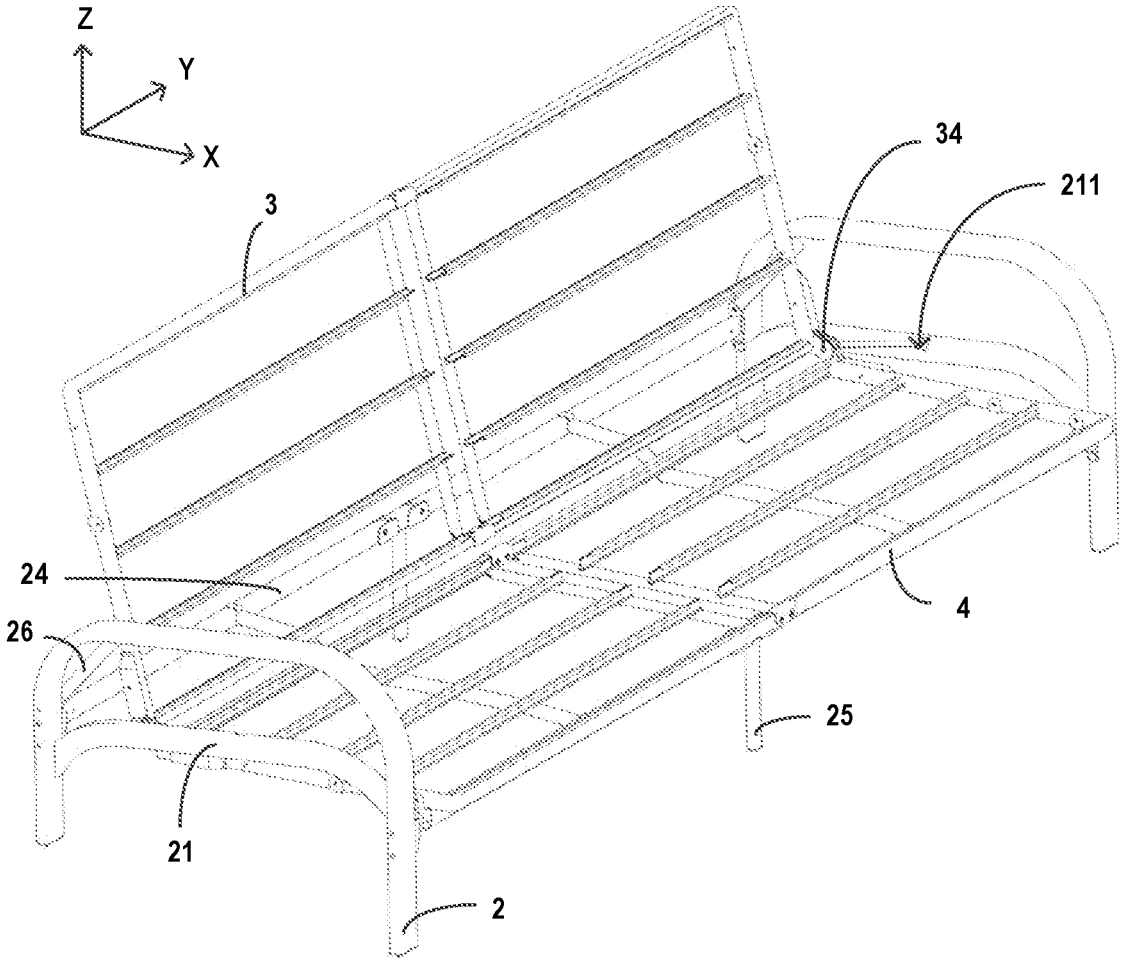
FIG. 3 is a perspective schematic view of the main body frame of FIG. 1 in a sofa configuration.
Figure 4:
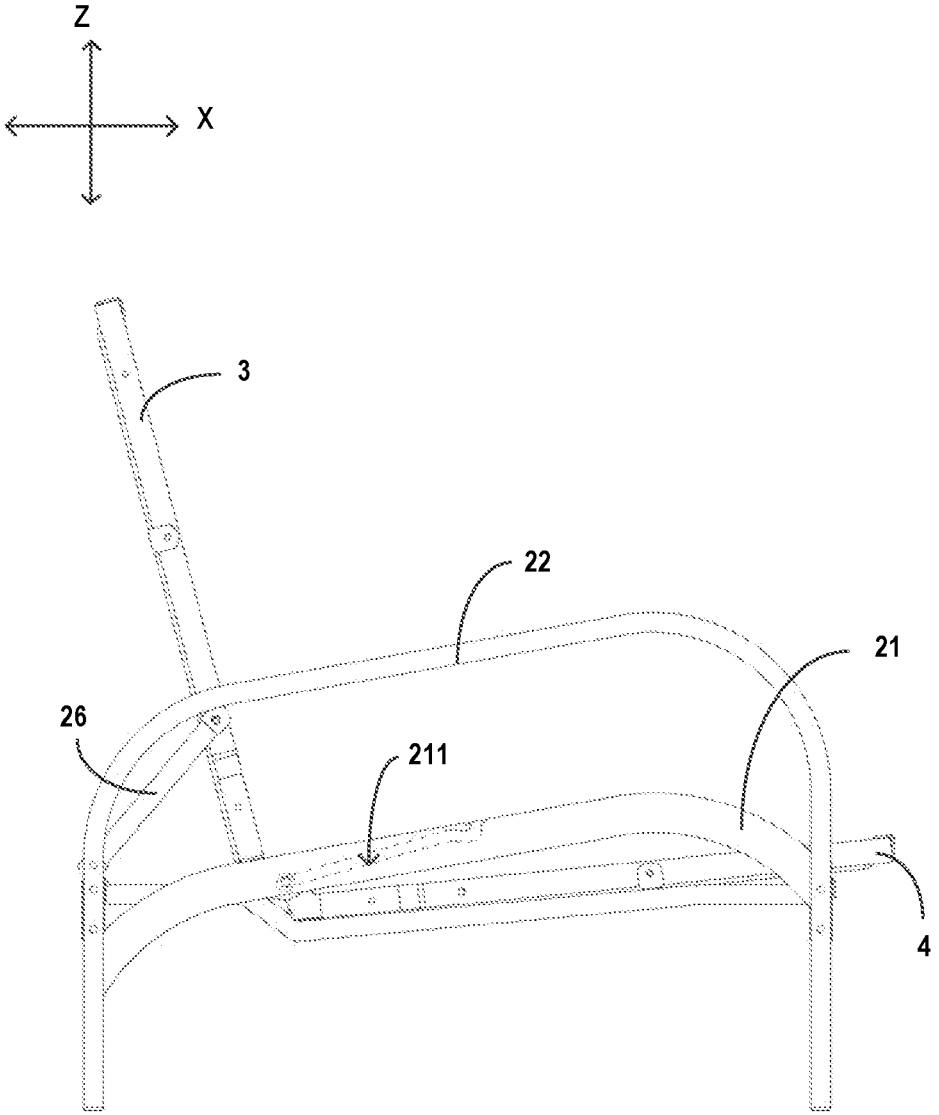
FIG. 4 is a side view of FIG. 3.
Figure 63:
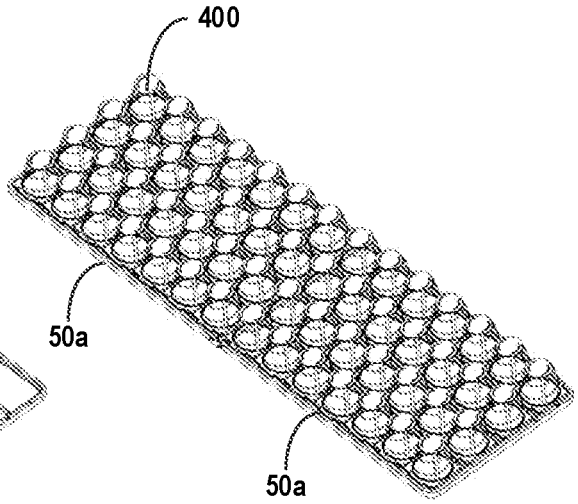

The invention provides a sofa bed. FIG. 1-FIG. 63 show at least partial structures of some preferred embodiments of the present invention. First, it needs be appreciated that "transverse direction" and "longitudinal direction" mentioned in the present invention are two directions perpendicular to each other, and they are relative directions relative to a rectangle formed by a seat portion, a backrest portion and even a unit frame; the transverse direction is shown by X in the figures, and the longitudinal direction is shown by Y in the figures; a height direction mentioned in the text is an absolute vertical direction and shown by Z in the figures.

FIG. 1-FIG. 63 show some preferred embodiments of the present invention.

Referring to FIG. 1 through FIG. 4, a sofa bed in the preferred embodiment comprising a main body frame 100 which includes a seat portion 4, a backrest portion 3, a seat portion connecting rod 41, a backrest portion connecting rod 31, and two armrest frames 2. The seat portion 4 and the backrest portion 3 are both formed as a rectangular structure, which may be a rectangular frame structure or a rectangular plate-shaped structure. A longitudinal edge of the seat portion 4 and a longitudinal edge of the backrest portion 3 are butted together.

The seat portion connecting rod 41 is fixed on a transverse edge of the seat portion 4, the backrest portion connecting rod 31 is fixed on a transverse edge of the backrest portion 3, and the seat portion connecting rod 41 and the backrest connecting rod 31 are connected together in a way that they are pivotable relative to each other. When the seat portion connecting rod 41 and the backrest portion connecting rod 31 pivot relative to each other, an angle therebetween increases or decreases. It needs to be appreciated that the "angle" mentioned in the present invention refers to an angle less than or equal to 180°.

The two armrest frames 2 are provided at both ends of the seat portion 4 and the backrest portion 3 in the longitudinal direction, and each armrest frame 2 is provided with a slideway that opens toward the backrest portion 3 and the seat portion 4 and partially extends in the transverse direction. In the present embodiment, the slideway is a sliding groove 211, and a rear end 211*b* of the sliding groove 211 is lower than a front end 211*a* of the sliding groove 211.

Figure 5:
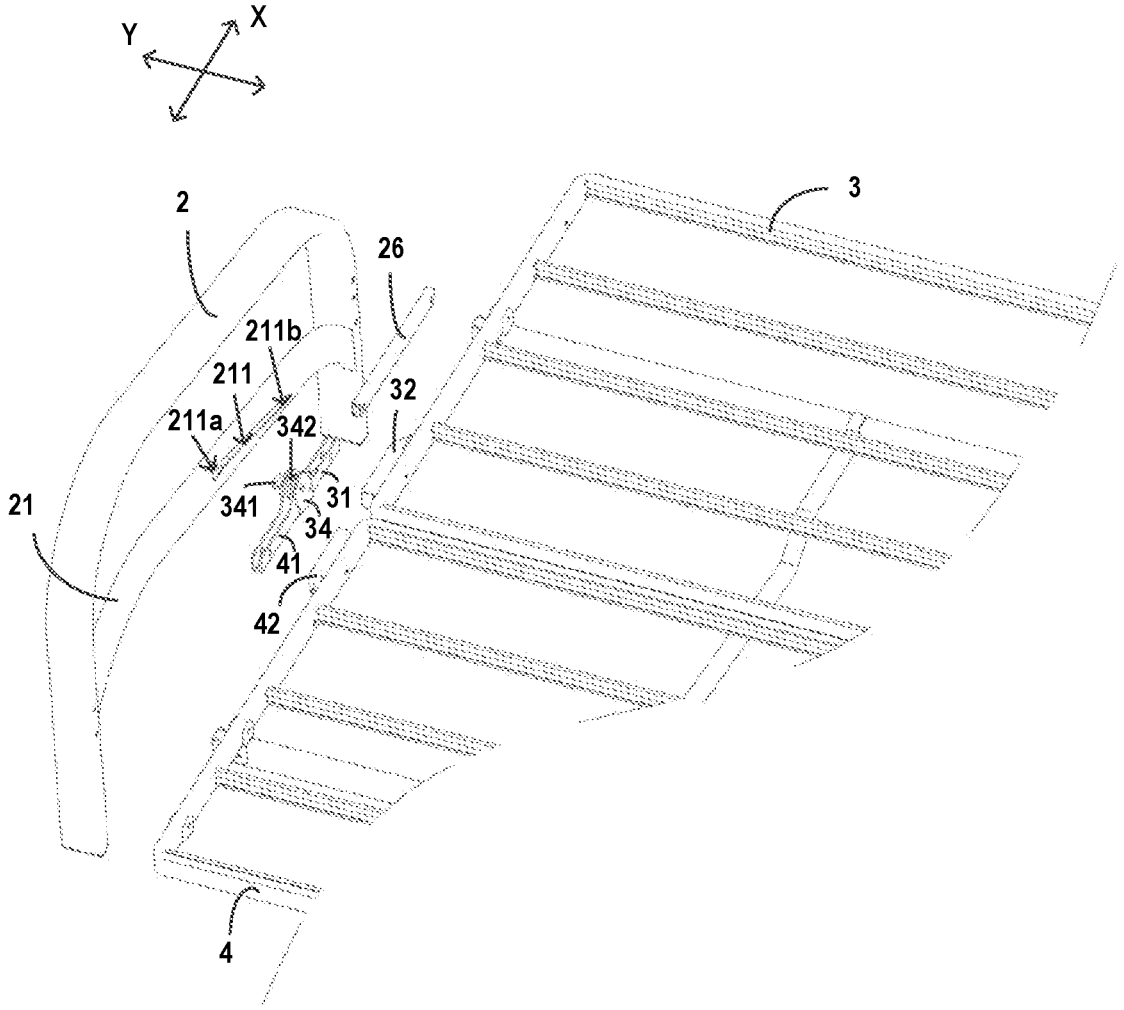
FIG. 5 is an exploded schematic view of a junction of a seat portion and a backrest portion.

The exploded schematic view of the pivotal connection of the seat portion 4 and the backrest portion 3 is shown in FIG. 5. Referring to FIG. 5, the seat portion connecting rod 41 and the backrest portion connecting rod 31 are engaged by a hinge mechanism 34, and the hinge mechanism 34 has a pin 341 protruding from a side facing the armrest. The front end 211*a* of the sliding groove 211 is provided with an upward opening, so that the pin 341 can enter the sliding groove 211 from the front end 211*a* of the sliding groove 211 and slide in the sliding groove 211. A special-shaped gear and a gear matching claw are provided at the hinge mechanism 34, and respectively disposed on the seat portion connecting rod 41 and the backrest portion connecting rod 31. The special-shaped gear is for example a ratchet 342. An edge of the ratchet 342 is provided with a recessed portion that is recessed in a radial direction of the ratchet 342. The gear matching pawl is provided with a protruding portion that mates with the recessed portion. The recessed portion and the protruding portion are positioned such that when the backrest portion 3 and the seat portion 4 are at a predetermined obtuse angle, the protruding portion is embedded in the recessed portion to achieve locking. The seat portion 4 is provided with a seat portion insertion sleeve 42 for accommodating the seat portion connecting rod 41, and the backrest portion 3 is provided with a backrest portion insertion sleeve 32 for accommodating the backrest portion connecting rod 31.

Furthermore, each armrest frame 2 includes an armrest frame main body 22 (i.e. the outer frame of the armrest frame) and a reinforcing cross beam 21, the sliding groove 211 is disposed on the reinforcing cross beam 21, and an extension direction of the reinforcing cross beam 21 coincides with that of the sliding groove 21, i.e., the rear end 211*b* of the reinforcing cross beam 21 is also lower than the front end 211*a* of the reinforcing cross beam 21. The armrest frame main body 22 further includes two upright columns extending in the vertical direction and a body cross beam connected to the top of the two upright columns. The reinforcing cross beam is connected to the middle of the two upright columns and is parallel to the main body cross beam.

In addition to the armrest frame 2, the supporting and fixing structure of the sofa bed further includes a bottom supporting structure 24 which is disposed under the backrest portion 3 and the seat portion 4 and is fixedly connected to the two armrest frames 2. The bottom supporting structure 24 for example includes a bottom supporting structure longitudinal beam, a bottom supporting structure transverse beam 23, and legs 25. The sofa bed further includes a driven beam 26 whose one end is pivotally connected to the armrest frame 2, and whose the other end is pivotally connected to the backrest portion 3.

FIG. 6A-FIG. 6F show a process in which the main body frame 100 transitions from a first in-use position (in which the sofa bed is used as a bed) to a second in-use position (in which the sofa bed is used as a sofa) and then back to the first in-used position.

Figure 6A:
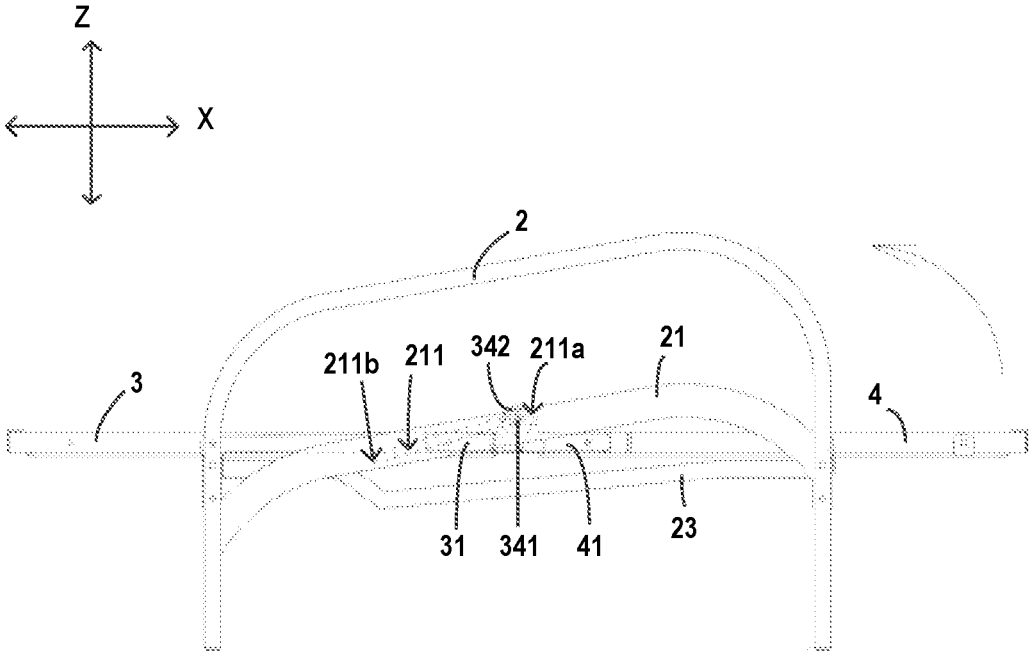
FIGS. 6A, 6B, 6C, 6D, 6E and 6F are side views of the main body frame, successively showing a process in which the sofa transitions from a first in-use state to a second in-use state, and then return back to the first in-use state.

First, referring to FIG. 6A, when the main body frame 100 is in the first in-use state, the backrest portion 3 and the seat portion 4 are both horizontal, and the angle therebetween is a straight angle. The angle between the backrest portion connecting rod 31 and the seat portion connecting rod 41 is also substantially a straight angle, and the pivot of the hinge mechanism 34 is substantially located nearby the front end 211*a* of the sliding groove 211. At this time, the backrest portion connecting rod 31 and the seat portion connecting rod 41 are not locked, which allows the seat portion 4 to be operated to pivot toward a position where the angle between the seat portion 4 and the backrest portion 3 is reduced. The direction of the pivoting is shown by the arrow in FIG. 6A.

Figure 6B:
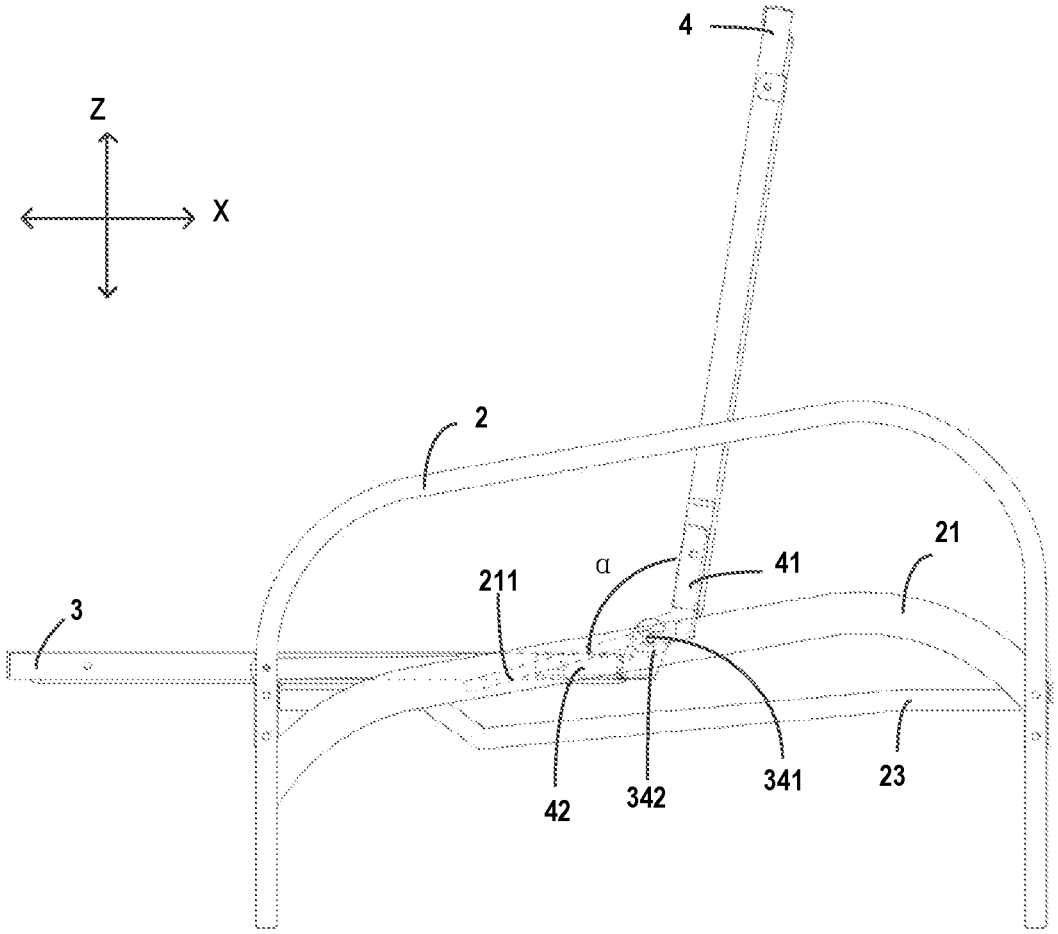

When the main body frame 100 needs to be adjusted to the second in-use state, the seat portion 4 can be pivoted in the direction shown by the arrow in FIG. 6A, to the position shown in FIG. 6B. At the position shown in FIG. 6B, the pivoting between the backrest portion connecting rod 31 and the seat portion connecting rod 41 is locked. Specifically, for example, the hinge mechanism 34 may be provided with a special-shaped ratchet 342 and a special-shaped pawl. At the position shown in FIG. 6B, the special-shaped ratchet 342 and the special-shaped pawl are shaped to snap fit together to stop the seat portion 4 from further rotating relative to the backrest portion 3. At this time, the angle between the seat portion 4 and the backrest portion 3 is a, which is an obtuse angle. The "predetermined obtuse angle" mentioned in the present invention may be understood as a in FIG. 6B.

Figure 6C:
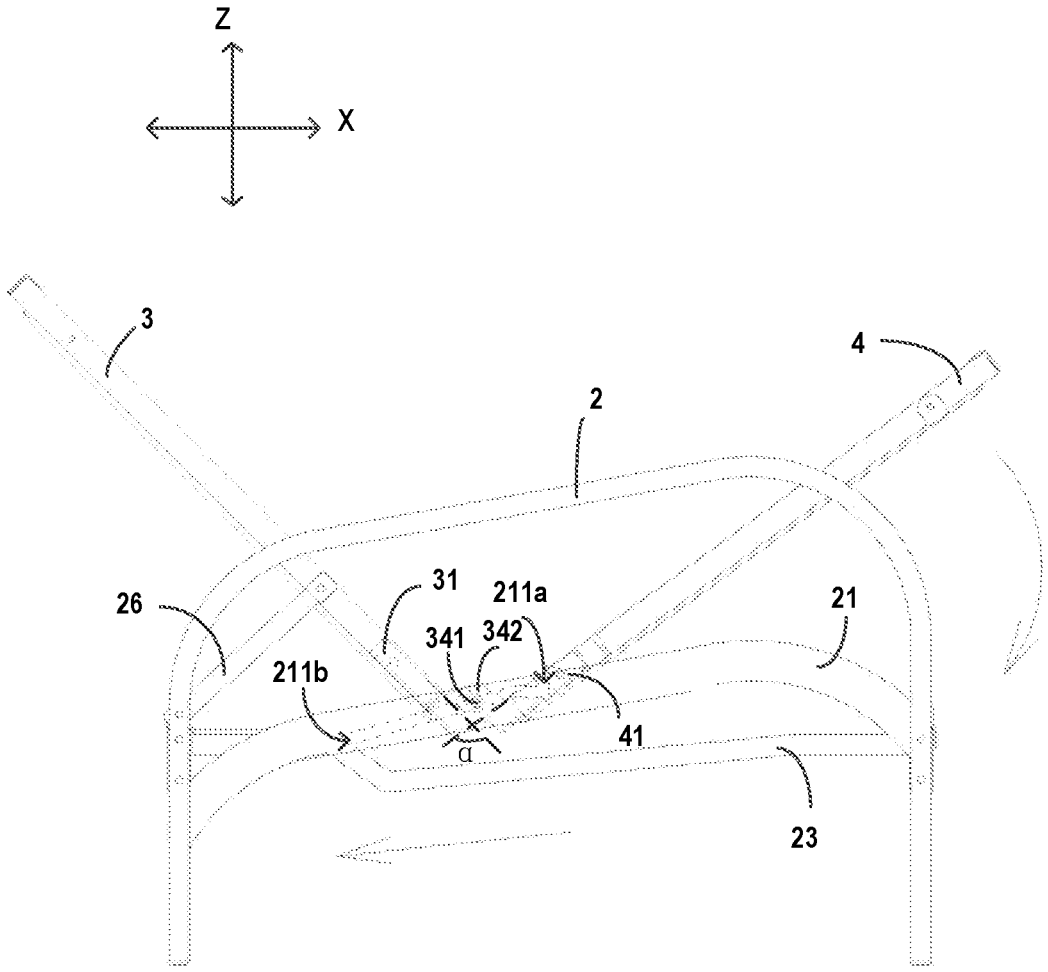

At this time, the pin 341 at the hinge mechanism 34 can enter the sliding groove 211 from the front end 211*a* of the sliding groove 211. Then, as shown in FIG. 6C, the seat portion 4 may be pressed down along an arc-shaped arrow, and meanwhile the pin 341 can drive the combination of the backrest portion 3 and the seat portion 4 to slide in a direction indicated by a straight arrow in FIG. 6C. After this operation, the combination of the backrest portion 3 and the seat portion 4 can reach the second in-use state as shown in FIG. 6D.

Figure 6D:
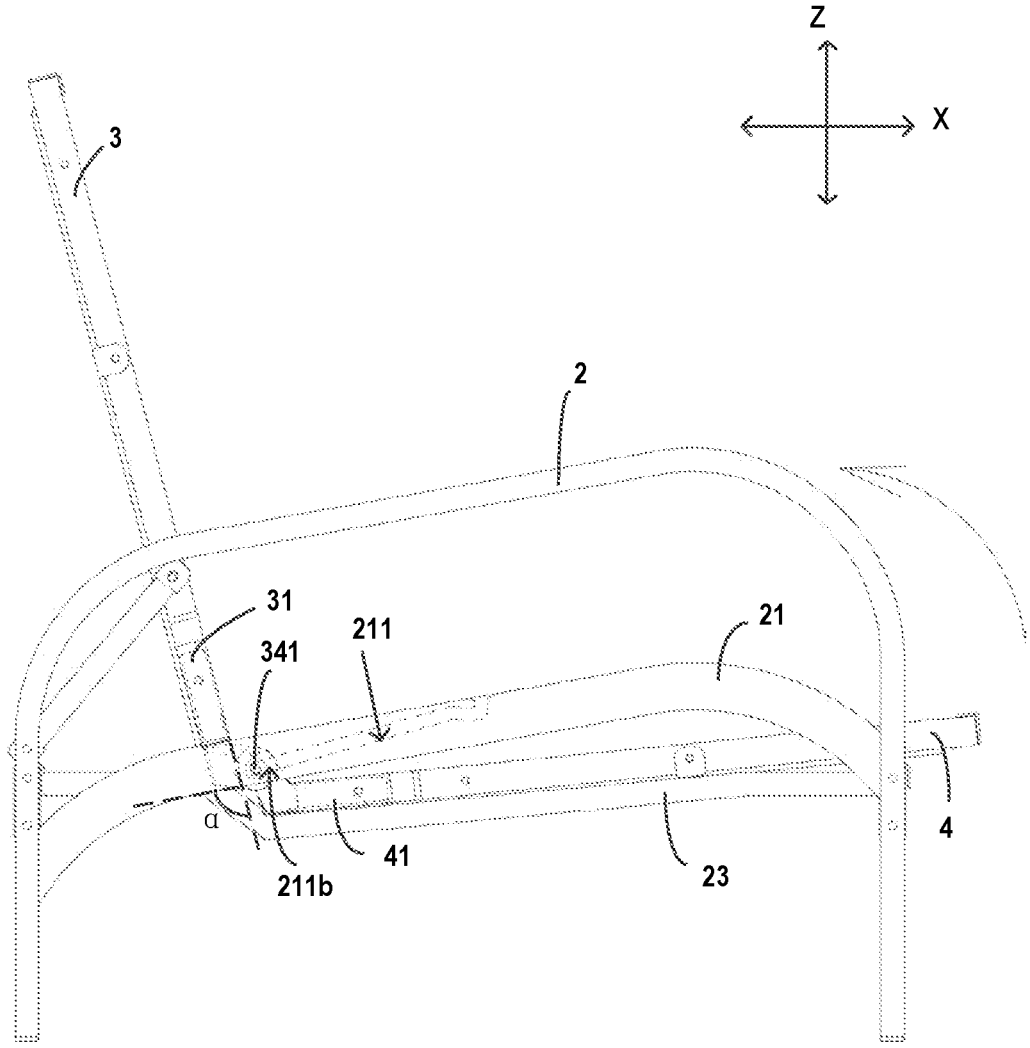

In the structure shown in FIG. 6B through FIG. 6D, the backrest portion connecting rod 31 and the seat portion connecting rod 41 are locked to each other at the hinge mechanism 34, and the angle between the backrest portion 3 and the seat portion 4 is always a.

When it is necessary to change the main body frame 100 from the second in-use position to the first in-use position, the seat portion 4 can be manually operated to further pivot toward the backrest portion 3 in the direction indicated by the arrow as shown in FIG. 6D. The action for example can make the protruding portion of the pawl disengage from the recessed portion of the ratchet, thereby releasing the locking between the seat portion connecting rod 41 and the backrest portion connecting rod 31.

Figure 6E:
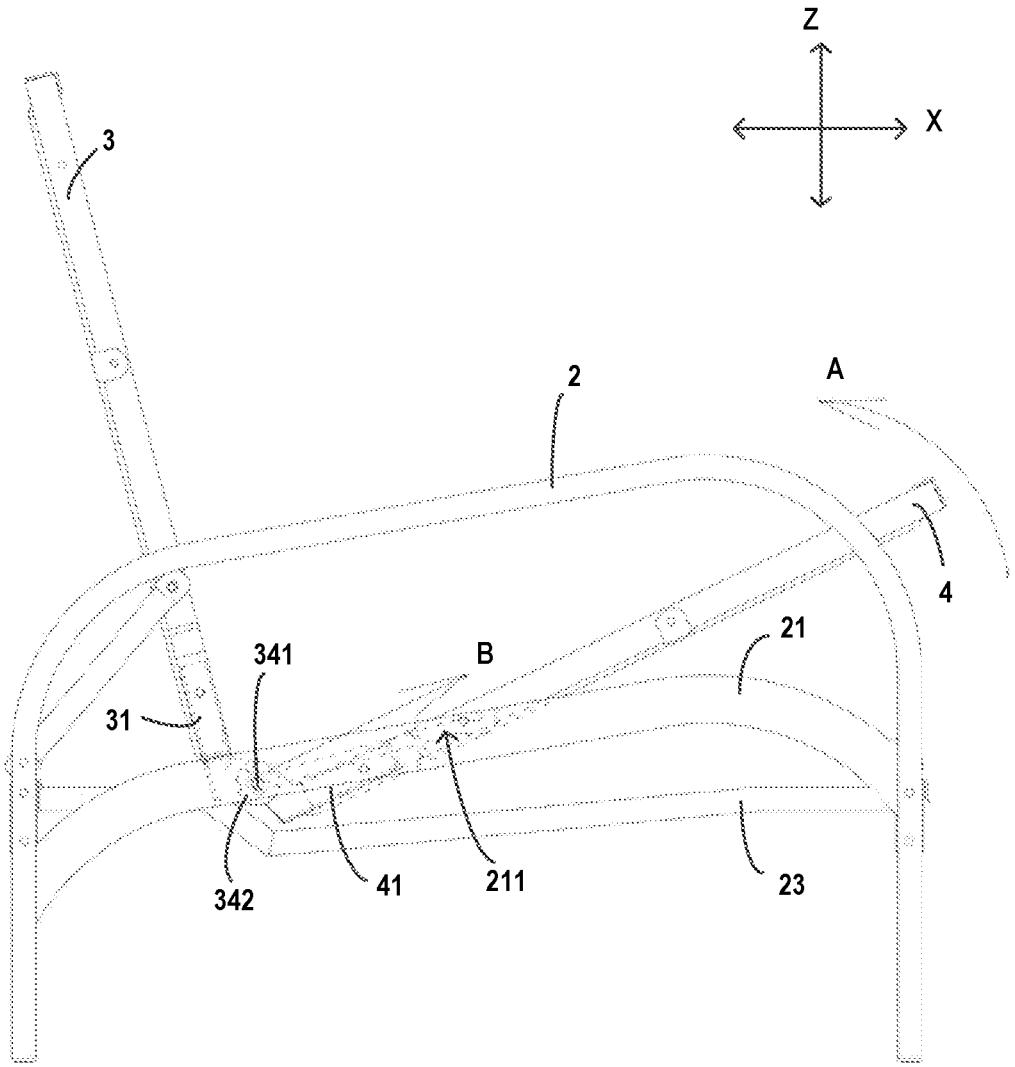
Figure 6F:
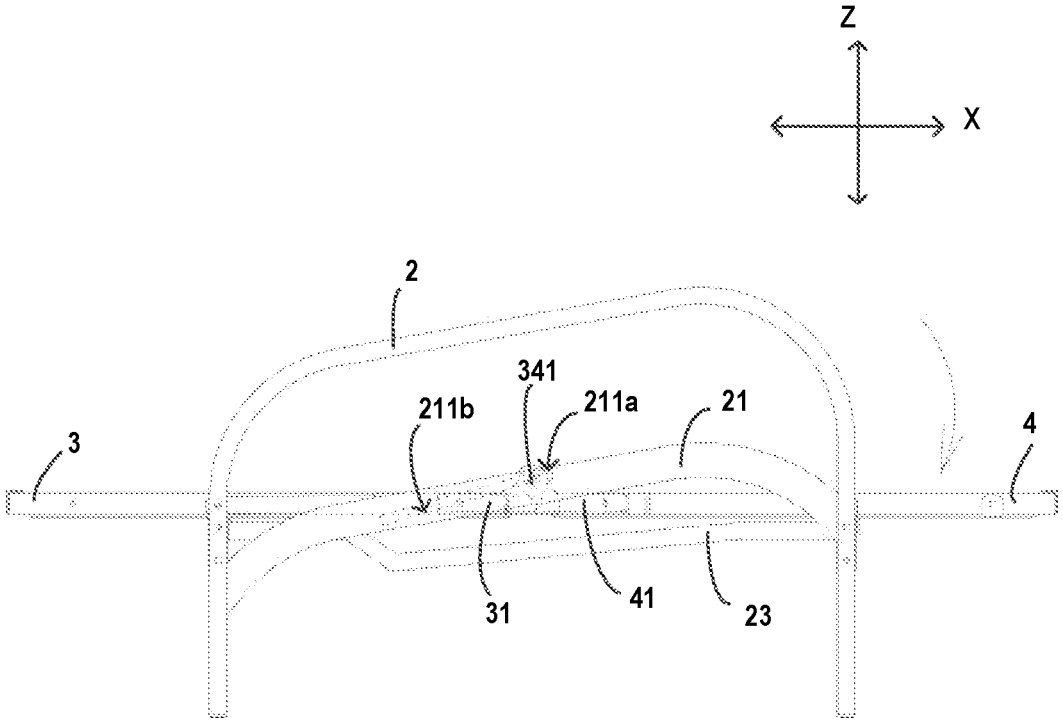

Referring to FIG. 6E, after the seat portion 4 is pivoted in the direction indicated by arrow A, the locking between the seat portion connecting rod 41 and the backrest portion connecting rod 31 is released. After the locking is released, the pin 341 is allowed to slide in the sliding groove 211 toward the front end 211*a* in the direction indicated by the arrow B, thereby driving the backrest portion 3 and the seat portion 4 to reach the position shown in FIG. 6F, so that the main body frame 100 returns to the first in-use state.

To sum up, it can be seen that the sofa bed of the present invention includes the hinge mechanism, and the hinge mechanism includes a first section (e.g., the combination of the seat portion insertion sleeve 42 and the seat portion connecting rod 41 in the above embodiments), a second section (e.g., the combination of the backrest portion insertion sleeve 32 and the backrest portion connecting rod 31 in the above embodiments) and a third section (e.g., the driven beam 26 in the above embodiments) which are sequentially connected pivotally relative to one another. The first section is fixed to a side of the seat portion, the second section is fixed to a side of the backrest portion, and the protruding portion (e.g., pin 341) is provided at a position where the first section is connected with the second section. The slideway is disposed on the armrest frame for engaging and guiding the protruding portion, an end of the third section opposite to the second section (i.e., an end of the driven beam opposite to the backrest portion connecting rod 31) is pivotally connected with the armrest frame.

In addition to the above embodiments, the hinge mechanism of the present invention may also have other preferred arrangements.

Figure 7:
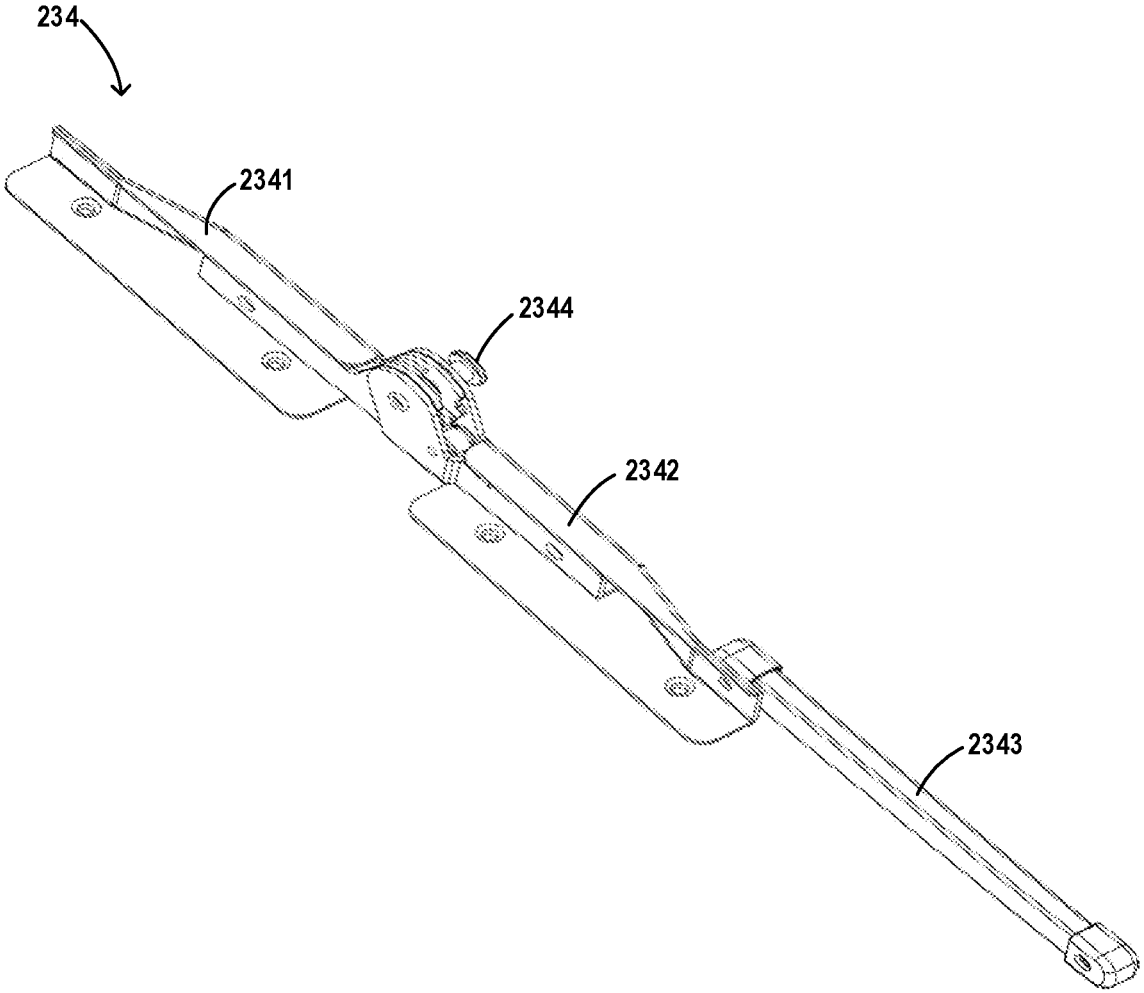
FIG. 7 and FIG. 8 are schematic views of assembling and disassembling of a hinge mechanism according to an embodiment.
Figure 8:
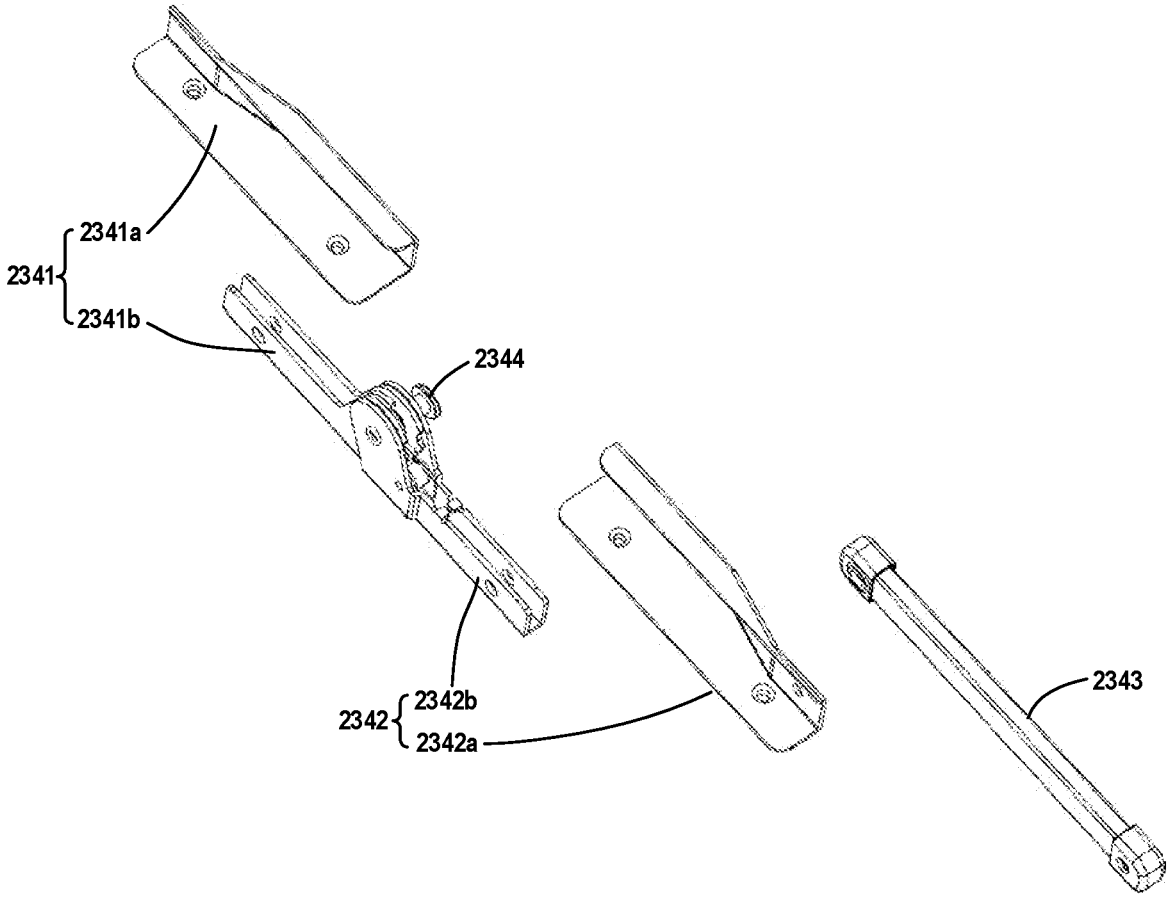

For example, referring to FIG. 7 and FIG. 8, the hinge mechanism 234 includes a first section 2341, a second section 2342 and a third section 2343. The first section 2341 includes a first section rod 2341*b* and a first section sleeve 2341*a*, the first section sleeve 2341*a* is provided with an opening toward the seat portion, the first section rod 2341*b* is placed in the first section sleeve 2341*a*, and the opening of the first section sleeve 2341*a* and the seat portion are fixed together to encapsulate the first section rod 2341*b* therein. The first section rod 2341*b* and the first section sleeve 2341*a* may be further fastened together by bolts. The second section 2342 includes a second section rod 2342*b* and a second section sleeve 2342*a*, the second section sleeve 2342*a* is provided with an opening towards the backrest portion, the second section rod 2342*b* is placed in the second section sleeve 2342*a*, and the opening of the second section sleeve 2342*a* and the backrest portion are fixed together to encapsulate the second section rod 2342*b* therein. The first section rod 2341*b* and the second section rod 2342*b* may also be pivotally connected. The second section rod 2342*b* and the second section sleeve 2342*a* may also be further fastened together by bolts. One end of the third section 2343 is pivotally connected to the second section sleeve 2342*a*, and the other end of the third section 2343 is pivotally connected to the armrest frame 202.

Figure 11:
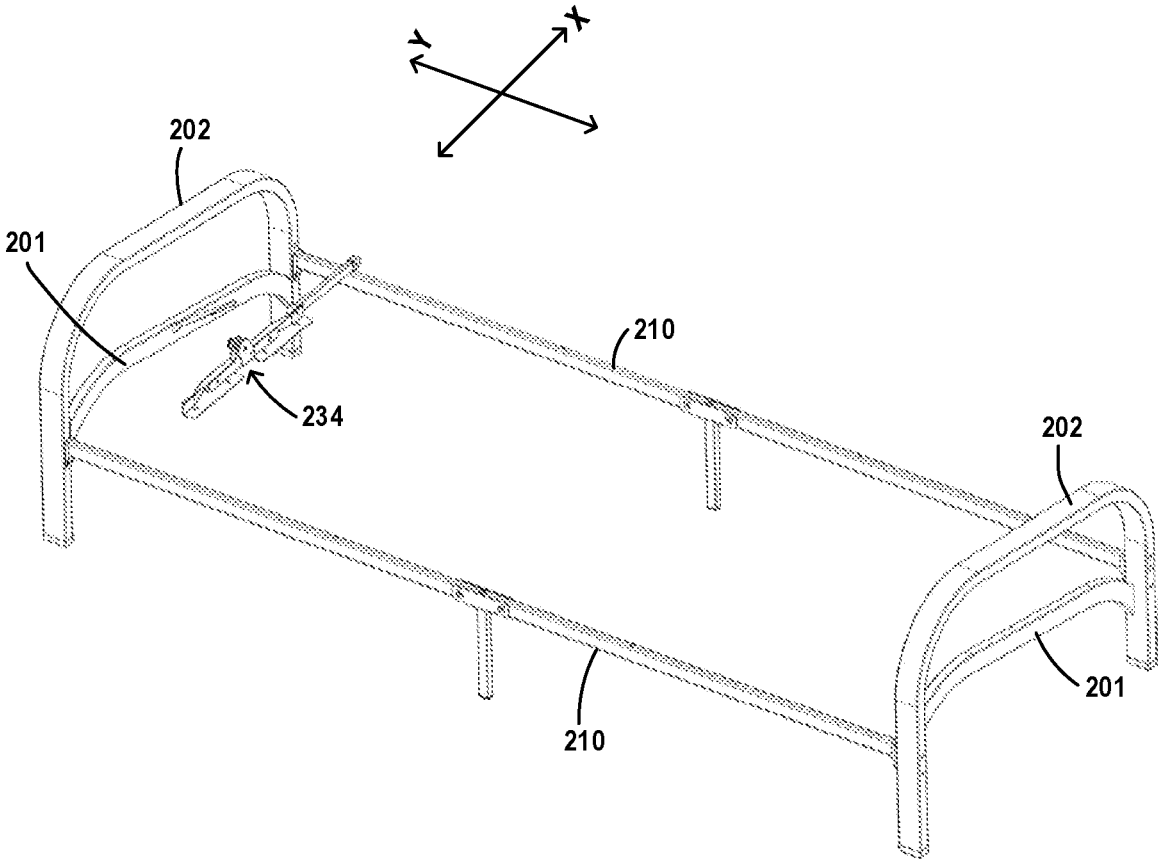
FIG. 11 is a schematic view of a part of a bottom supporting structure of the sofa bed, wherein the hinge mechanism is not mounted in position.
Figure 12:
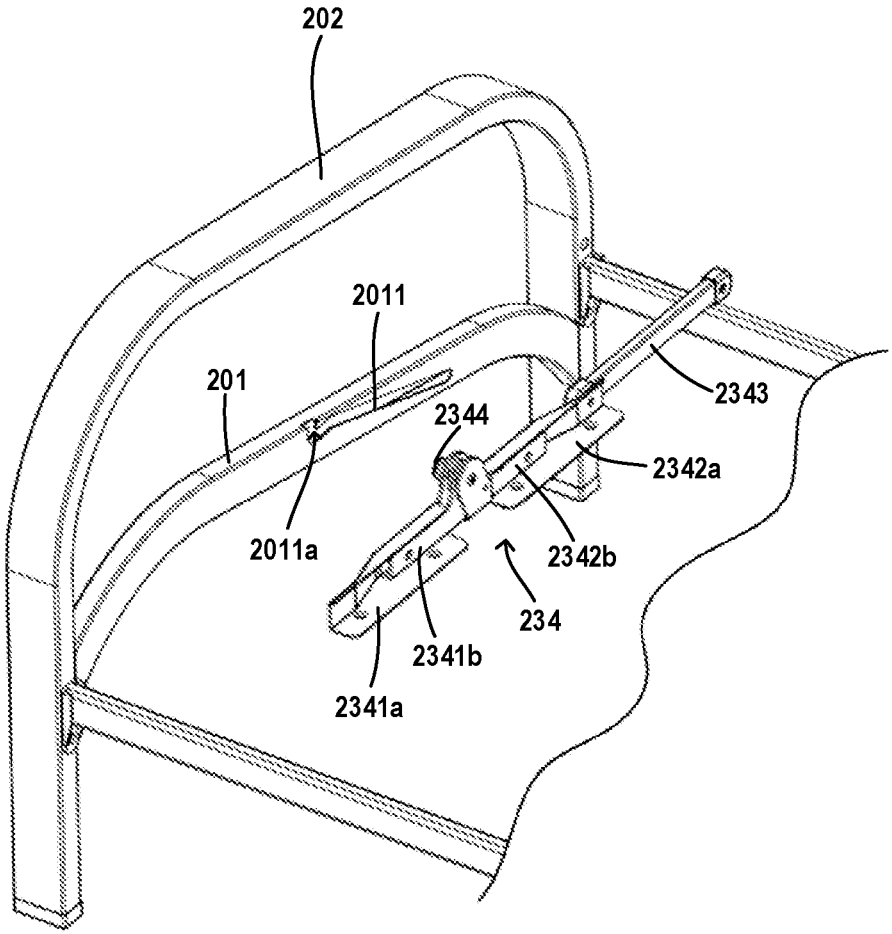
FIG. 12 is a partially enlarged view of FIG. 11.
Figure 13:
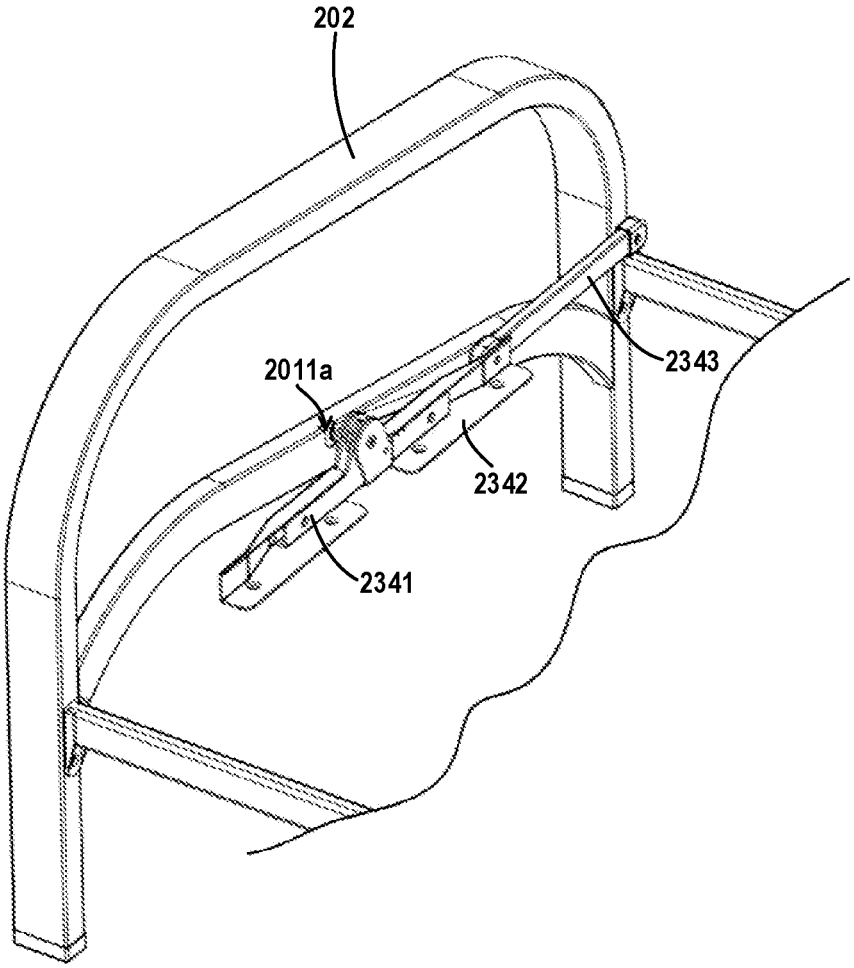
FIG. 13 is a partial schematic view of a bottom supporting structure of the sofa bed, wherein the hinge mechanism is already mounted in position.

The mounting and connection relationship between the hinge mechanism and the bottom supporting structure 210 is shown in FIG. 11-FIG. 13. As shown in the figure, an armrest frame 202 has a reinforcing beam 201, and a slideway 2011 having an opening 2011*a* is formed on the reinforcing beam. A protruding portion 2344 at the connection of the first section 2341 and the second section 2342 can extend from the opening 2011*a* into the slideway 2011 of the armrest frame 202 and can slide in the slideway 2011. Specifically, the protruding portion 2344 slides in the slideway 2011 in a case where an angle between the first section 2341 and the second section 2342 is locked.

Figure 9:
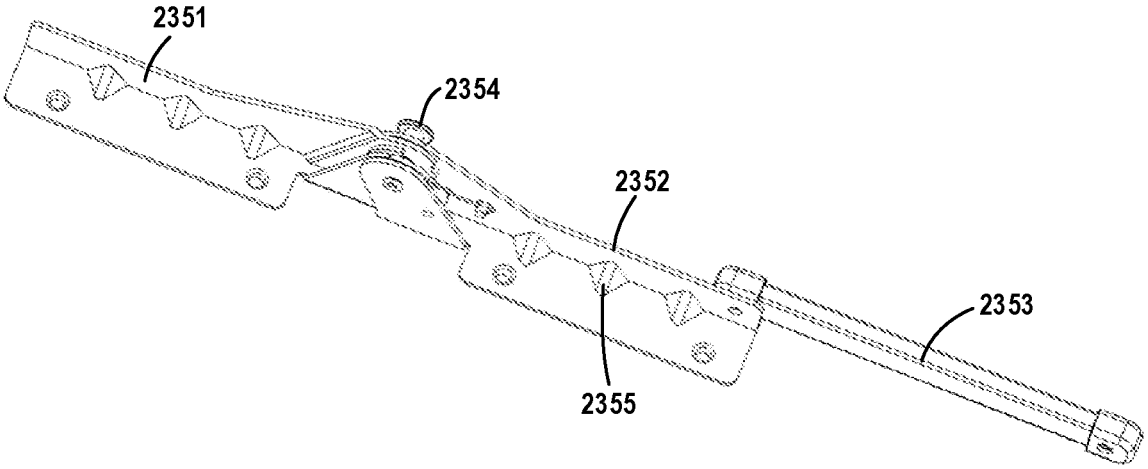
FIG. 9 and FIG. 10 are schematic views of assembling and disassembling of a hinge mechanism according to another embodiment.
Figure 10:
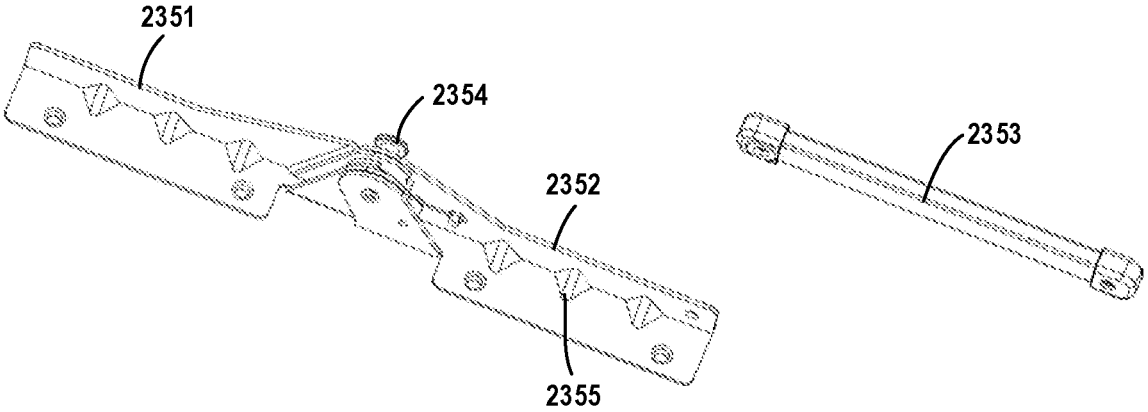

FIG. 9 and FIG. 10 are schematic views of another hinge mechanism of the sofa bed according to the present invention. Referring to FIG. 9, a first section 2351, a second section 2352 and a third section 2353 are sequentially and pivotably connected, wherein, the first section 2351 is a one-piece member, and the second section is also a one-piece member. If the first section 2351 and the second section 2352 are sectioned with a plane perpendicular to a direction in which the first section 2351 and the second section 2352 are pivoted relative to each other, it can be seen that the sections of the first section 2351 and the second section 2352 are L-shaped. In order to make the first section 2351 and the second section 2352 which are L-shaped in cross section have better stability, reinforcing portions 2355 are provided at an angle of the two walls forming the L shape, and reinforcing portions 2355 comprise a plurality of reinforcing portions and are disposed in an extending direction of the first section 2351 and the second section 2352. A protrusion 2354 capable of engaging with the slideway is disposed at the connection between the first section 2351 and the second section 2352.

FIG. 14-FIG. 22 illustrate another preferred embodiment according to the present invention.

Figure 14:
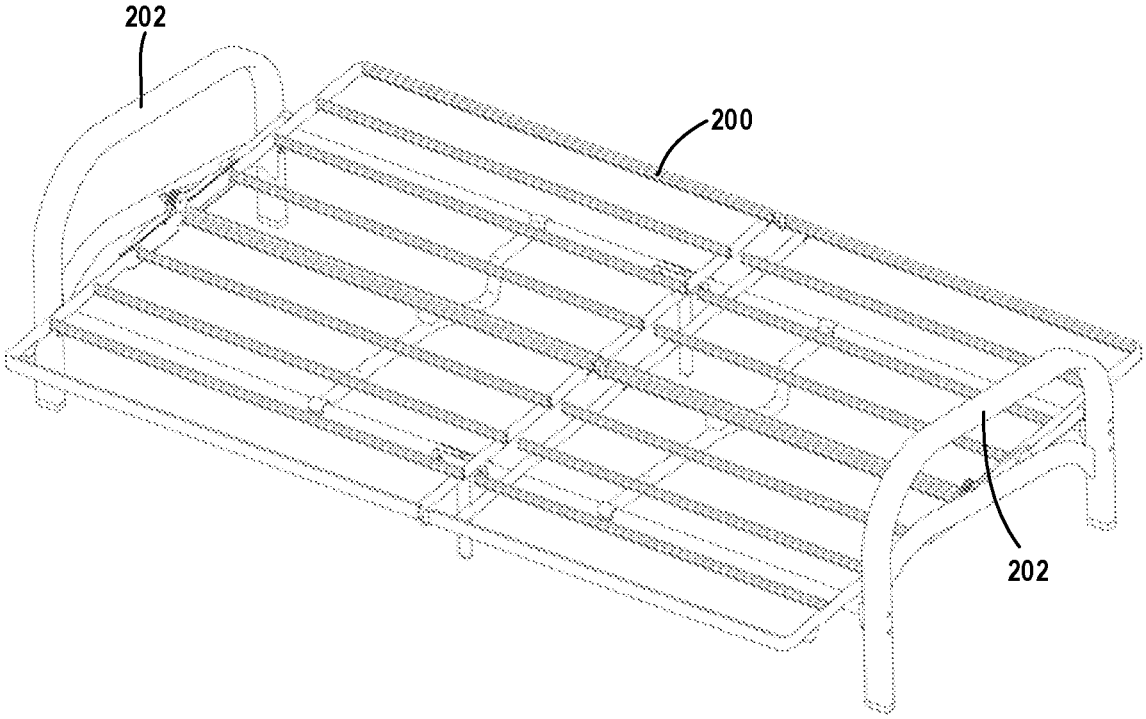
FIG. 14 and FIG. 15 are schematic views after the bottom supporting structure of FIG. 13 is mounted with the main body frame.
Figure 15:
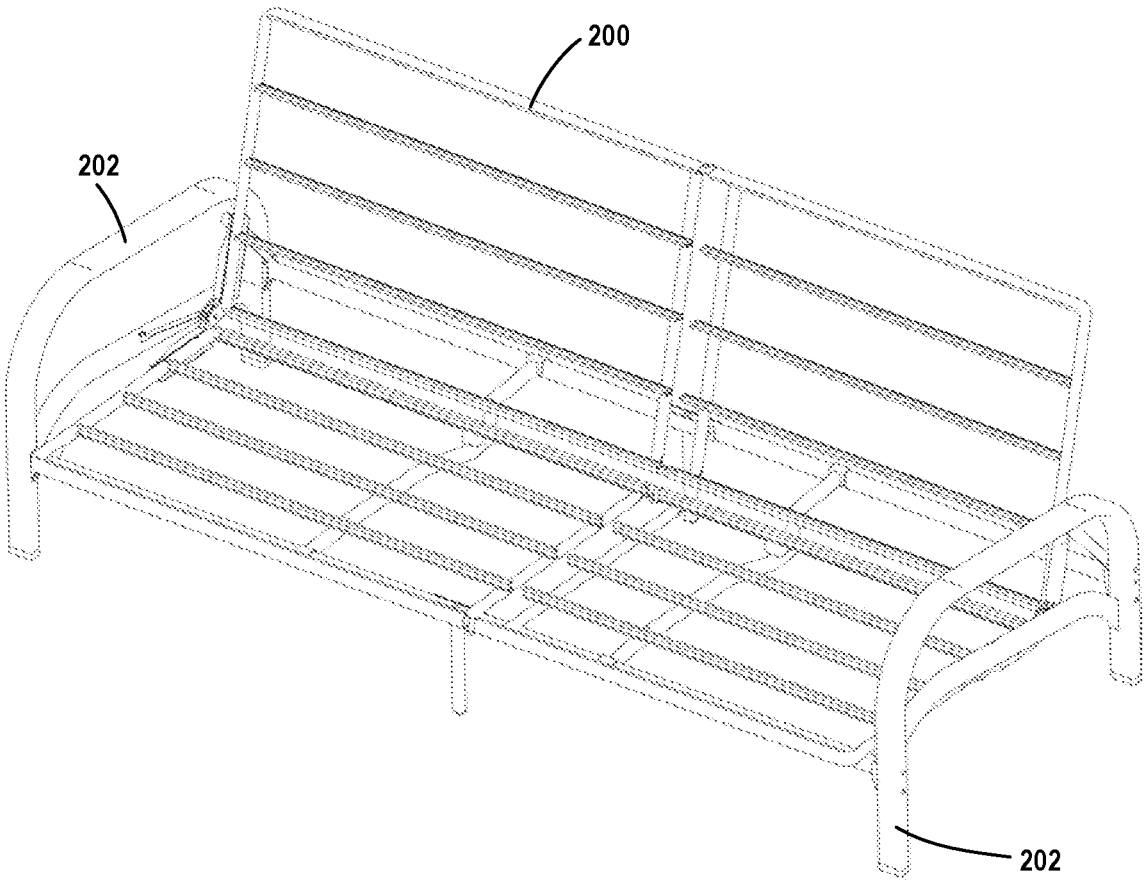

Referring to FIG. 14 and FIG. 15, the sofa bed includes a main body frame 200 and an armrest frame 202, and the seat portion 204 and the backrest portion 203 of the main body frame 200 can transition between a sofa configuration and a bed configuration.

Figure 16:
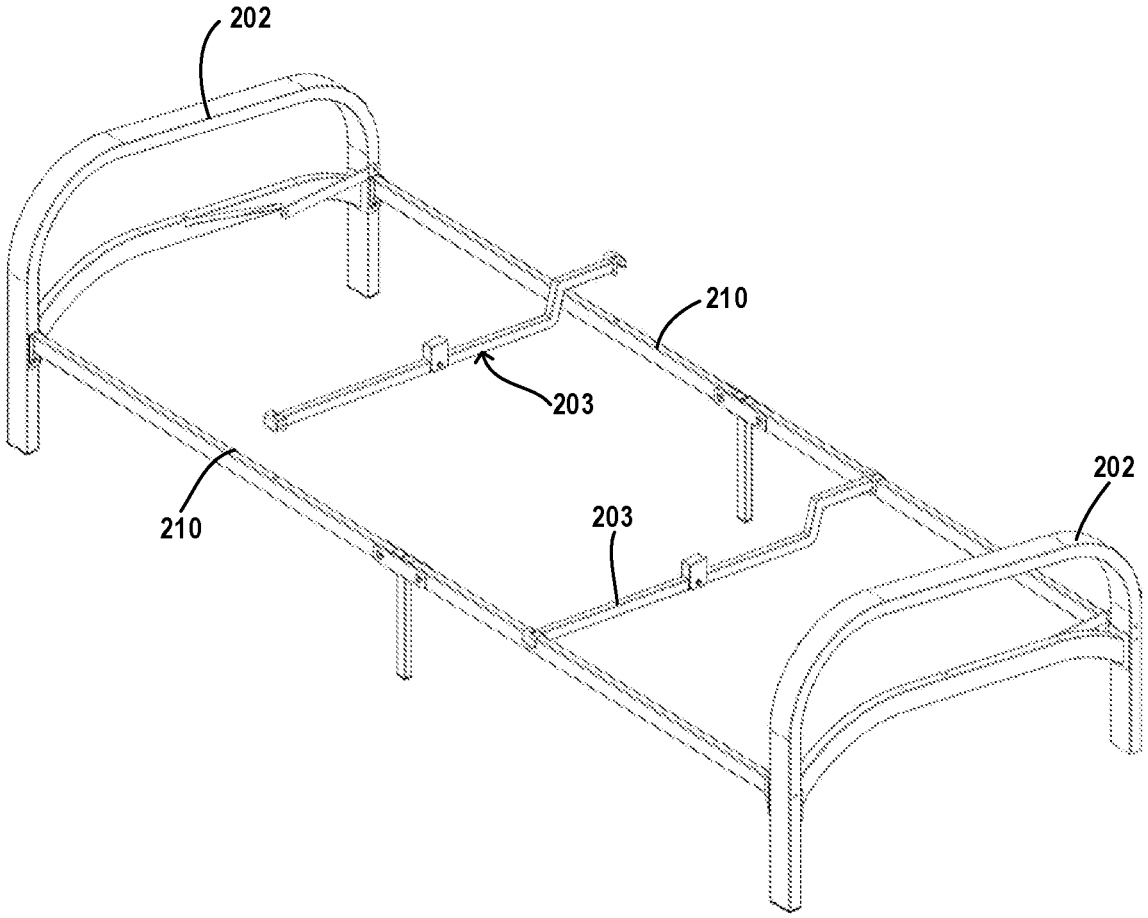
FIG. 16 is a partial structural schematic view of a bottom supporting structure of the sofa bed according to an embodiment.

FIG. 16 shows a schematic view of a bottom supporting structure 210 of the sofa bed in FIG. 14 and FIG. 15 after the main body frame 200 is detached. The bottom supporting structure 210 includes a support pipe 203 extending substantially in a transverse direction, and the number of support pipe 203 may be one, two or more. In the present embodiment, the support pipe serves as a bracket, while in other embodiments the bracket may have other forms. The support pipe 203 is provided with a first supporting structure and a second supporting structure, wherein the first supporting structure is configured to support the position where the seat portion 204 and the backrest portion 203 are connected when the main body frame 200 is in the bed configuration; the second supporting structure is configured to support both the seat portion 204 and the backrest portion 203 when the main body frame 200 is in the sofa configuration.

Figure 17:
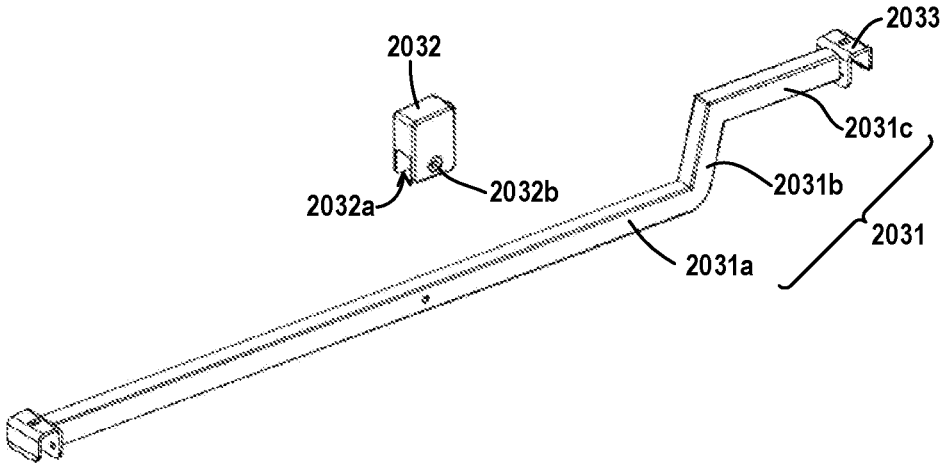
FIG. 17 is a schematic view of a supporting pipe shown in FIG. 16.

Referring to FIG. 17, in the present embodiment, a main body 2031 of the support pipe extends in the transverse direction of the seat portion 204 and the backrest portion 203, and the main body 2031 of the support pipe includes a first support pipe section 2031*a*, a second support pipe section 2031*b* and a third support pipe section 2031*c* which are connected sequentially, the main body 2031 of the support pipe is provided with a support block 2032, a lower end of the support block 2032 may have a U-shaped opening 2032*a*, and the U-shaped opening 2032*a* can be snapped on the main body 2031 of the support pipe, and the support block 2032 may have a riveting hole for engaging with the main body 2031 of the support pipe, and the support block 2032 may be mounted on the main body of the support rod by welding or riveting.

Figure 18:
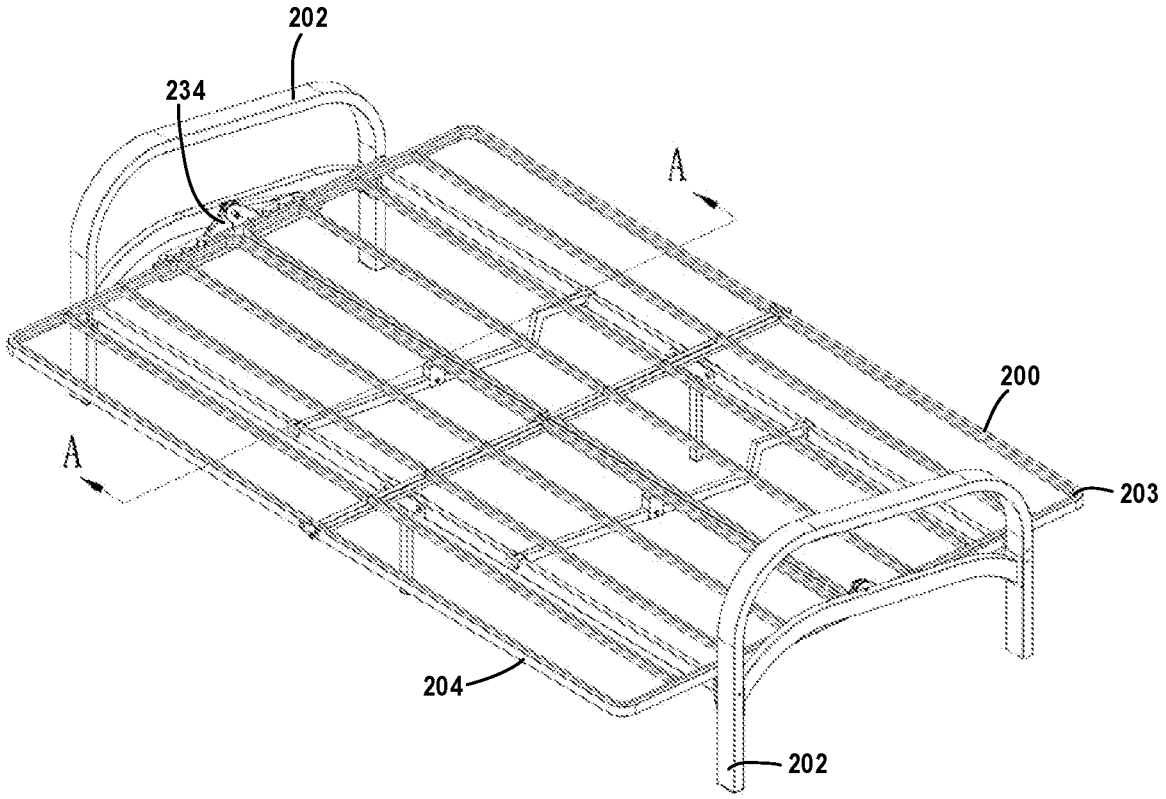
FIG. 18 is a schematic view when the main body frame is mounted on the bottom supporting structure in FIG. 16 and the sofa bed is in the first in-use state.
Figure 19:
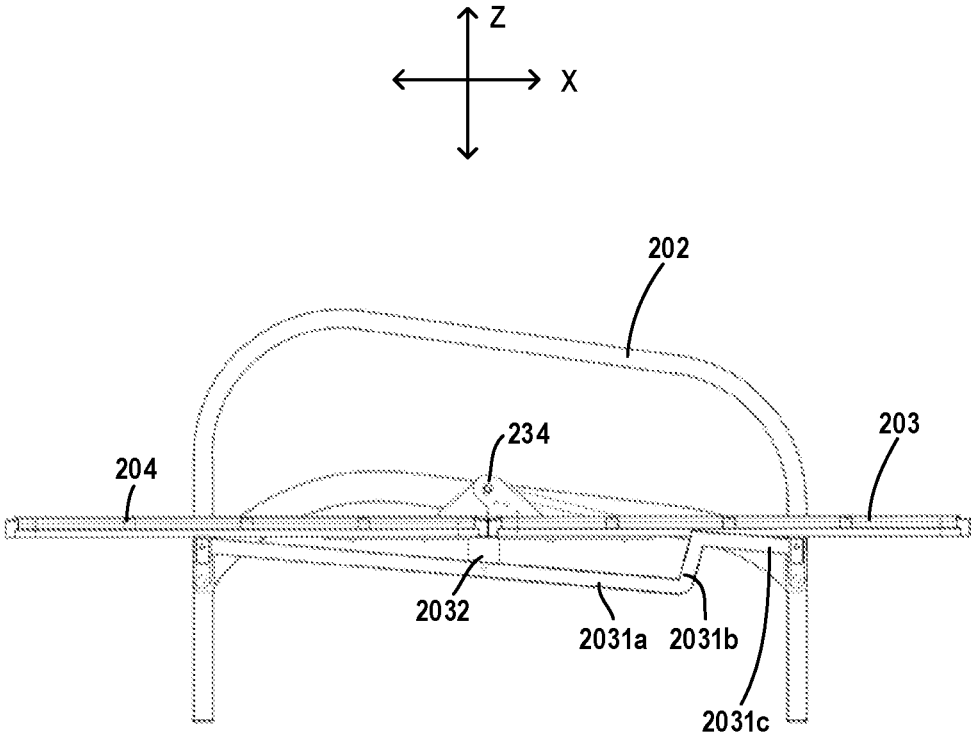
FIG. 19 is a sectional view taken along line A-A shown in FIG. 18.

Referring to the state in which the main body frame 200 is in the bed configuration as shown in FIG. 18 and FIG. 19, the support block 2032 is located below the position where the seat portion 204 and the backrest portion 203 are connected (the hinge mechanism 234 is disposed at the longitudinal end of the connection position) and supports the seat portion 204 and the backrest portion 203 simultaneously, so that the main body frame 200 is stably located in the bed configuration. That is, in the present embodiment, the support block 2032 constitutes the first supporting structure of the support rod.

Figure 20:
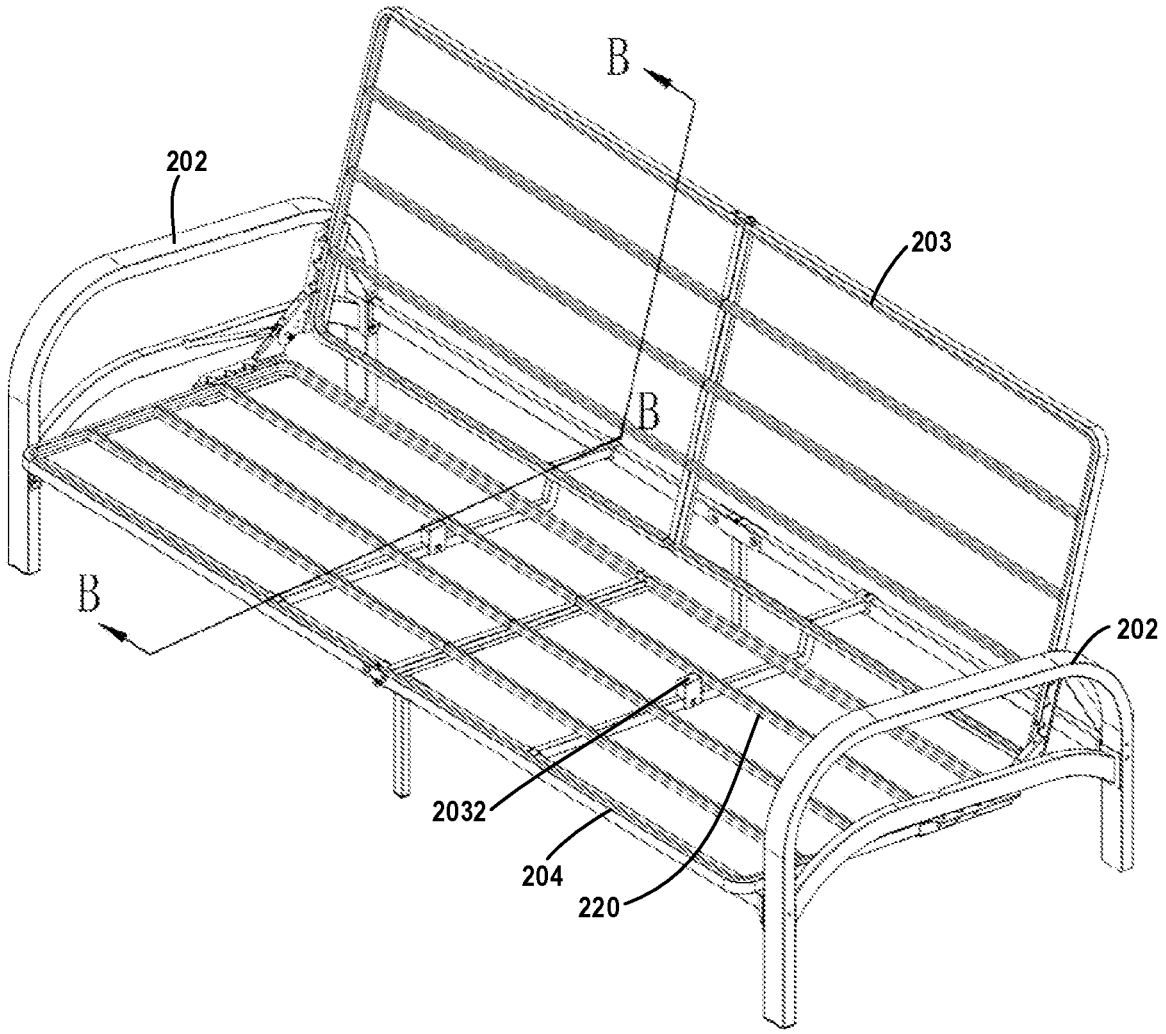
FIG. 20 is a schematic view when the main body frame is mounted on the bottom supporting structure in FIG. 16 and the sofa bed is in the second in-use state.
Figure 21:
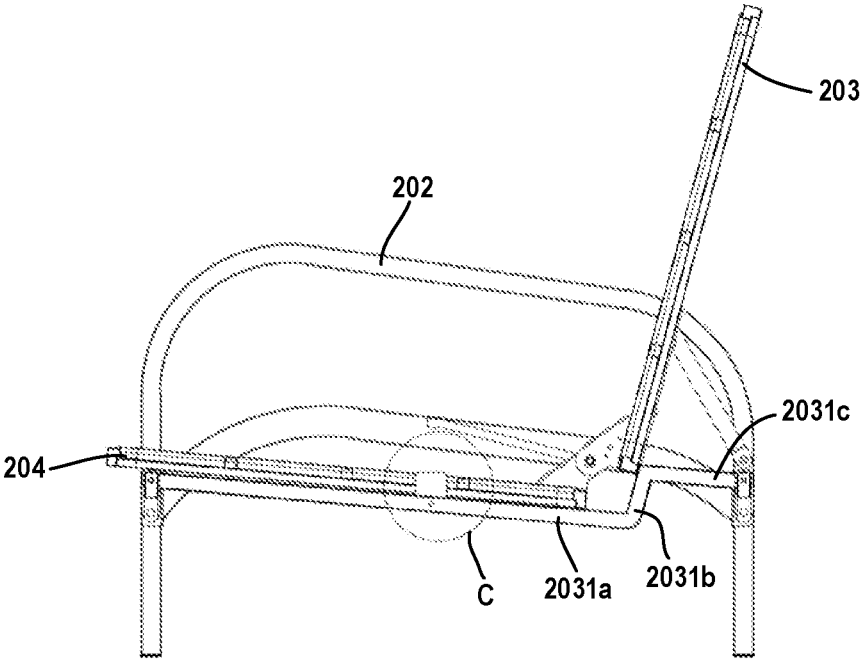
FIG. 21 is a sectional view taken along line B-B shown in FIG. 20.

Referring to the state when the main body frame 200 is in the sofa configuration as shown in FIG. 20 and FIG. 21, it can be seen that the first section 2031*a* of the support pipe 203 abuts against and supports a bottom surface of the seat portion 204, and the second section 2031*b* of the support pipe 203 abuts against and supports a surface of the backrest section 203 facing away from the seat portion 204, that is, the surfaces of the support rod first section 2031*a* and the support rod second section 2031*b* of the support pipe 203 facing the main body frame 200 jointly form the second supporting structure for the support rod.

Figure 22:
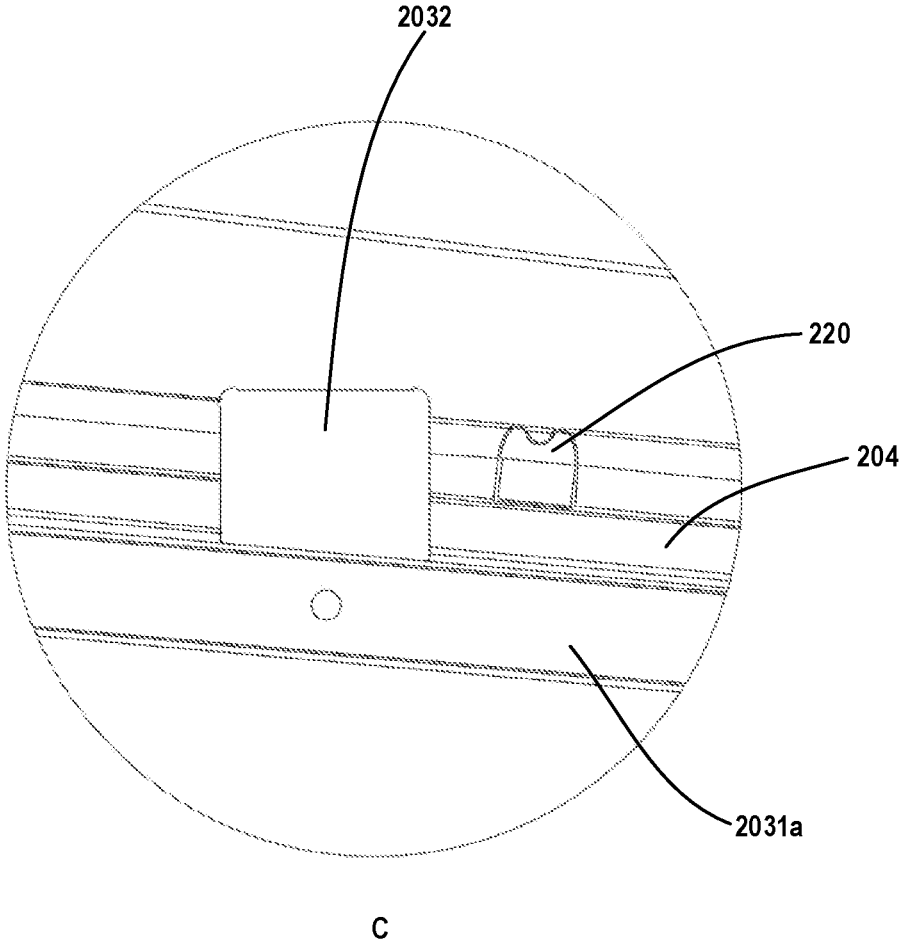
FIG. 22 is a partial enlarged view of FIG. 21.

Preferably, further referring to FIG. 20, the backrest portion 203 and the seat portion 204 each include a plurality of longitudinal beams 220 extending in the longitudinal direction. Referring to FIG. 22, the support block 2032 is configured to be positioned forward of a longitudinal beam 220 of the seat portion 204 to limit the forward slide of the seat portion 204 when the main body frame 200 is in the bed configuration. Referring to FIG. 18 and FIG. 19, when the main body frame 200 is in the bed configuration, the longitudinal beam of the backrest portion 203 closest to the seat portion 204 and the longitudinal beam of the seat portion 204 closest to the backrest portion 203 are in close contact with each other, and the support block 2032 contact sand supports the two longitudinal beams.

Figure 23:
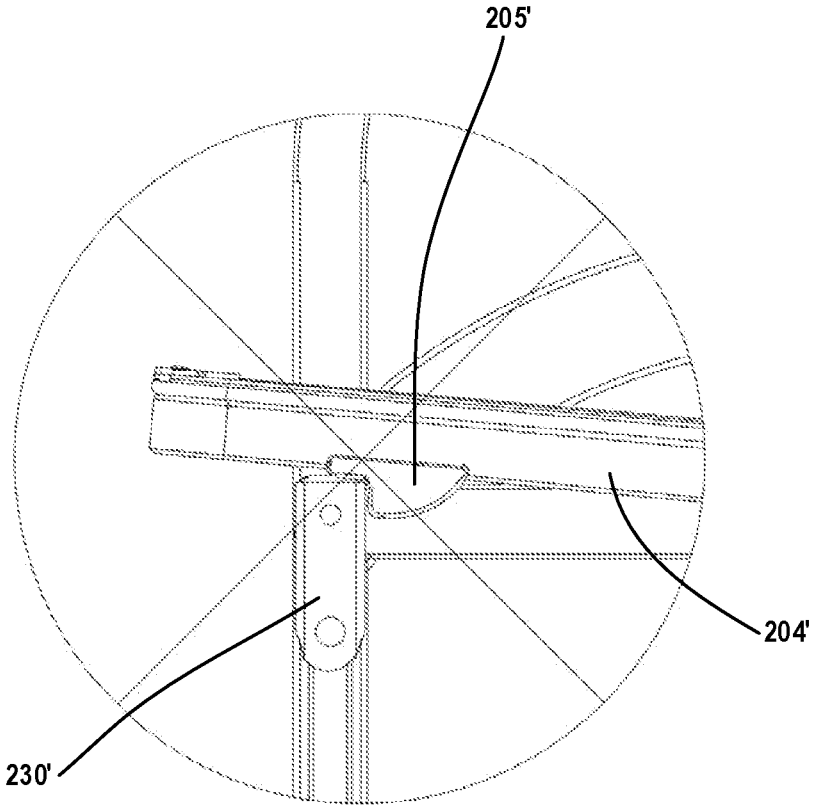
FIG.23 PRIOR ART
FIG. 23 is a view showing a structure of the prior art for comparison with the present invention.

As a comparison with the present invention, FIG. 23 shows a limiting supporting structure of a conventional sofa bed. It can be seen that in this structure, a limiting and fixing device 205' is provided on the leg 230' to support a bed plate 204' in a sofa configuration, but the supporting structure cannot support the bed plate when the bed plate is in a bed configuration. The present invention overcomes this defect. In the present invention, the support pipe as shown in FIG. 17 is provided, and the sofa bed in the present invention needn't be provided with the traditional limiting and fixing structure as shown in FIG. 23. Certainly, the present invention can also be provided with a limiting supporting structure as shown in FIG. 23.

Preferably, turning back to FIG. 16 and FIG. 17, the bottom supporting structure 210 includes two longitudinal bottom supporting structure pipes located at two transverse outermost edges respectively; both ends of the main body 2031 of the support pipe are respectively provided with downward-opened and U-shaped portion 2033; when the support pipe 203 is mounted on the bottom supporting structure 210, the two longitudinal bottom supporting structure pipes are respectively embedded in the two U-shaped portions 2033 of the support pipe 203.

Figure 24:
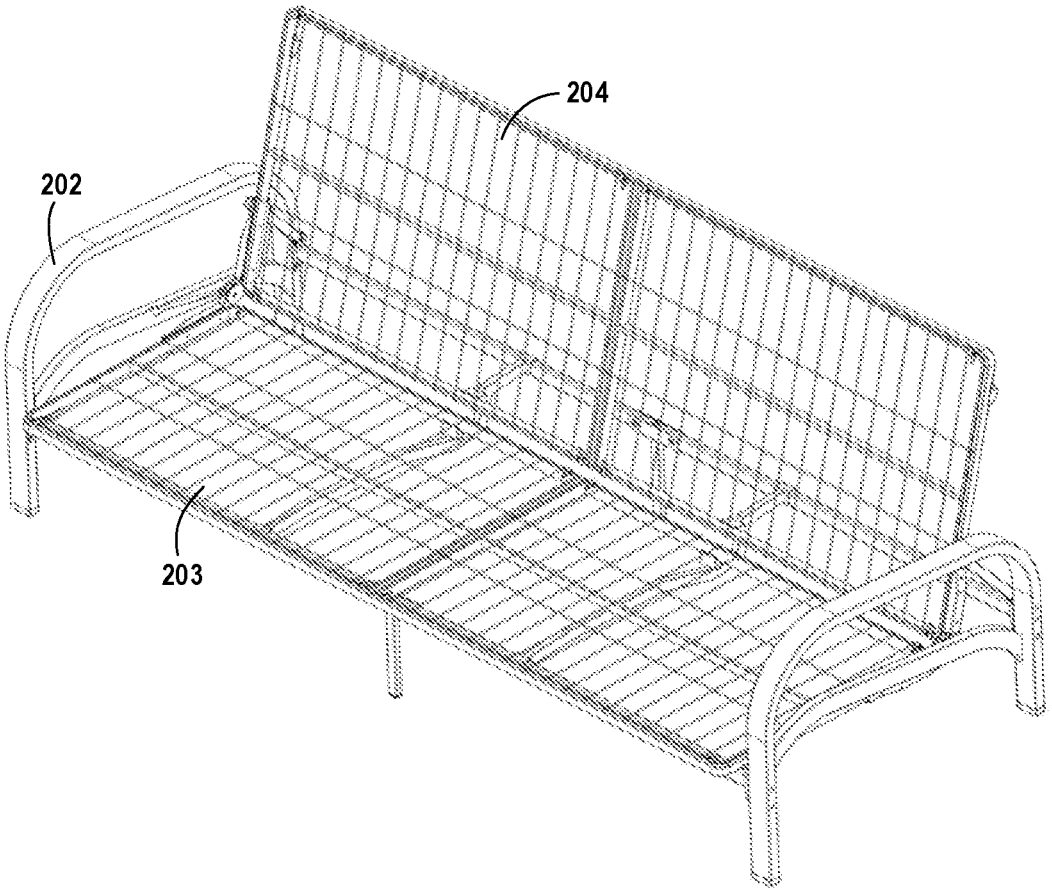
FIG. 24 is a schematic view of a sofa bed according to a preferred embodiment of the present invention.

FIG. 24-FIG. 29 illustrate another preferred embodiment according to the present invention. Referring to FIG. 24, the sofa bed includes a main body frame composed of a seat portion 203 and a backrest portion 204, and an armrest frame 202. Both the seat portion 203 and the backrest portion 204 include a mesh panel structure.

Figure 25:
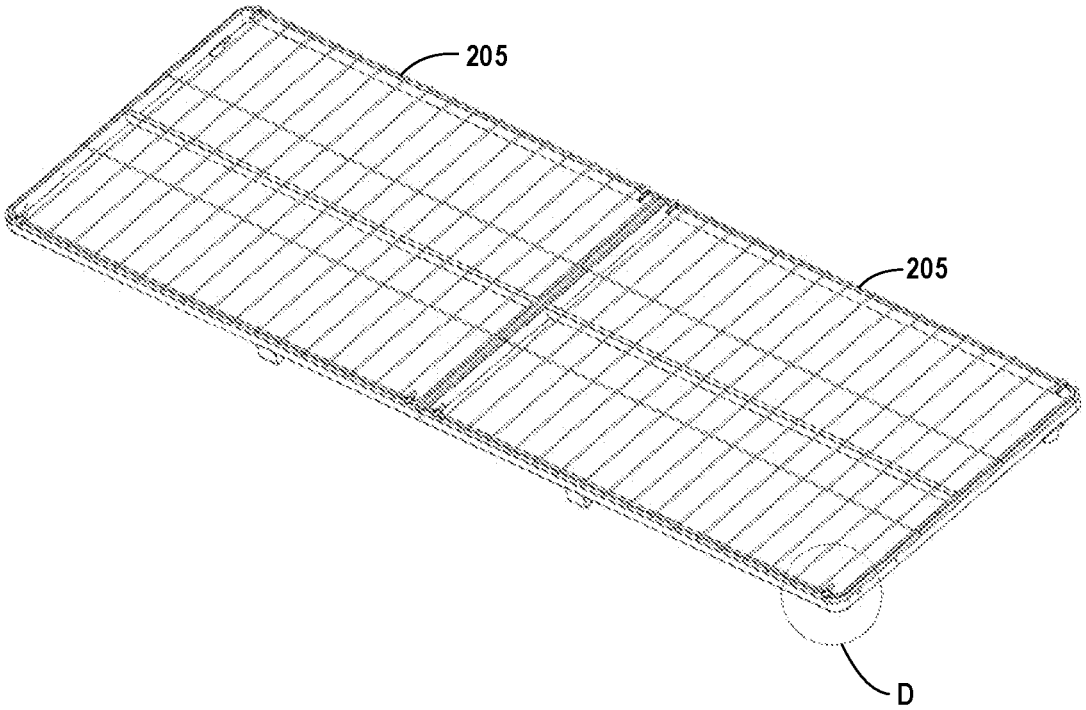
FIG. 25 is a schematic view of a seat portion or a backrest portion of the sofa bed in FIG. 24.

FIG. 25 may be a separate schematic view of the seat portion 203 or the backrest portion 204 in FIG. 24, wherein the seat portion 203 and the backrest portion 204 may both include main body units 205. By way of an example, FIG.

Figure 26:
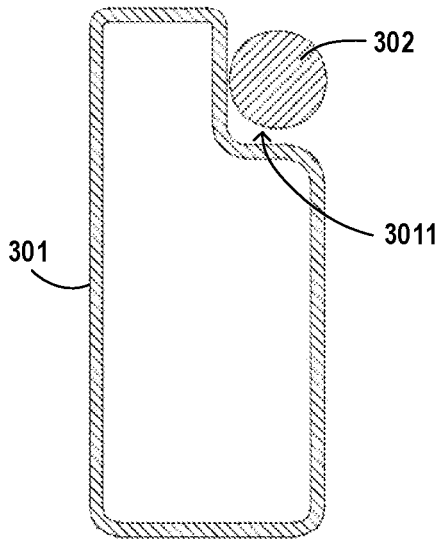
FIG. 26 is a sectional view of a partial portion shown in FIG. 25.

25 shows the seat portion 203 of FIG. 24. The seat portion 203 includes two main body units 205 arranged in the longitudinal direction, and each main body unit 205 includes a unit frame 301 and a unit mesh panel 302. Referring to FIG. 26, the unit frame 301 is provided with a step 3011 around an inner edge of the unit frame 301 and integrally disposed around the main body of the unit frame 301. The step 3011 may be disposed intermittently or continuously. The unit mesh panel 302 includes an edge rib around its edge. The unit mesh panel 302 is detachably mounted on the unit frame 301 and the edge rib fits on the step 3011.

Figure 27:
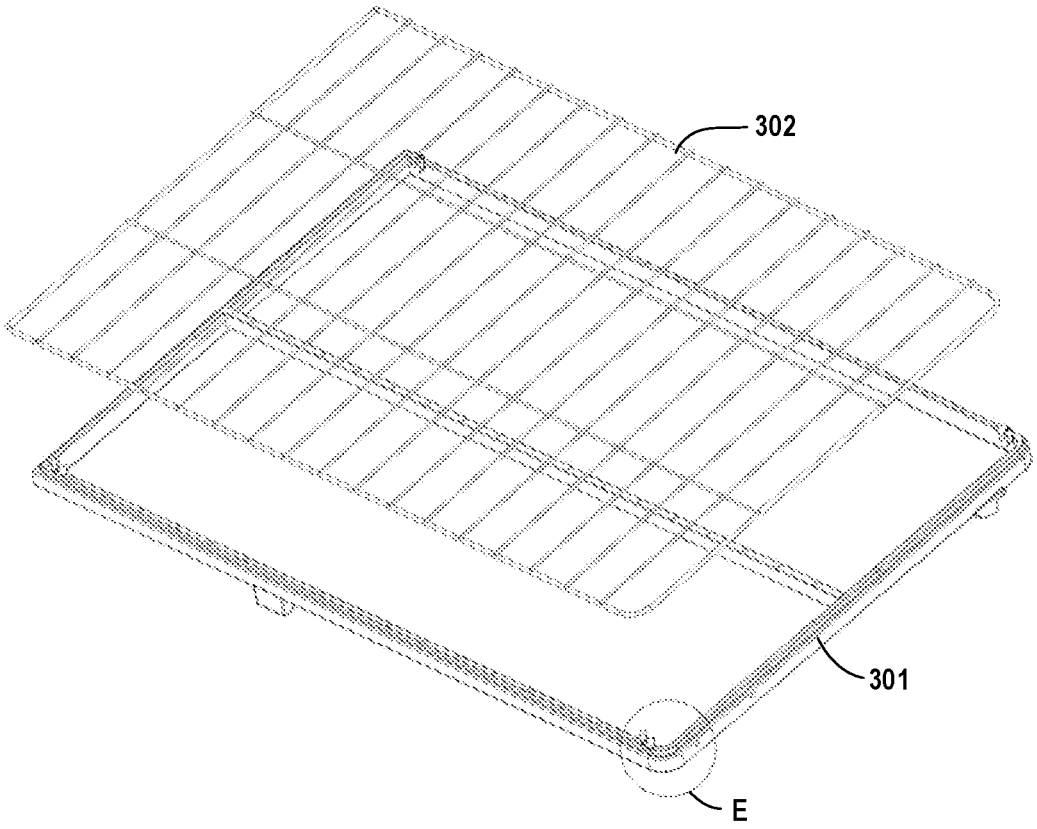
FIG. 27 is an exploded schematic view of the structure shown in FIG. 25.
Figure 28:
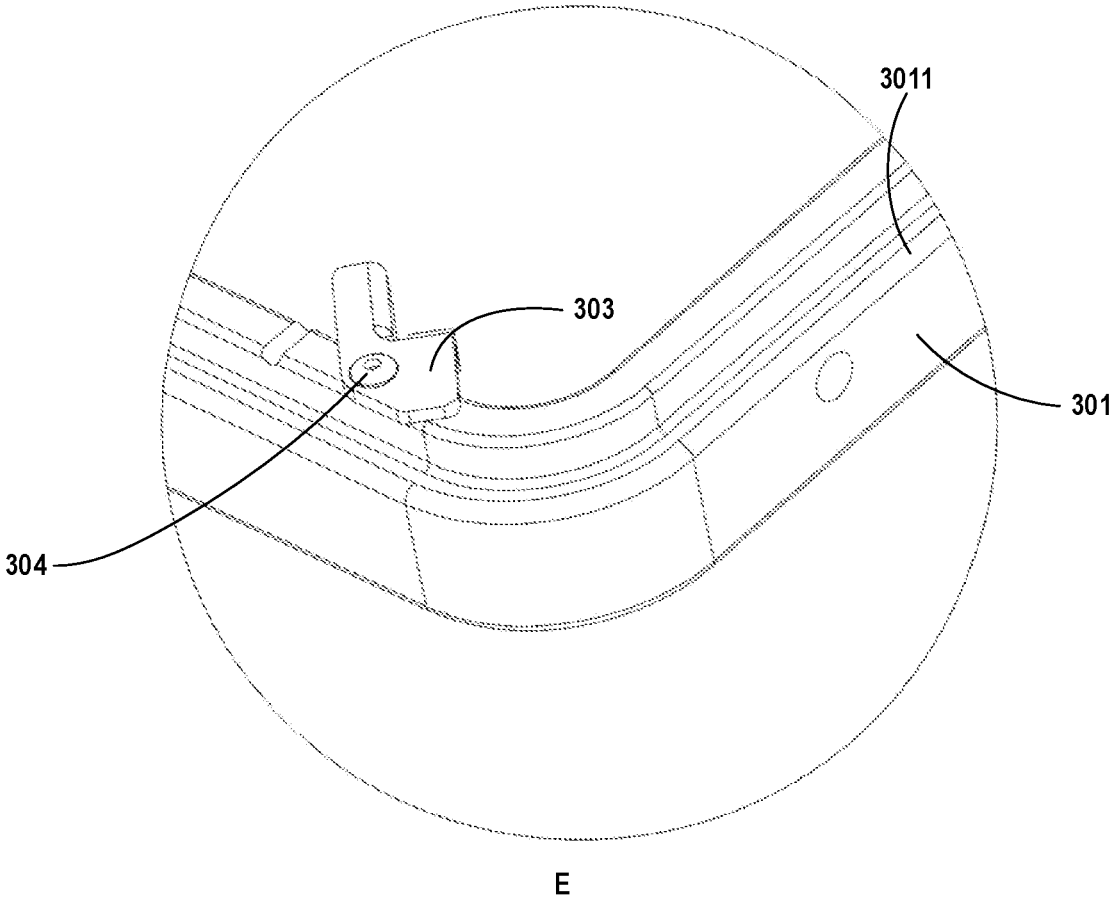
FIG. 28 is a partially enlarged view of a unit frame shown in FIG. 27.
Figure 29:
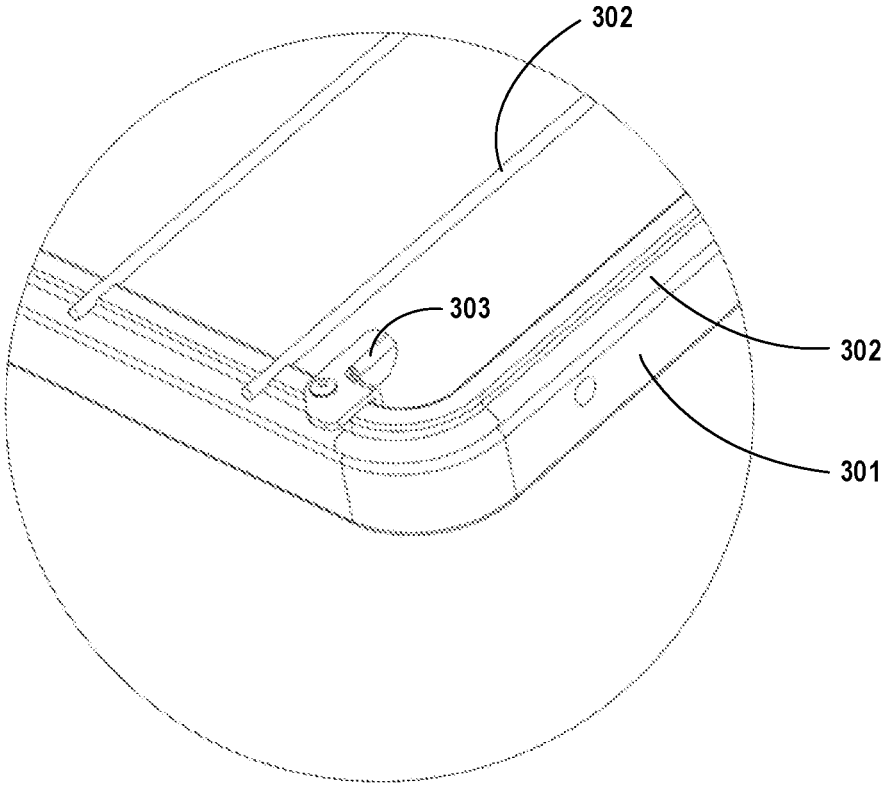
FIG. 29 is a partially enlarged view of FIG. 25.

FIG. 27 and FIG. 28 show schematic views after the unit mesh panel 302 is removed from the unit frame 301, and FIG. 29 shows a schematic view showing the unit mesh panel 302 mounted on the unit frame 301. As can be seen from FIG. 28 and FIG. 29, the unit frame 301 is further mounted with a toggle piece 303 which is configured to be operable to move between a first position (as shown in FIG. 29) where the toggle piece 303 stops at a top of the edge rib to prevent the unit mesh panel 302 from disengaging from the unit frame 301 and a second position (shown in FIG. 28) that the toggle piece 303 allows the unit mesh panel 302 to disengaging from the unit frame 301.

Preferably, the toggle piece 303 is configured to be connected to the unit frame 301 via a pin 304 perpendicular to an overall extension direction of the main body unit 205 and to be rotatable about the pin 304.

Also preferably, each of the main body units 205 is a polygonal structure, and each corner of the polygonal structure is provided with the toggle piece 303. In the present embodiment, each main body unit 205 is rectangular.

As shown in FIG. 24, the seat portion 203 and the backrest portion 204 are each formed into a rectangular structure. Respective longitudinal edges of the seat portion 203 are butted together with respective longitudinal edges of the backrest portion 204, and the seat portion 203 and the backrest portions 204 each include two main body units 205 arranged in the longitudinal direction thereof. That is to say, the sofa bed includes four main body units 205 arranged in an array, wherein a pair of main body units 205 arranged side by side in the longitudinal direction constitute the seat portion 203, and another pair of main body units 205 arranged side by side in the longitudinal direction constitute the backrest portion 204.

FIG. 30-FIG. 37 illustrate another preferred embodiment according to the present invention.

Figure 30:
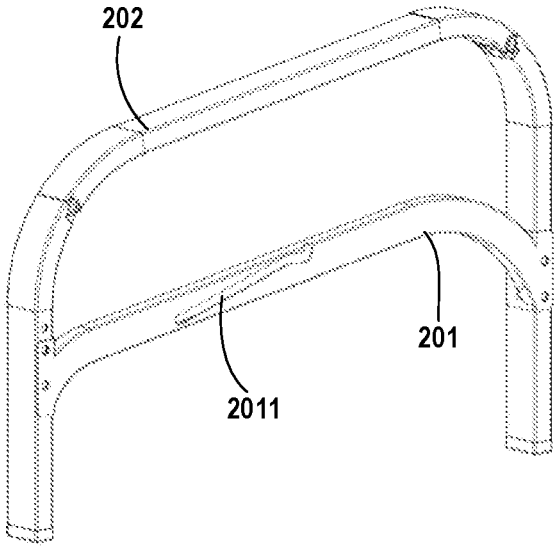
FIG. 30 is a schematic view of an armrest frame of a sofa bed according to a preferred embodiment of the present invention.
Figure 31:
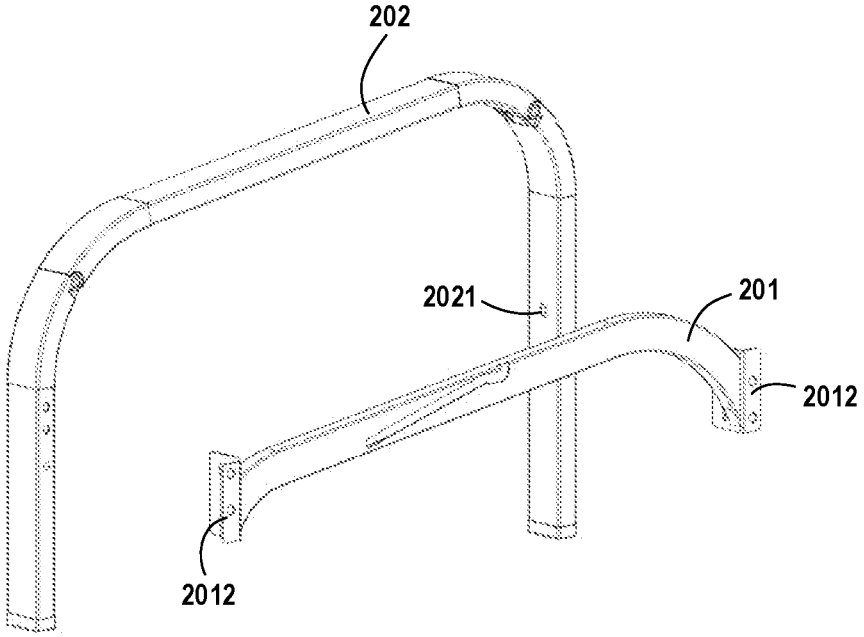
FIG. 31 is an exploded view of the armrest frame shown in FIG. 30.

Referring to FIG. 30 and FIG. 31, the armrest frame 202 of the sofa bed can be detached from the sofa bed main body, and the armrest frame 202 itself can further be disassembled. The armrest frame 202 includes a substantially U-shaped armrest frame main body and a reinforcing beam 201 detachably connected between two legs of the armrest frame main body, wherein both ends of the reinforcing beam 201 are provided with tongues 2012 which are respectively detachably engaged with the two legs. A slideway 2011 is formed on the reinforcing beam 201.

In order to facilitate the positioning and installation of the reinforcing beam 201 on the armrest frame main body, the armrest frame main body is further provided with a catching hole 2021, and each end of the reinforcing beam 201 may be provided with a small protrusion which can engage with the catching hole 2021 to achieve positioning.

Figure 32:
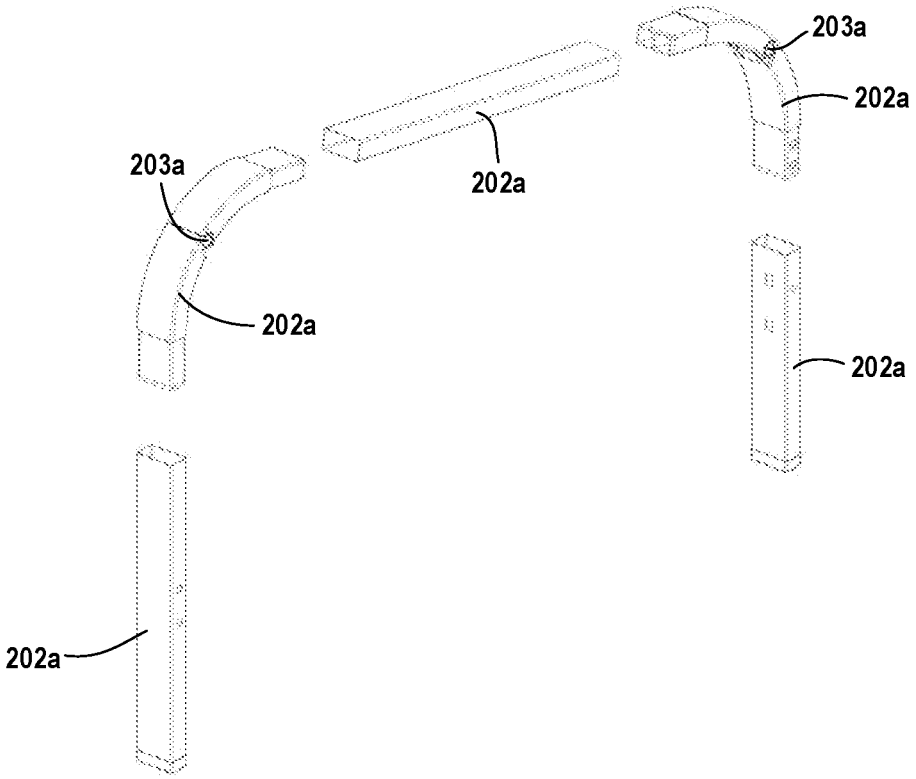
FIG. 32 is an exploded view of an armrest frame main body shown in FIG. 31.
Figure 33:
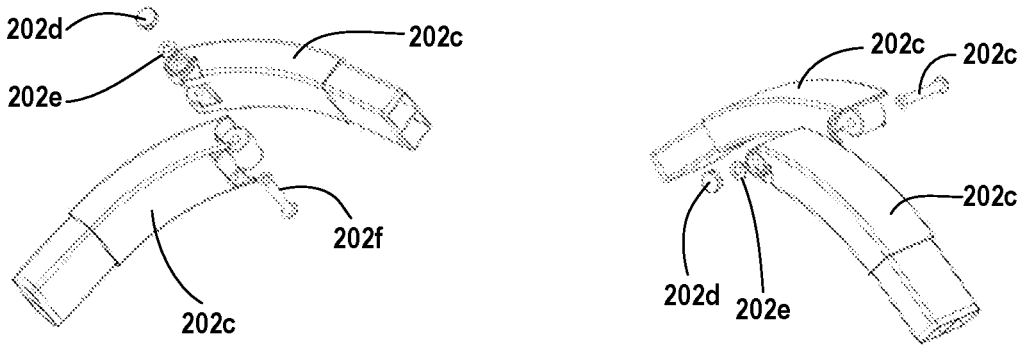
FIG. 33 is a schematic view showing the connection of sections of legs and a section of a connecting portion shown in FIG. 22.
Figure 34:
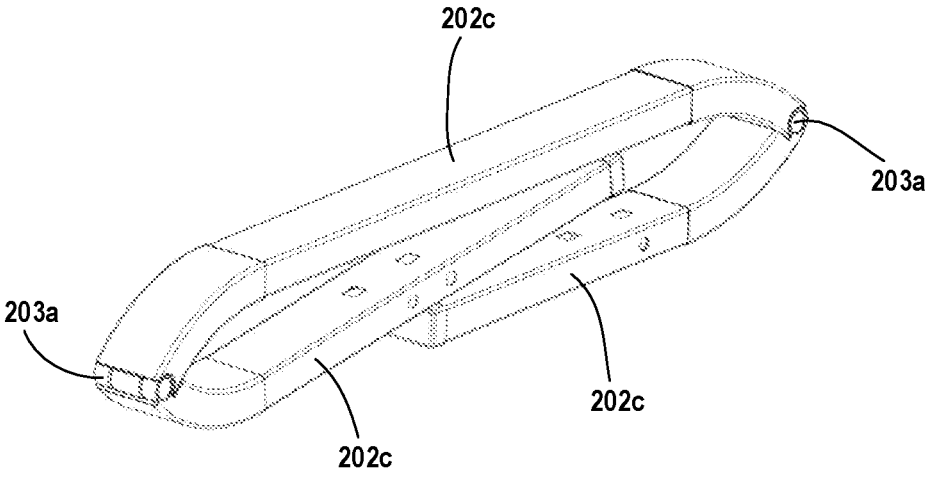
FIG. 34 is a schematic view in which the armrest frame main body of FIG. 31 is folded and received.

Preferably, referring to FIG. 32-FIG. 34, the armrest frame main body can be further disassembled and/or folded. That is to say, FIG. 32-FIG. 34 show two storing modes that can be realized on the same armrest frame main body at the same time.

The armrest frame main body includes a plurality of sections 202*a* connected in sequence, one section 202*a* of any two adjacent sections 202*a* has an opening at the end, and the end of the other section 202*a* extends into the opening to connect the two adjacent sections 202*a*. Each section 202*a* is disassembled and stored in one of two storing modes.

The legs are connected to a connecting section by a pivot shaft 203*a*, and the armrest frame main body is configured so that the two legs can be pivotally folded relative to the connecting section between the two legs to make the armrest frame main body is in a folded state as shown in FIG. 34. Referring to FIG. 33, the connection between the section 202*c* of the leg and the section 202*c* of the connecting section specifically includes a shaft 202*f*, a washer 202*e*, and a plastic cover 202*d* that encapsulates the shaft 202*f* and washer 202*e*. The legs and the connecting section being pivotally thus to be stored is the other mode of the two storing modes.

The structure of the armrest frame adapting the second storing mode other than the first storing mode is shown in FIG. 34.

Figure 36:
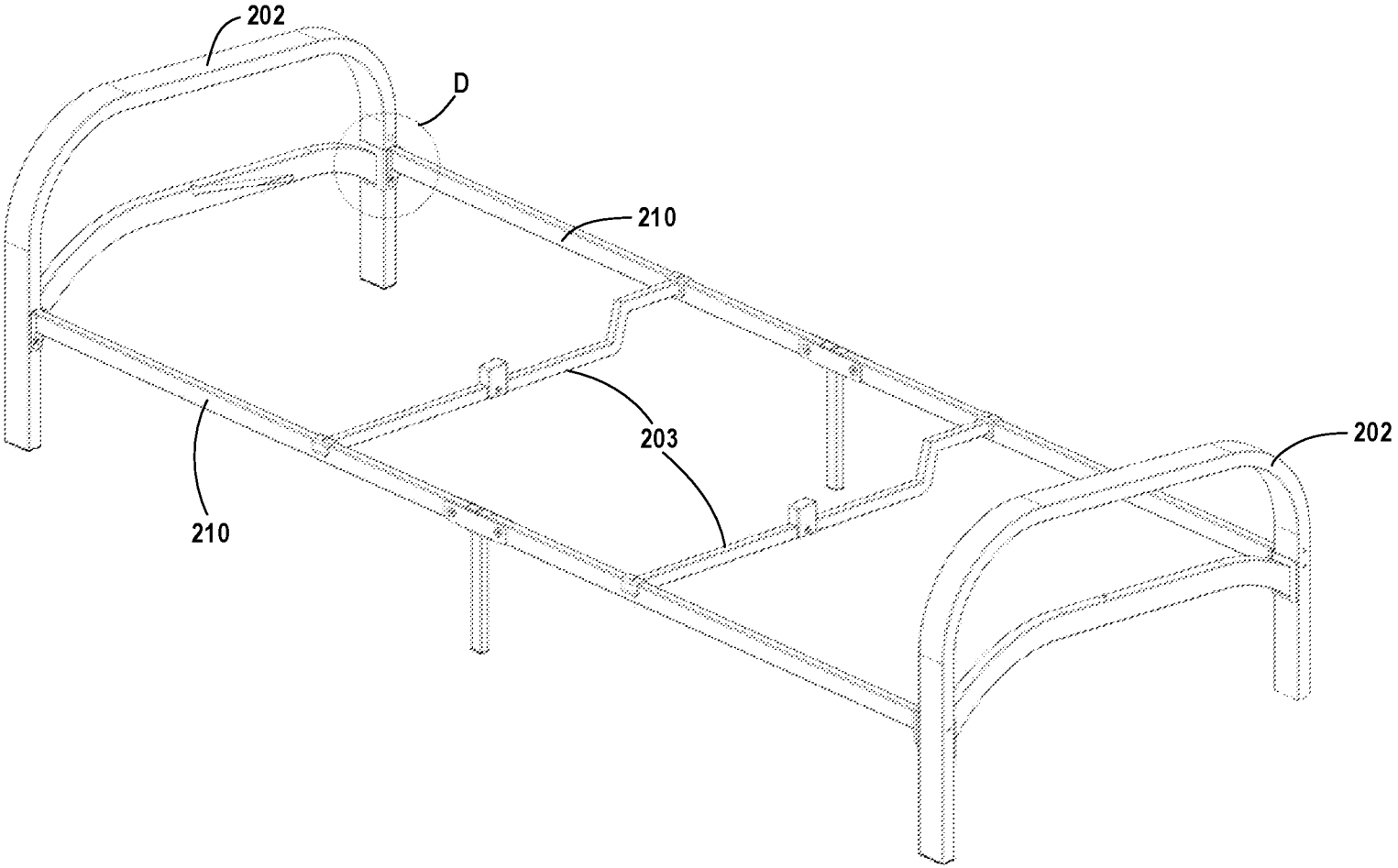
FIG. 36 is a schematic view of a bottom supporting structure of a sofa bed according to a preferred embodiment of the present invention.
Figure 37:
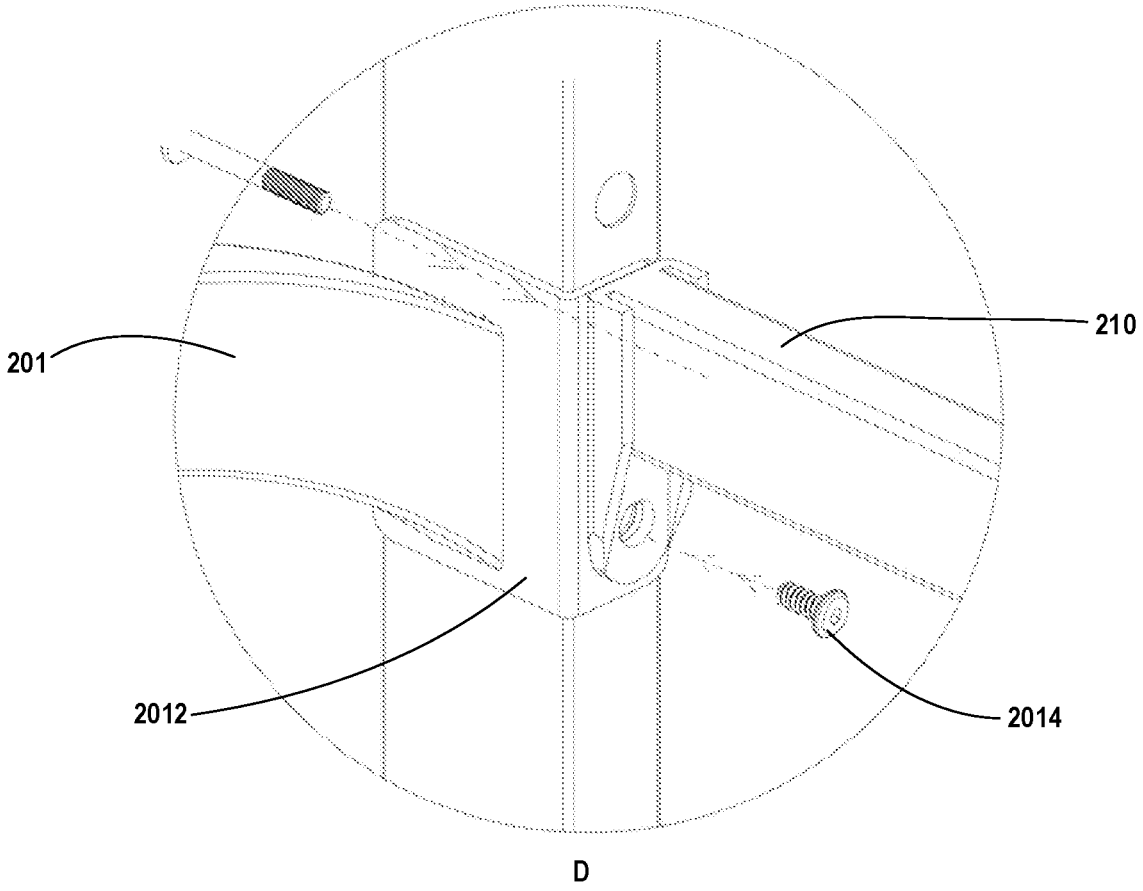
FIG. 37 is a partially enlarged schematic view of FIG. 36.
Figure 38A:
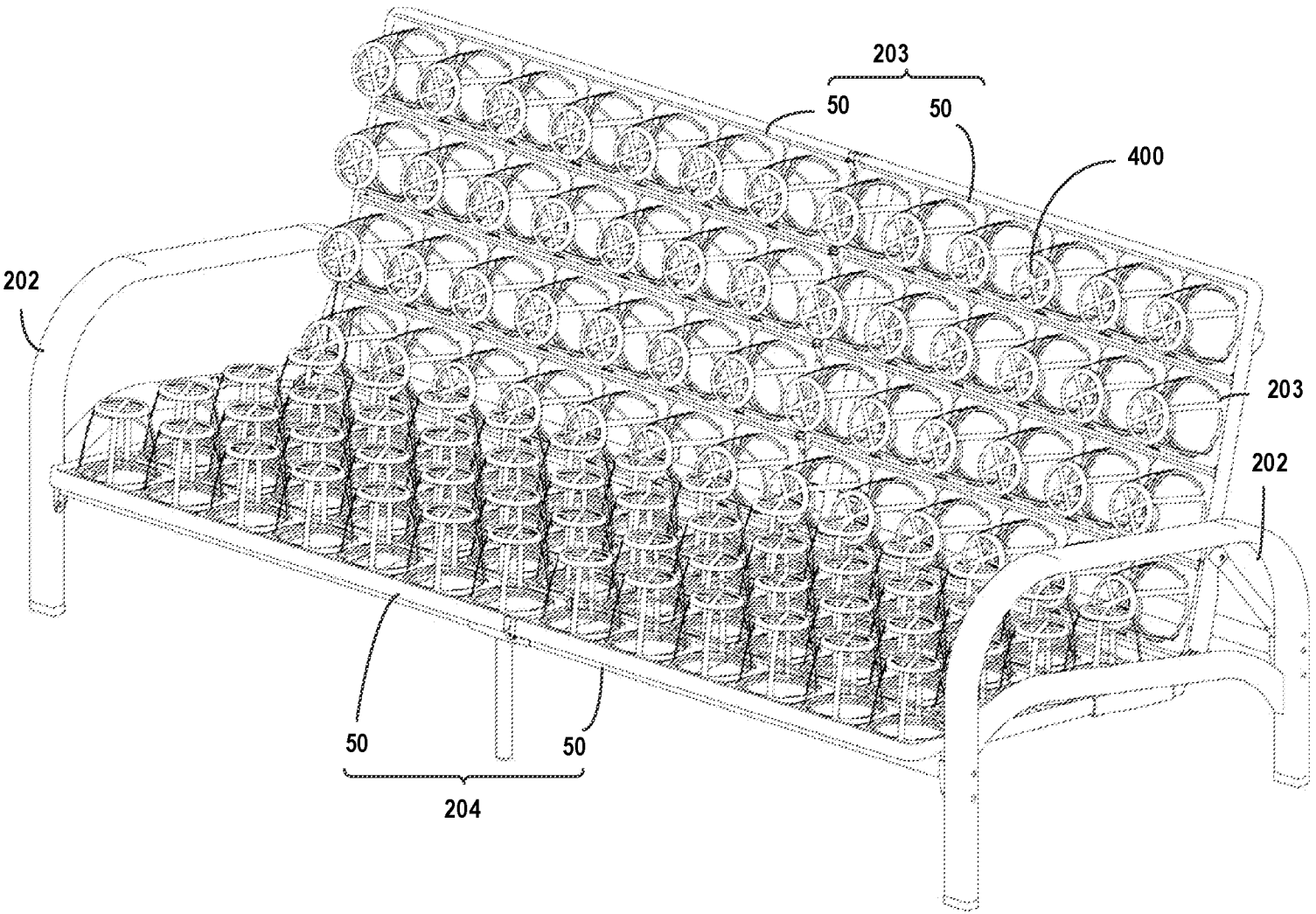
FIG. 38A and FIG. 38B are schematic views of a sofa bed according to a preferred embodiment of the present invention, wherein spring modules are mounted on the sofa bed.
Figure 38B:
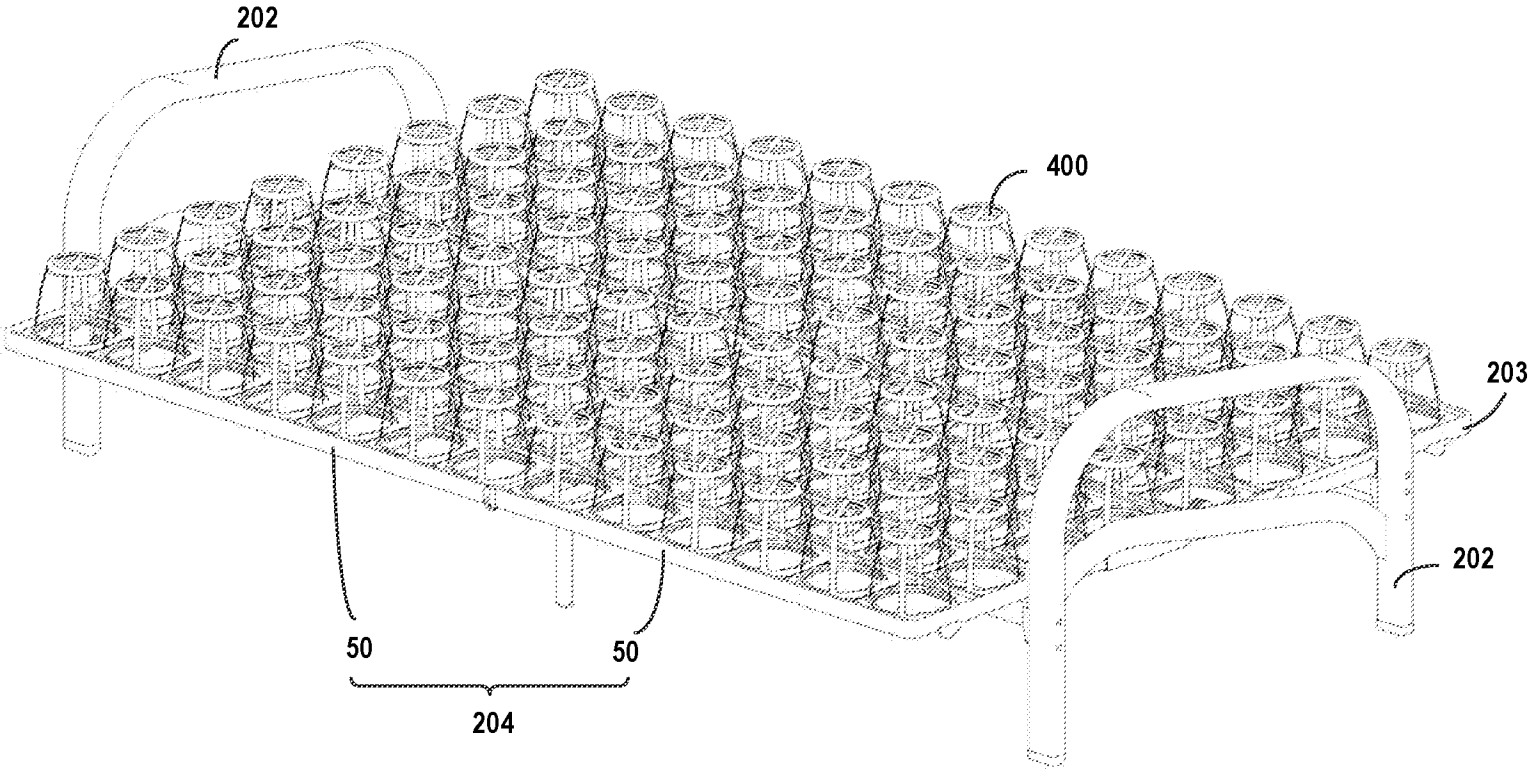

Referring to FIG. 36 and FIG. 37, a cross-section of the leg is rectangular, a cross-section of the tongue 2012 is L-shaped, and the tongue 2012 fits with two adjacent side surfaces of the leg. Furthermore, the sofa bed further includes the bottom supporting structure 210 positioned and supported under the main body frame. The bottom supporting structure 210 includes a bottom supporting structure longitudinal beam connected between the two armrest frames 202. Furthermore, the tongue 2012 of each of the armrest frames 202 includes a first portion of the tongue 2012 facing the other armrest frame 202 and fitted on the leg. The bottom supporting structure longitudinal beam is connected to the armrest frame 202 by being fixed on the first portion of the tongue 2012 by a bolt 2014.

Figure 35:
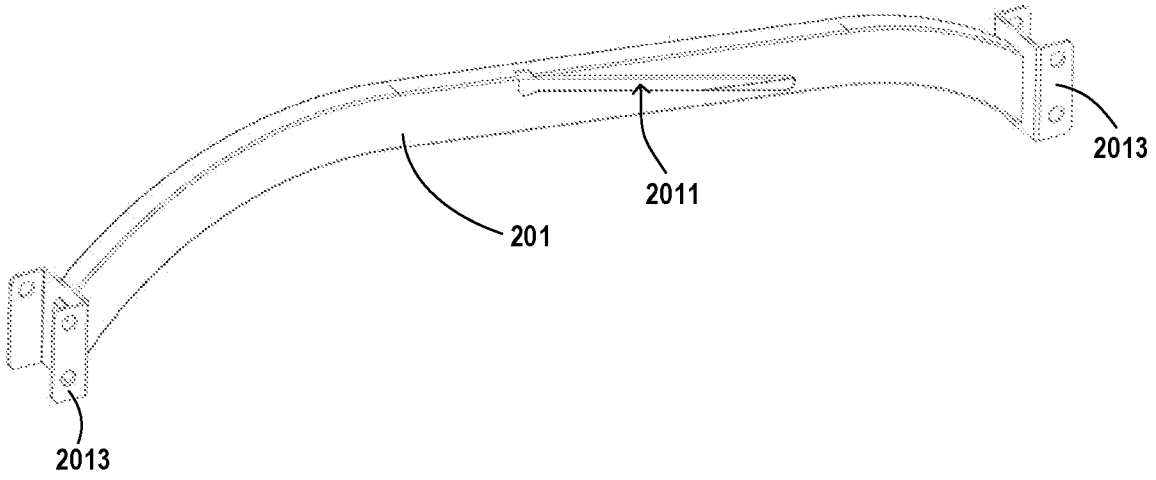
FIG. 35 is a schematic view of an alternative structure of a reinforcing beam in FIG. 31.

As an alternative to the tongue with the L-shaped cross-section, FIG. 35 shows another reinforcing beam 201 on which a slideway 2011 is provided. The cross section of the tongue 2013 of the reinforcing beam 201 is U-shaped, and the tongue 2013 can fit on two adjacent side surfaces of the leg and a surface between the two adjacent side surfaces.

FIG. 38A-FIG. 47 show schematic views of another preferred embodiment of the present invention. The sofa bed may further include a plurality of elastic modules mounted in an array on the seat portion and the backrest portion.

Figure 39:
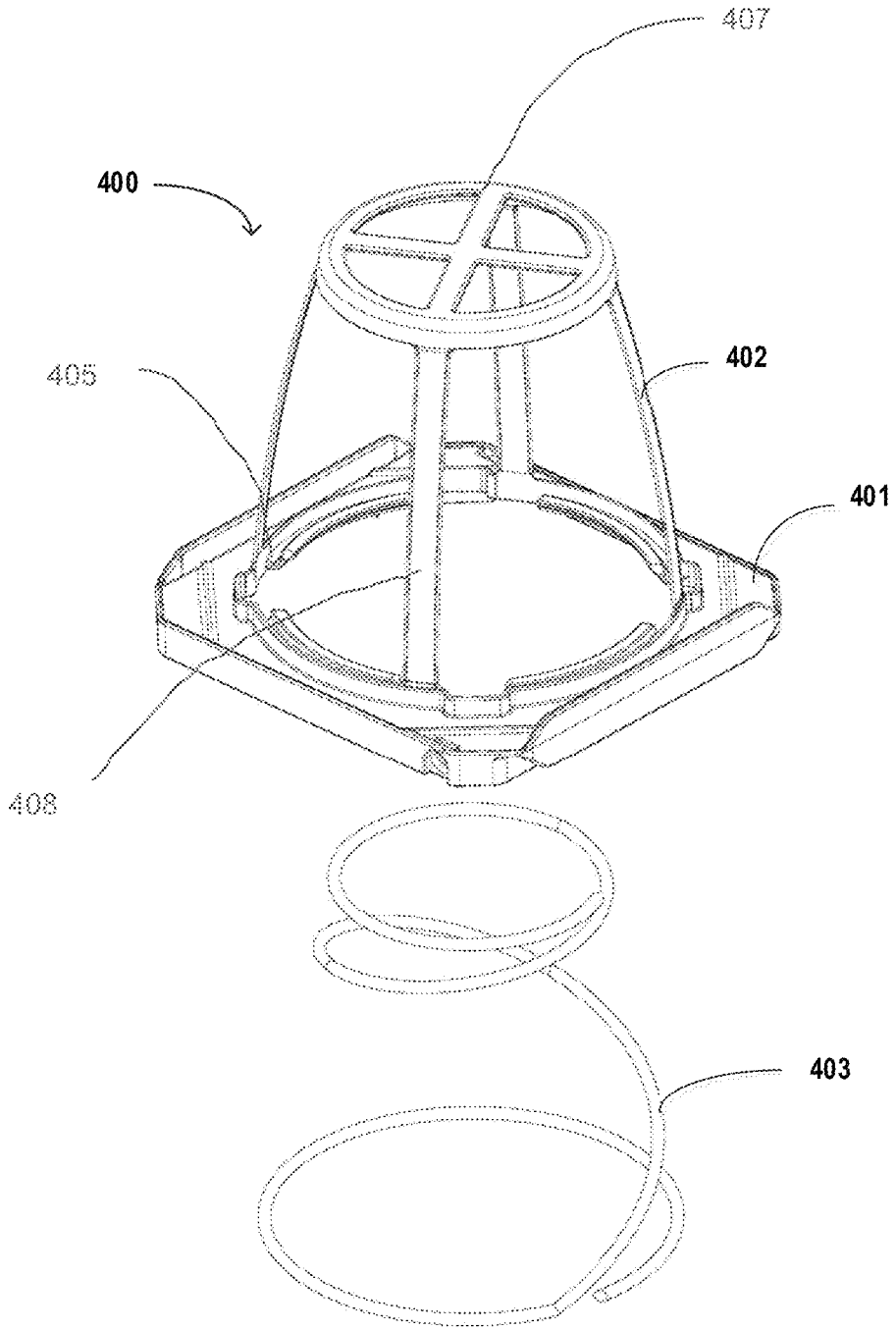
FIG. 39 is an enlarged exploded schematic view of a spring module shown in FIG. 38A and FIG. 38B.

FIG. 39 shows an exploded schematic view of an elastic module 400. Each elastic module 400 includes a conical spring 403 and a spring bracket 402 that accommodates the conical spring. The spring bracket 402 includes a bottom portion 401 that can fit with the main body frame of the sofa bed. The spring bracket of each of the elastic modules includes a base having a spring mounting seat 405, wherein each spring mounting seat 405 has a spring fixing portion for fixing an end of the conical spring. An end cap 407 is disposed opposite to a corresponding spring mounting seat 405. Flexible straps 408 are spaced apart from each other and evenly arranged between a corresponding pair of the spring mounting seat and end cap.

In the present embodiment, the seat portion 204 and the backrest portion 203 may each constitute a main body frame, or both of them may jointly constitute a main body frame. The main body frame is formed with a slide rail that can be engaged with the bottom of the spring bracket, so that the plurality of elastic modules 400 can slide in the slide rails, and the main body frame can be folded in half along a fold-in-half line perpendicular to an extending direction of the slide rail to switch between a folded state and an in-use state. When the main body frame is in the folded state, the slide rail forms a slide rail opening 53 at the fold line; when the main body frame is in the in-use state, the slide rail opening 53 is closed. The slide rails on the main body frame are configured so that the plurality of elastic modules 400 can be mounted to the slide rails from the outside of the main body frame via the slide rail openings 53 and slide toward the ends of the slide rails when the main body frame is folded, so that the plurality of elastic modules 400 are densely arranged on the side facing the user.

It should be appreciated that the "folded state" mentioned herein refers to a position where the main body frame is folded in half along the fold-in-half line to expose the opening 53 of the slide rail. When the main body frame is in the folded state, the sofa bed cannot be used. As this time, the sofa bed is not used as a bed nor as a sofa. The "in-use state" mentioned herein refers to a position where the main body frame is flattened so that the opening 53 of the slide rail is closed, and the sofa bed can be used in the in-use state. At this time, the sofa bed can be used as a sofa or a bed.

Figure 40:
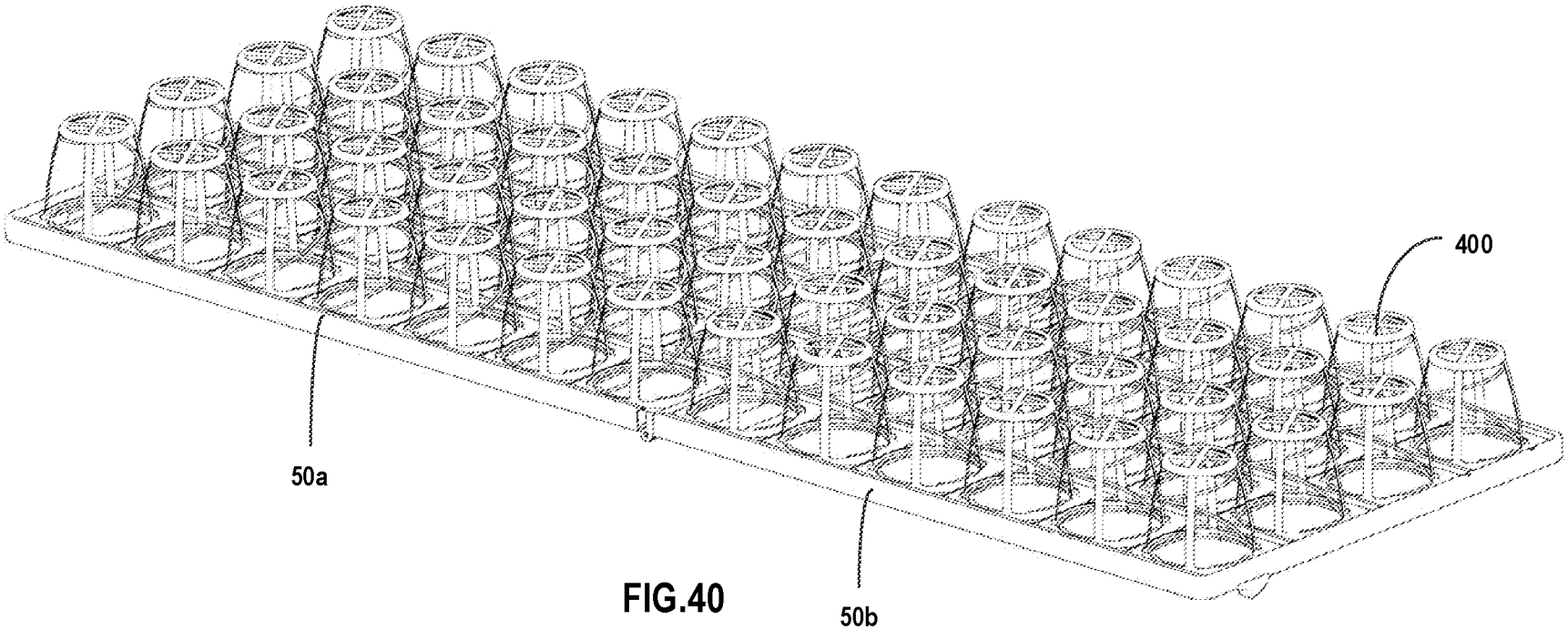
FIG. 40 is an alternative structure of a seat portion or a backrest portion shown in FIG. 38A and FIG. 38B.

FIG. 40 shows a possible structure of the seat portion 204 or the backrest portion 203. For an illustration purpose, FIG. 40 shows the seat portion 204. Each of the slide rails of the seat portion 204 extending in the longitudinal direction is mounted with an odd number of elastic modules 400, and the fold line is offset from an intermediate position of the main body frame in the longitudinal direction. FIG. 41-FIG. 46 are schematic views of a process of mounting the elastic modules 400 on the main body frame to finally obtain the structure shown in FIG. 40.

Figure 41:
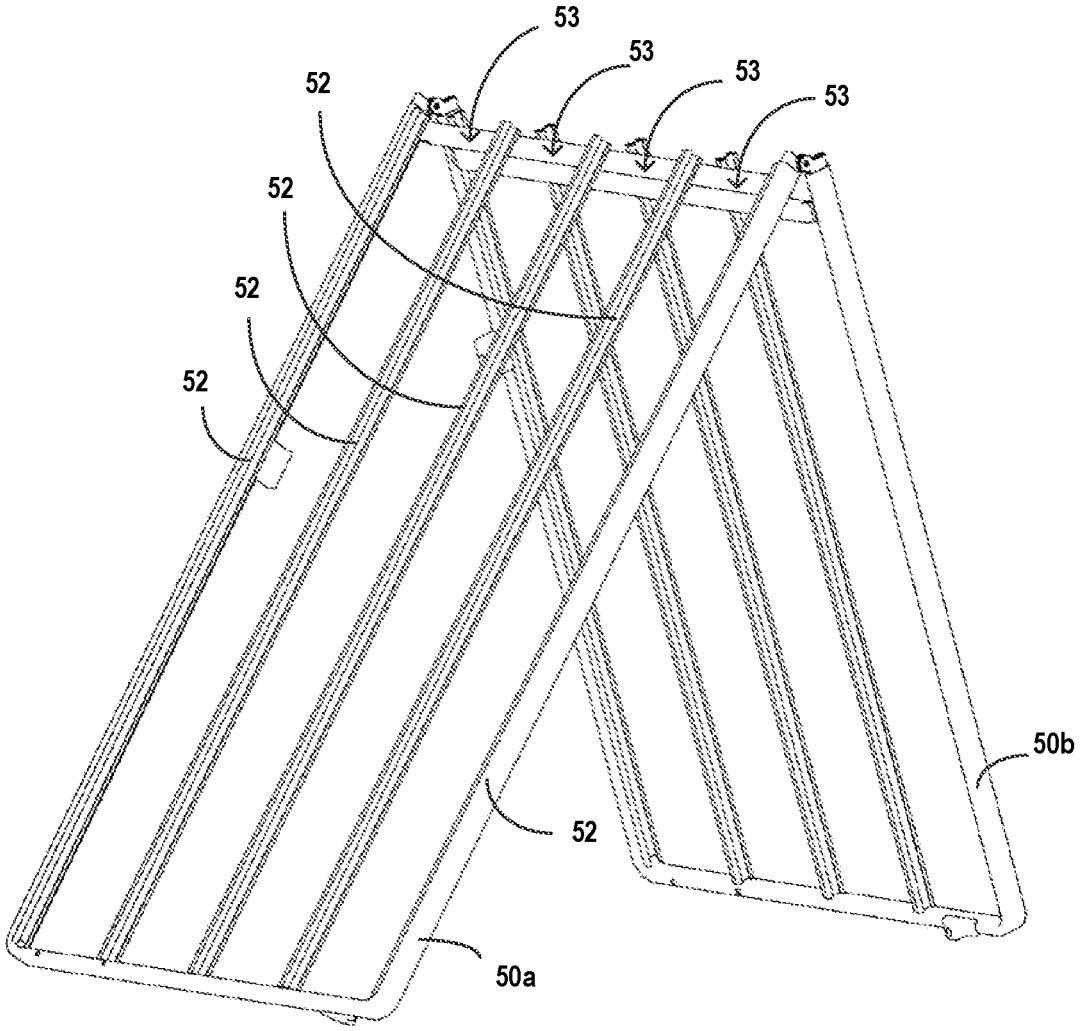
FIGS. 41, 42, 43, 44, 45 and 46 are schematic views corresponding to FIG. 40, showing a process of mounting spring modules.

Referring to FIG. 41, the main body frame is folded in half along the fold-in-half line, and the two folded portions 50 folded in half with each other, namely, a first folded portion 50*a* and a second folded portion 50*b*, have different longitudinal dimensions (i.e., dimensions of extension along their respective longitudinal directions). Taking the first folded portion 50*a* as an example, the first folded portion 50*a* includes a plurality of longitudinal beams 52 (i.e., rail beams), and any two adjacent longitudinal beams 52 together form a slide rail, each slide rail has an opening 53 at a position wherein the first folded portion 50*a* and the second folded portion 50*b* are folded in half.

Figure 42:
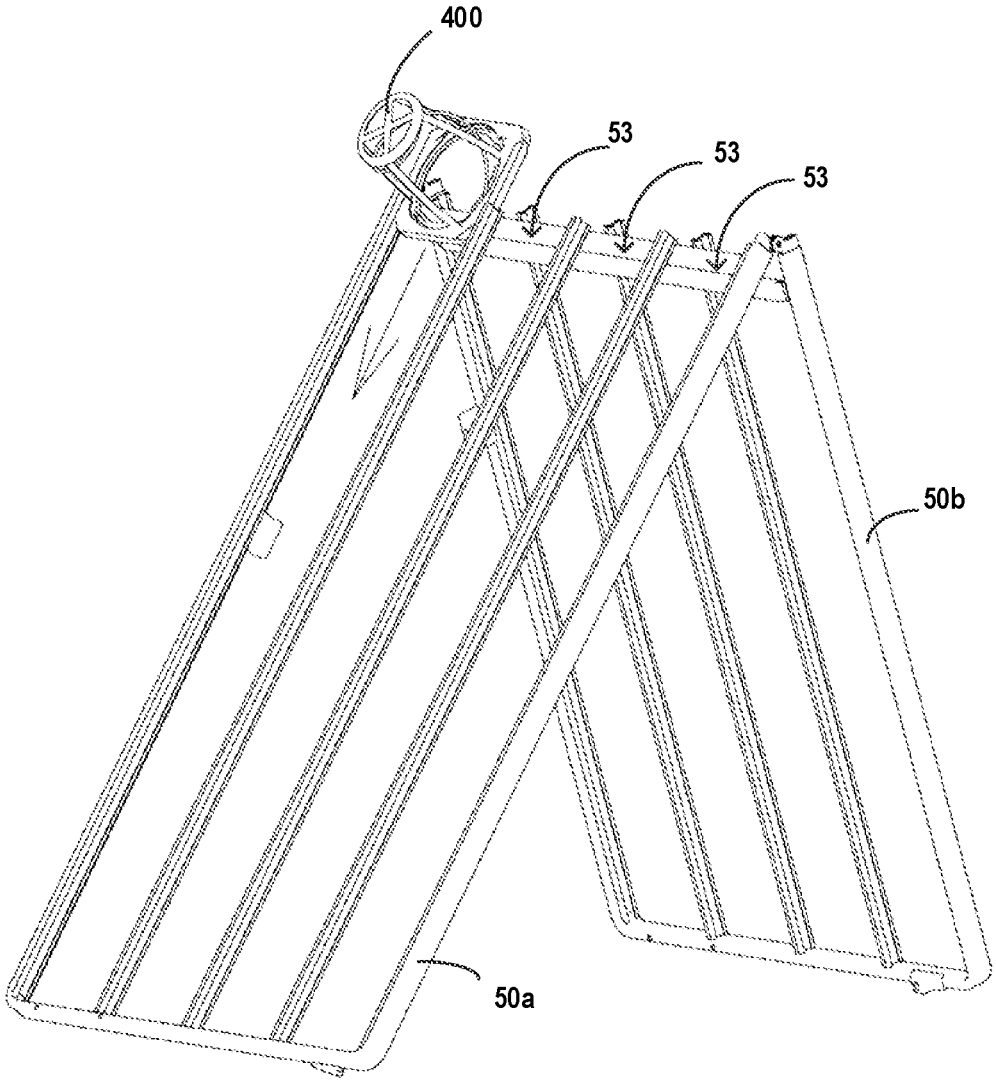
Figure 43:
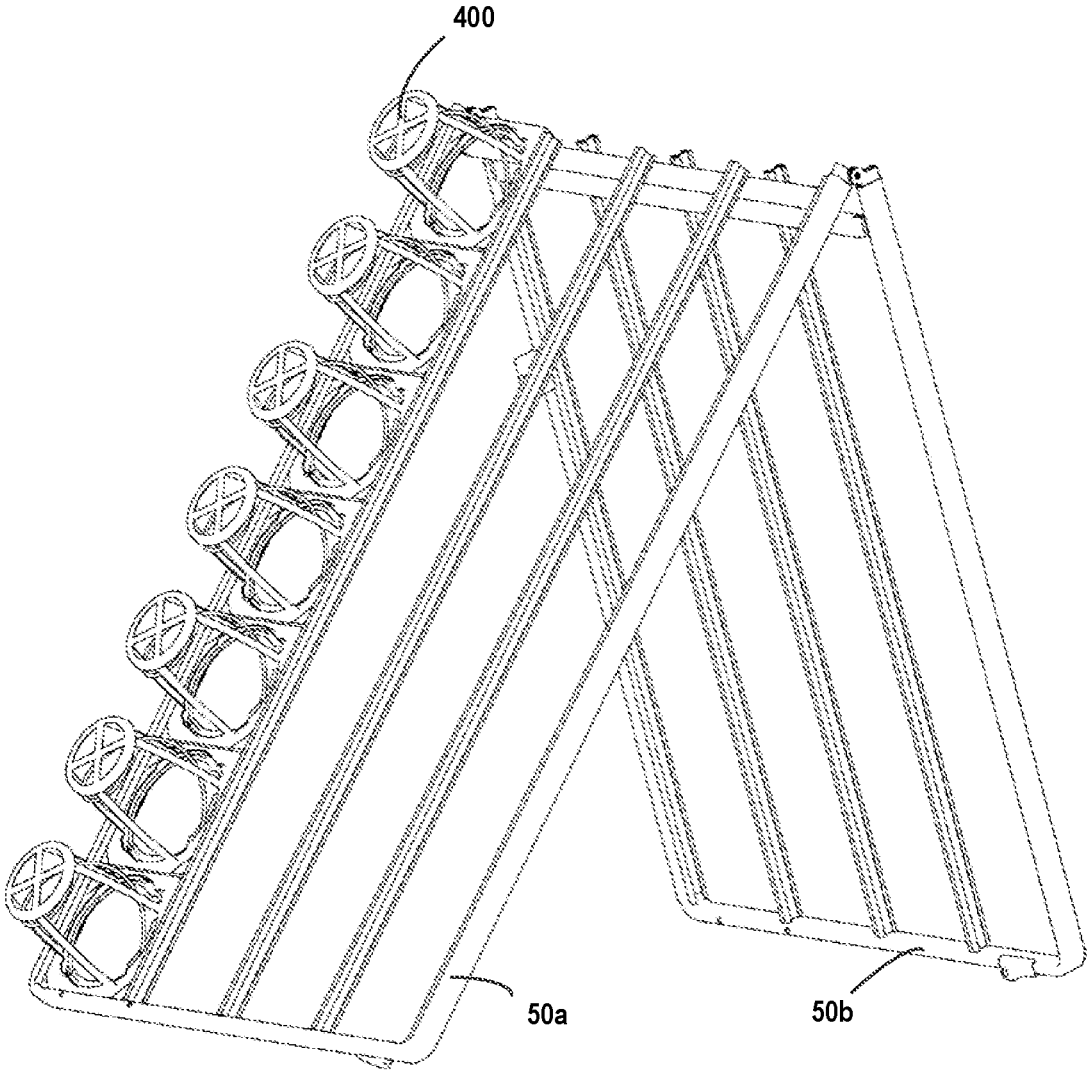
Figure 44:
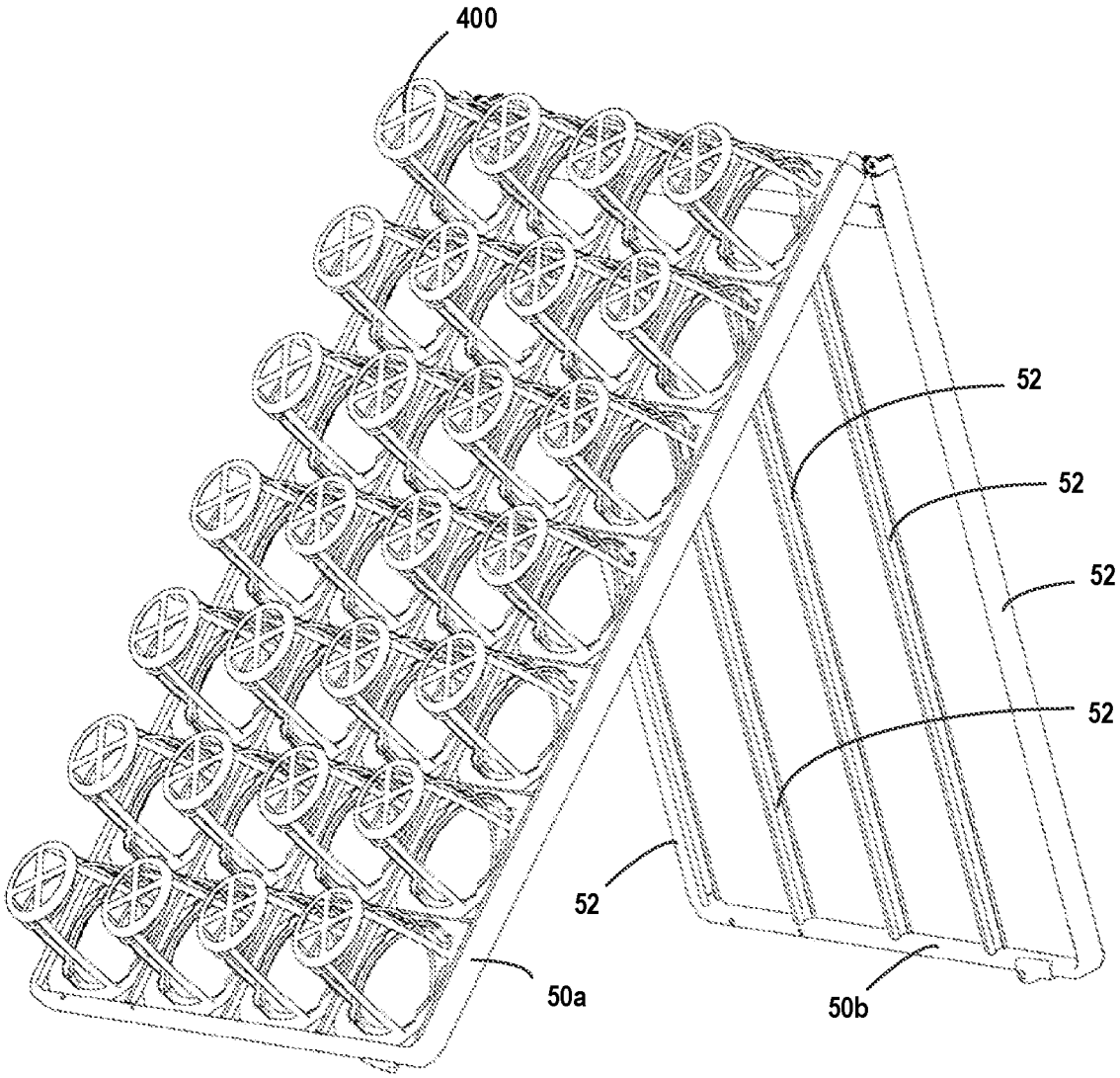

Referring to FIG. 42, the elastic module 400 can be mounted into the slide rail from the opening 53 of the slide rail and slide on the slide rail. The bottom of the elastic module 400 matches with the slide rail, so that the elastic module 400 can not only slide on the slide rail, but also won't disengage from the slide rail from other positions except the opening 53. A state after one slide rail of the first folded portion 50*a* is covered with the elastic modules 400 is shown in FIG. 43, and a state after all slide rails of the first folded portion 50*a* are covered with the elastic modules 400 is shown in FIG. 44. In FIG. 44, the second folded portion 50*b* is not yet mounted with spring modules, and the second folded portion 50*b* also has a plurality of longitudinal beams 52, and any two adjacent longitudinal beams 52 form a slide rail.

Figure 45:
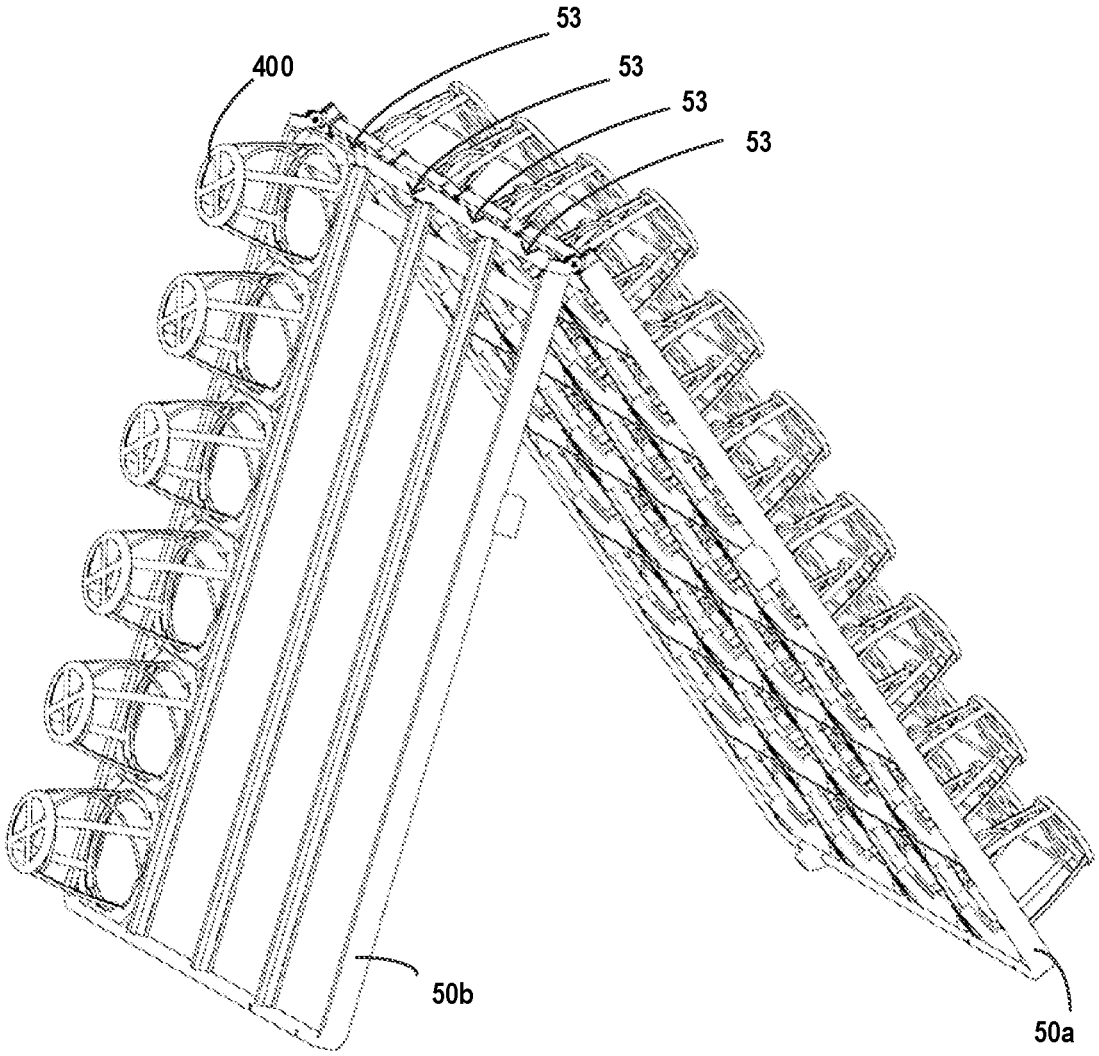
Figure 46:
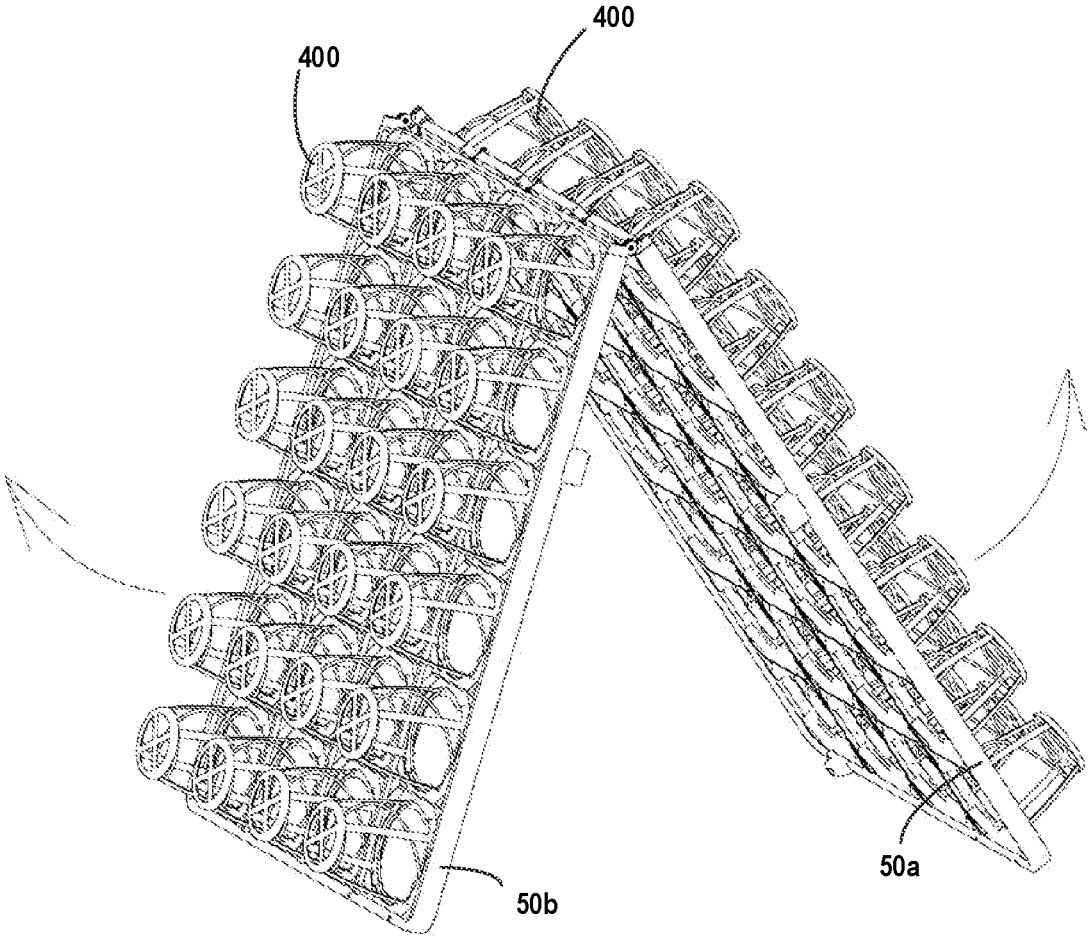

FIG. 45 shows a schematic view showing one slide rail of the second folded portion 50*b* being covered with the elastic modules 400. It can be seen that the elastic modules 400 are also mounted into the slide rail from the opening 53 of the slide rail of the second folded portion 50*b*. A state in which the second folded portion 50*b* is covered with the elastic modules 400 is shown in FIG. 46. In FIG. 46, the first folded portion 50*a* and the second folded portion 50*b* are both covered with the elastic modules 400, the seat portion 204 can be flattened again by folding the first folded portion 50*a* and the second folded portion 50*b* in a direction indicated by the arrows in the figure; the openings 53 of the slide rails will be closed after the flattening, and the elastic modules 400 cannot be taken out from the seat portion 204.

It can be seen from FIG. 46 that at maximum 7 elastic modules 400 can be mounted on each slide rail of the first folded portion 50*a*, and at maximum 6 elastic modules 400 can be mounted on each slide rail of the second folded portion 50*b*. The maximum number of the elastic modules 400 that can be mounted on each slide rail of the first folded portion 50*a* is only one more than the maximum number of the elastic modules 400 that can be mounted on each slide rail of the second folded portion 50*b*. In this way, finally the maximum number of the elastic modules 400 that are received in a complete slide rail (jointly formed by butting a slide rail of the first folded portion 50*a* with a slide rail of the second folded portion 50*b*) of the seat portion 204 is certainly an odd number. Such an arrangement can minimize the longitudinal dimension of the main body frame (i.e., the longitudinal dimension of the first folded portion 50 *a*) when the main body frame is in the folded state, so that the main body frame in the folded state occupies the smallest area when being stored. Certainly, without considering the occupied area in the folded state, it is possible to set a larger difference between the maximum numbers of elastic modules that can be carried on the slide rails of the first folded portion 50*a* and the second folded portion 50*b*.

Turning back to FIG. 40, respective transversely-extending beams of any two adjacent folded portions in at least two folded portions in the longitudinal direction are butted together and are pivotal relative to each other about a transversely-extending shaft so that the two adjacent folded portions are folded relative to each other. Furthermore, the slide rail beams of the two adjacent folded portions are aligned in the longitudinal direction, but the fold-in-half lines may be spaced apart (certainly there may not be a spacing). A size of the spacing is configured in a way that the elastic modules 400 are not allowed to disengage from the slide rail from the spacing in the fold-over state.

Figure 47:
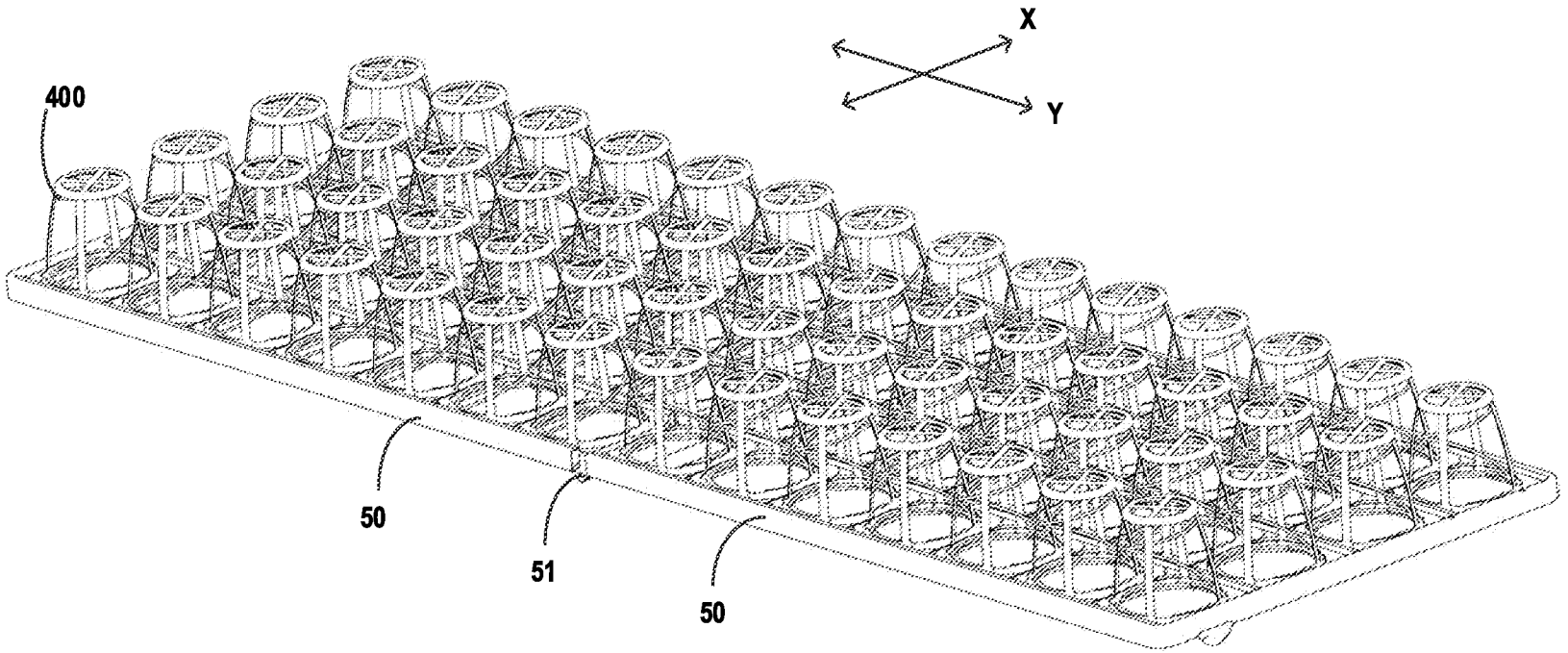
FIG. 47 is another alternative structure of the seat portion or the backrest portion shown in FIG. 38A and FIG. 38B.
Figure 48:
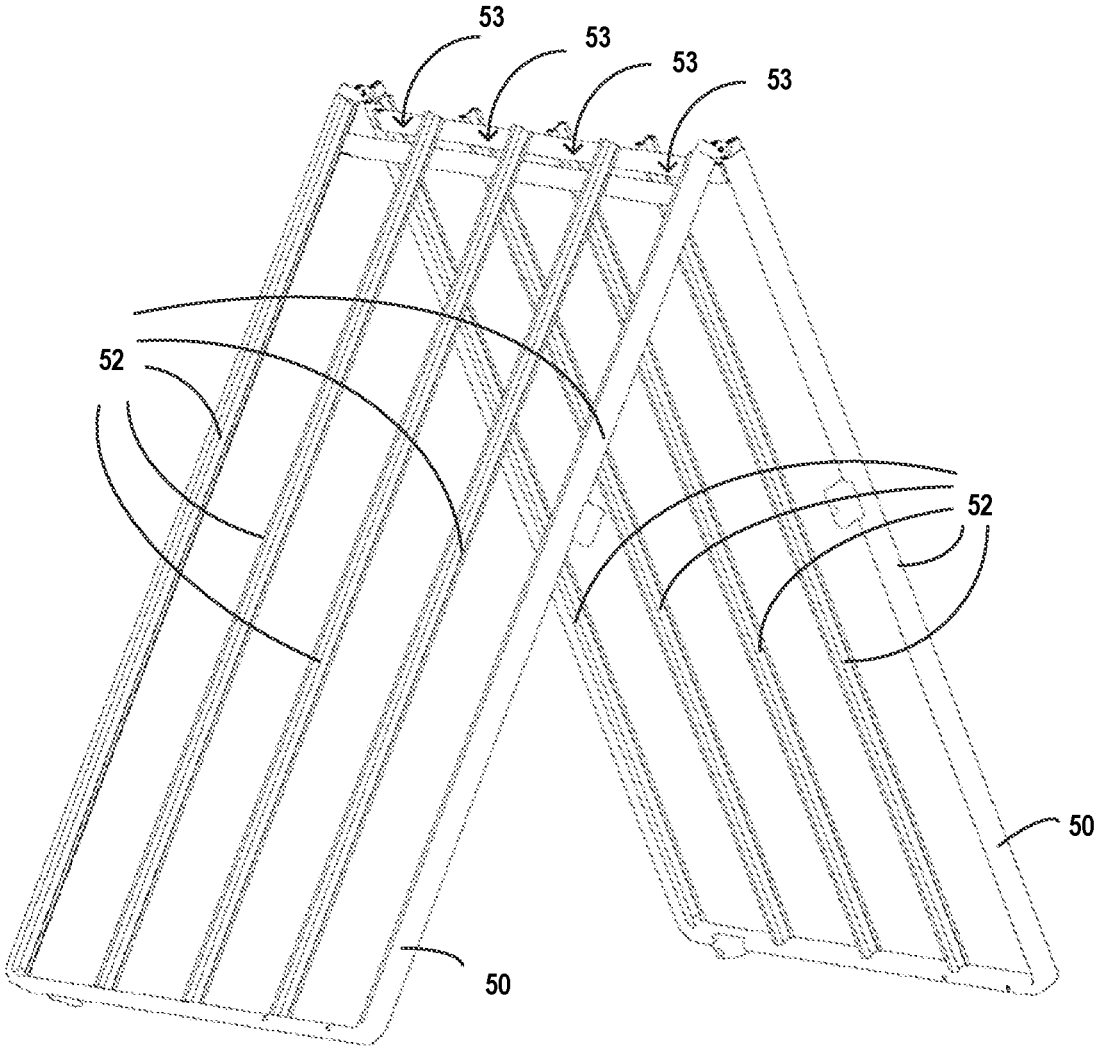
FIG. 48 and FIG. 49 are schematic views corresponding to FIG. 47, showing a process of mounting the spring modules, wherein some intermediate steps are omitted.

FIG. 47 shows a further possible configuration of the seat portion or the backrest portion. For an exemplary purpose, FIG. 47 shows a seat portion with an even number of elastic modules 400 mounted on each longitudinally-extending slide rail of the seat portion. Referring to FIG. 47, the fold-in-half line 51 is located at a middle position in the longitudinal direction, that is, the longitudinal dimensions of the two folded portions 50 folded in half along the fold-in-half line 51 are equal. FIG. 48 shows a state after the main body frame in FIG. 47 is folded in half along the fold-in-half line 51. It can be seen that each folded portion 50 includes a plurality of longitudinal beams 52, and two adjacent longitudinal beams 52 together form a slide rail, each slide rail forms an opening 53 at the position of the fold-in-half line 51, and the elastic modules 400 can be mounted into the slide rail from the opening 53.

Figure 49:
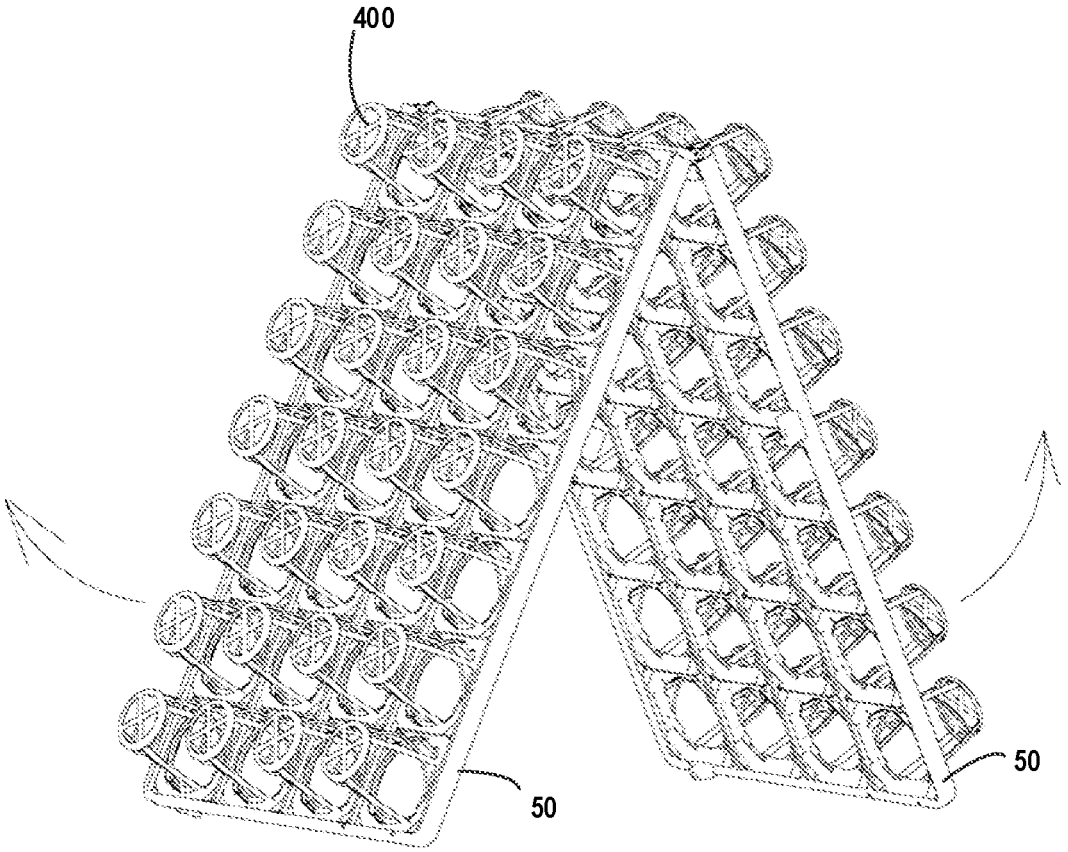

FIG. 49 shows a schematic view after the main body frame in FIG. 48 are covered with elastic modules 400, and each slide rail of each of the two folded portions 50 folded in half along the fold-in-half line 51 can receive up to 7 elastic modules 400. That is to say, the maximum number of elastic modules 400 that can be received on each slide rail of the two folded portions 50 folded in half along the fold-in-half line 51 is equal. In this way, finally the maximum number of the elastic modules 400 that are received in a complete slide rail (jointly formed by butting a slide rail of the first folded portion 50 with a slide rail of the second folded portion 50) of the seat portion 204 is certainly an even number. Such an arrangement can minimize the longitudinal dimension of the main body frame (i.e., the longitudinal dimension of the first folded portion 50) when the main body frame is in the folded state, so that the main body frame in the folded state occupies the smallest area when received. Certainly, regardless of the occupied area in the folded state, it is possible to set different numbers of elastic modules in the slide rails of the first folded portion 50 and the second folded portion 50.

Although the main body frame in the embodiments shown in FIG. 40-FIG. 49 includes only two folded portions 50, the main body frame may include a plurality of folded portions 50 arranged in the longitudinal direction in other embodiments not shown. Any two adjacent folded portions 50 can be folded in half relative to each other so that the opening 53 of the slide rail is opened, and be flattened relative to each other so that the opening 53 of the slide rail is closed. That is to say, if there are a plurality of folded portions 50, the structures of any two adjacent folded portions 50 can be similar to the structures shown in FIG. 40-FIG. 49.

FIG. 50-FIG. 63 illustrate other possible implementations for mounting elastic modules.

Figure 50:
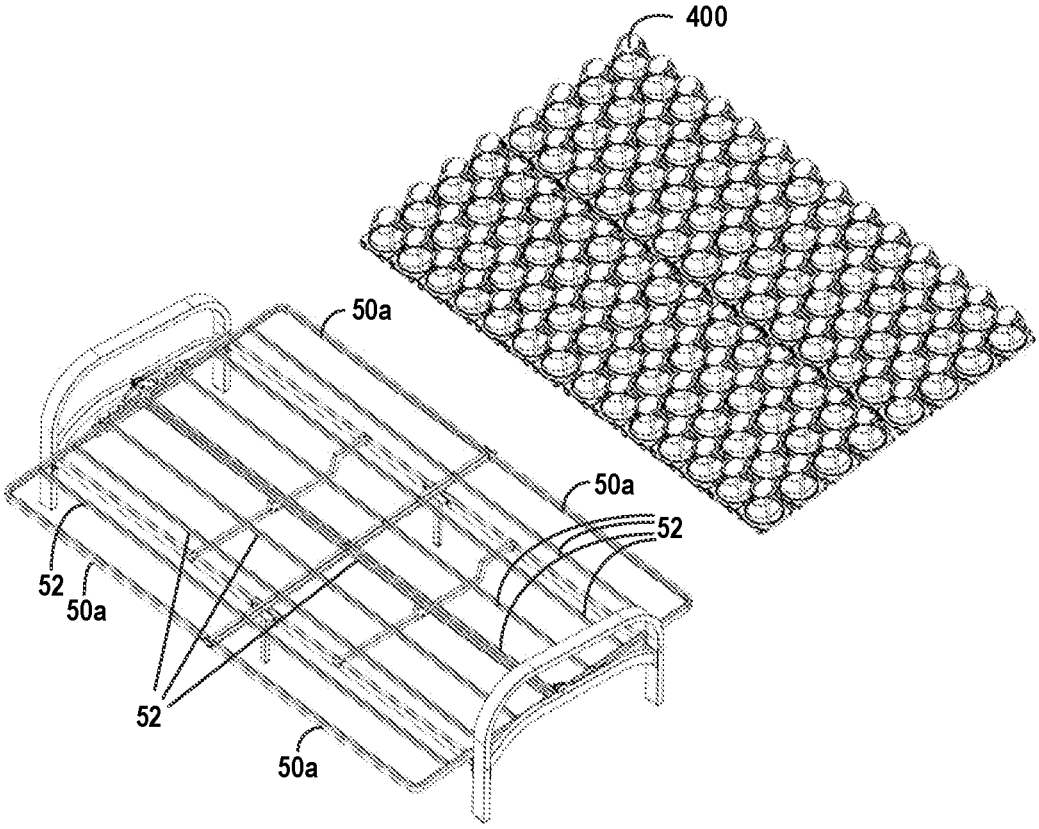
FIG. 50 is a schematic view of a sofa bed according to another preferred embodiment of the present invention, wherein spring modules are mounted on the sofa bed.
Figure 51:
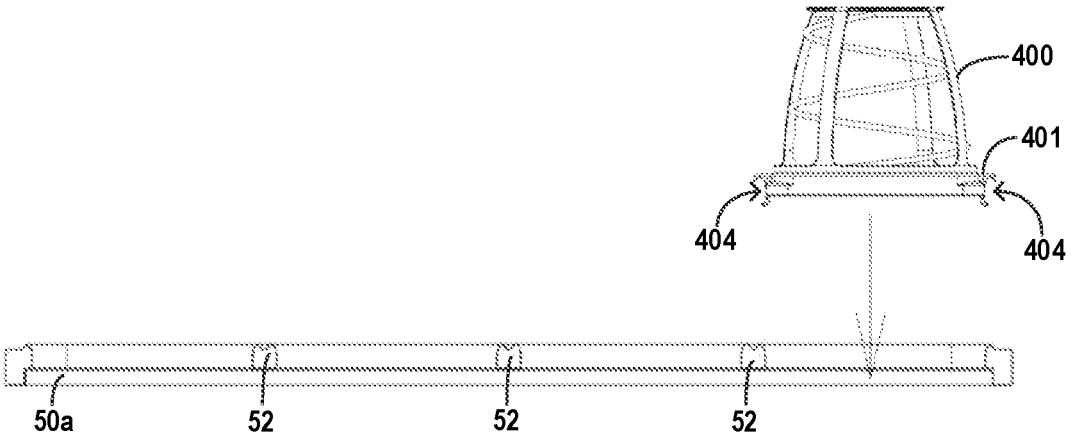
FIG. 51 and FIG. 52 are sectional views of FIG. 50, sequentially showing a process of mounting spring modules on two adjacent slide rails.
Figure 52:
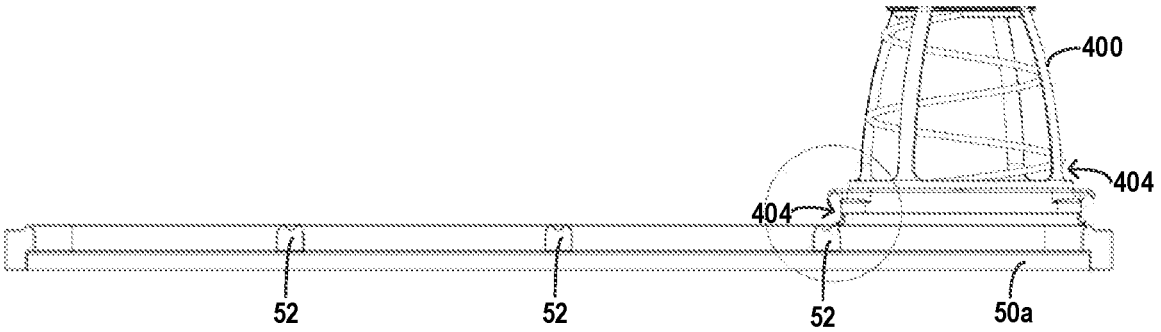

Referring to FIG. 50, the sofa bed includes a main body frame and a plurality of elastic modules 400. The main body frame may include a seat portion and/or a backrest portion. The main body frame may in turn include a plurality of main body units 50*a*. Specifically, the seat portion includes two main body units 50*a* arranged in the longitudinal direction, and the backrest portion also includes two main body units 50*a* arranged in the longitudinal direction. Each main body unit 50*a* includes a plurality of longitudinal beams extending in the longitudinal direction, and the longitudinal beams may also be referred to as rail beams. Any two adjacent slide rail beams 52 can jointly form a slide rail. Furthermore, the two slide rail beams 52 of each slide rail are provided with a first snap structure extending along the entirety thereof, the bottom of the spring bracket is provided with a second snap structure 404, and the elastic modules 400 can be mounted in the slide rail in a way of being pressed perpendicular to a plane jointly defined by extension directions of the two slide rail beams. When the elastic modules 400 are mounted on the slide rail, the first snap structure and the second snap structure 404 are snap-fitted with each other to only allow the elastic modules 400 to move relative to the slide rail beam 52 in a sliding manner along the slide rail.

It can be understood that in the process of mounting the elastic modules 400 in the slide rail by pressing them perpendicular to the plane jointly defined by extension directions of the two slide rail beams (i.e., pressing them downward), a portion of a base 401 of the elastic module 400 in contact with the slide rail beams 52 will be slightly deformed, and the deformation will disappear after completion of the mounting, so that the elastic module 400 cannot disengage from the slide rails. In other words, when the elastic module 400 is not mounted on the slide rails, the base 401 of the elastic module 400 is structured to interfere with the slide rail beams 52. If a downward pressure is not applied to the elastic module 400 to deform it, the elastic module 400 cannot be mounted on the slide rails.

Figure 53:
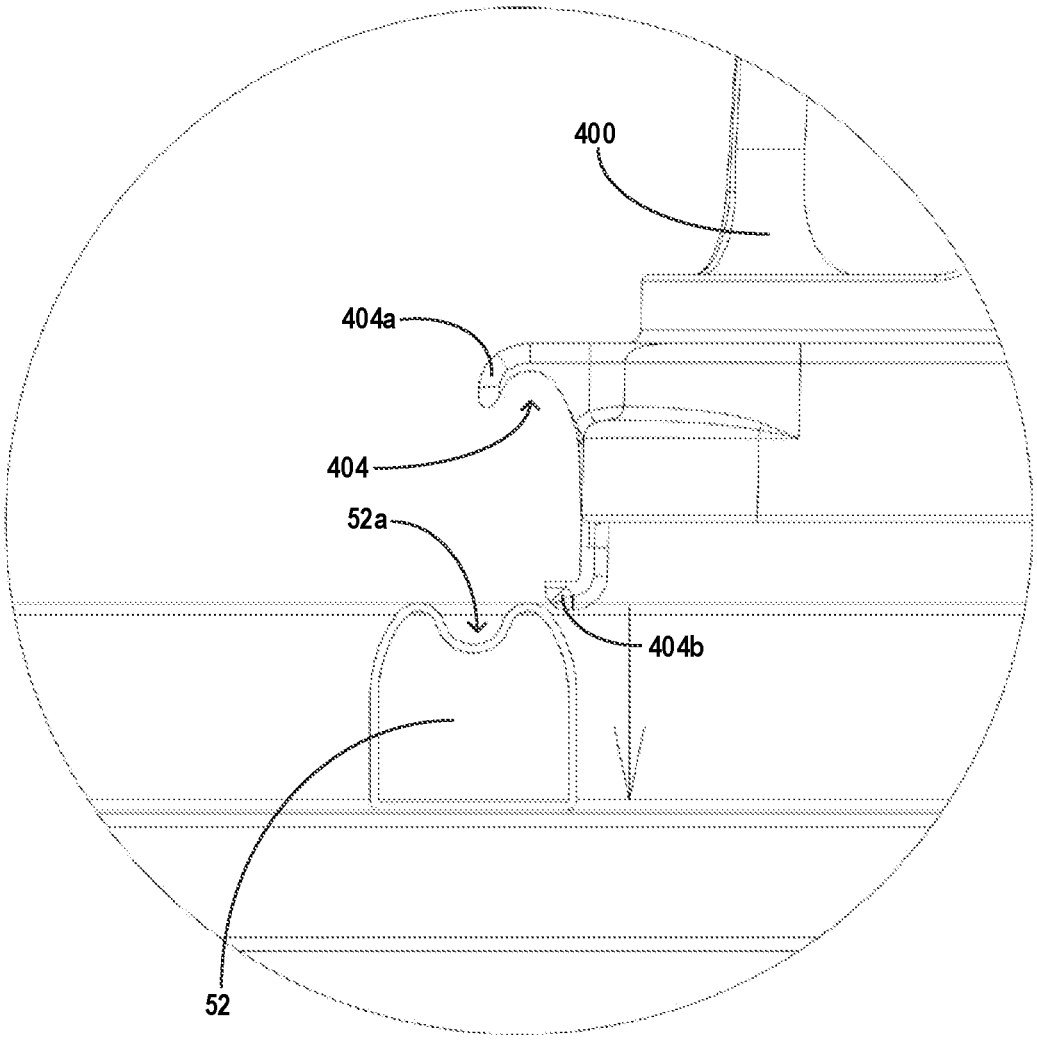
FIG. 53 is a partially enlarged view of FIG. 52.

Preferably, referring to FIG. 53, the first snap structure includes a groove 52*a* that is on a top surface of the slide rail beam 52 and extends along the slide rail beam 52 (i.e., extends in a direction perpendicular to the paper of FIG. 53), and the second snap structure 404 comprises a protrusion 404*a* protruding outward from the top surface of the base 401 of the elastic module 400 and toward the groove 52*a*.

Preferably, further referring to FIG. 53, the first snap structure further includes a bottom surface 52*b* of the slide rail beam, the second snap structure 404 includes an extension structure protruding downward from the base 401, and a bottom of the extension structure is provided with an outwardly protruding snap hook 404*b*. The snap hook 404*b* is configured to snap onto the bottom surface 52*b* of the slide rail beam. Furthermore, two said extension structures and the protrusion 52*a* located between the two extension structures are provided on a side of the base 401 which is engaged with the slide rail beam 52.

Figure 55:
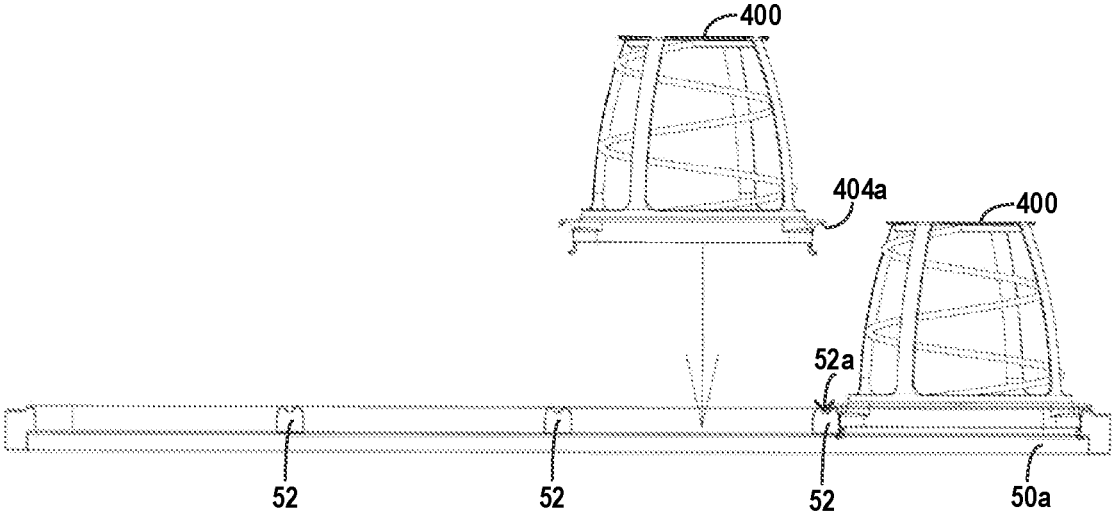
FIG. 55 and FIG. 56 are additional sectional views of FIG. 50, sequentially showing a process of mounting spring modules on two adjacent slide rails.
Figure 56:
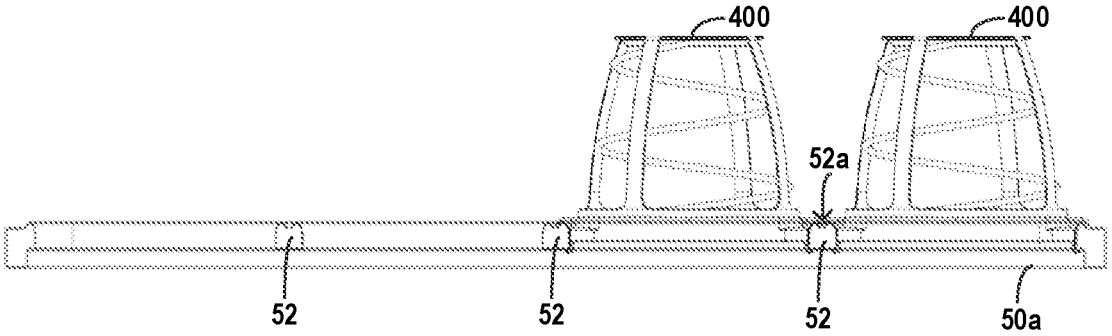
Figure 57:
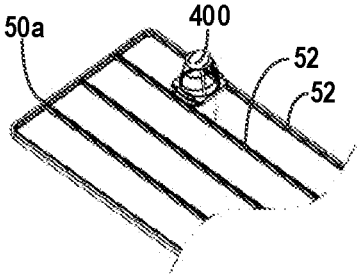
FIGS. 57, 58, 59, 60 and 61 are views showing a process of mounting the spring module on a main body unit.

More preferably, referring simultaneously to FIG. 53, FIG. 55 and FIG. 56, the width of the groove 52*a* is configured to receive two protrusions 404*a* side by side, so that respective protrusions 404*a* of two elastic modules 400 on both sides of each of the slide rail beams 52 can slide in the grooves 52*a* independently relative to each other. That is, the slide rail beam 52 is configured so that the first snap structure can simultaneously engage the second snap structures 404 of the two elastic modules 400 on both sides of the slide rail beam 52, and in the engaged state, the two elastic modules 400 on both sides of the slide rail beam 52 can slide along their respective rails independently relative to each other.

Figure 54A:
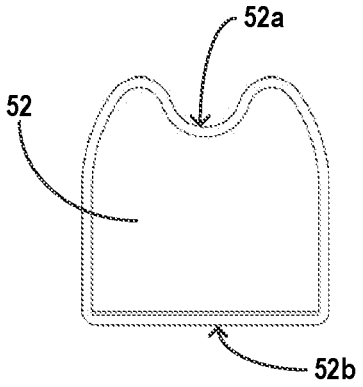
FIG. 54A is an enlarged view of a section of a longitudinal beam shown in FIG. 53.
Figure 54B:
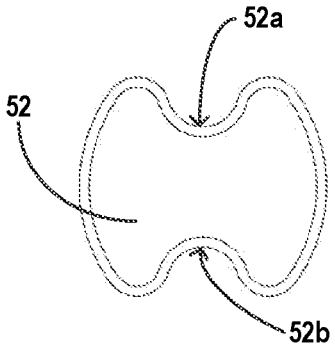
FIG. 54B and FIG. 54C are views showing alternative designs of the longitudinal beam of FIG. 54A.
Figure 54C:
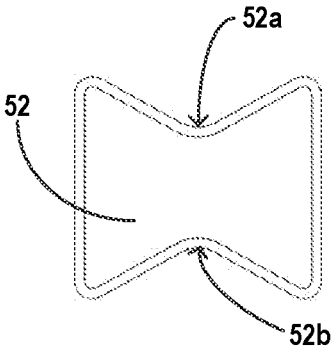

The cross-sectional configuration of the slide rail beam 52 may also have other preferred configurations. For example, referring to FIG. 54B and FIG. 54C, the bottom surface 52*b* of the slide rail beam is also provided with a groove 52*a*, and the snap hook 404*b* is configured to hook into the groove 52*a*. Furthermore, the grooves 52*a* on the bottom surface 52*b* and the grooves 52*a* on the top surface of the slide rail beam 52 are arranged symmetrically, and the slide rail beam 52 is simultaneously configured to be symmetrical about a plane defined by the bottommost end of the groove 52*a* on the top surface of the slide rail beam 52 and the topmost end of the groove 52*a* on the bottom surface 52*b* of the slide rail beam. As shown in FIG. 54C, left and right side surfaces of the slide rail beam 52 are planes, or as shown in FIG. 54B, the left and right side surfaces of the slide rail beam 52 are convex arc surfaces, and a portion of the base 401 of the elastic module 400 corresponding to the convex arc surface is a concave arc surface.

Alternatively, in other embodiments not shown, the first snap structure includes a protrusion 52*a* extending along the slide rail beam 52 on the top surface of the slide rail beam 52, and the second snap structure 404 includes a groove 52*a* provided at an edge of the top surface of the base 401 of the elastic module 400 and facing the protrusion 52*a*.

Figure 58:
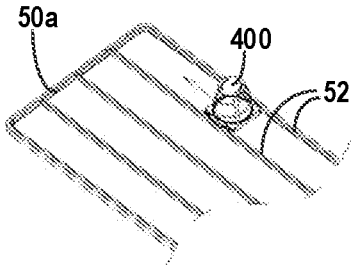
Figure 59:
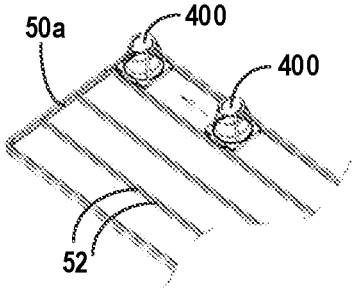
Figure 60:
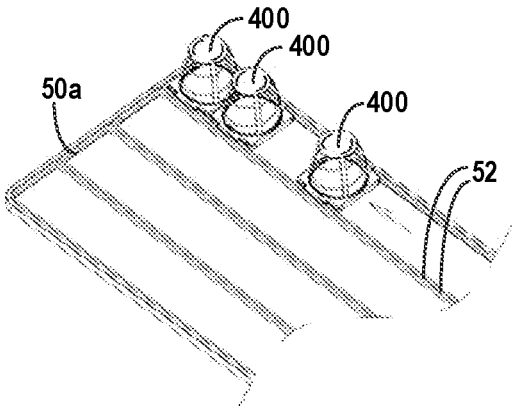
Figure 61:
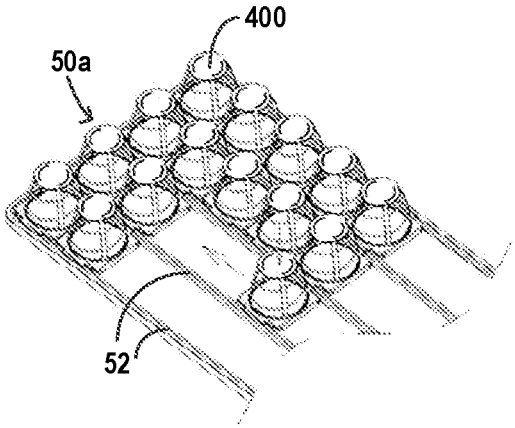
Figure 62:
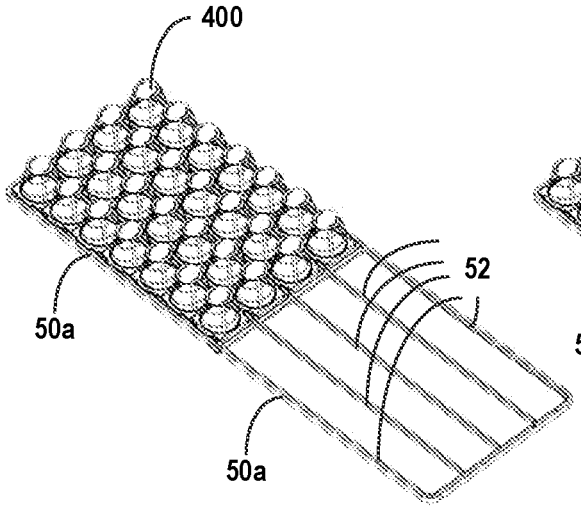
FIG. 62 and FIG. 63 are schematic views after two main body frames are arranged side by side, wherein FIG. 62 and FIG. 63 may constitute the backrest portion or seat portion of the soft bed.

FIG. 57-FIG. 63 show schematic views of a process of mounting the elastic modules 400 on the bed frame of the sofa bed. First, an elastic module 400 is pressed down to the slide rail formed by a pair of slide rail beams 52. After the elastic module 400 is mounted on the slide rail, the elastic module 400 can slide on the slide rail in the longitudinal direction. Afterwards, subsequent elastic modules 400 can be mounted on the slide rail, as shown in FIG. 58-FIG. 59. Referring to FIG. 61, while the elastic modules 400 are mounted on one slide rail, the elastic modules 400 can be simultaneously mounted on the other slide rails by being pressed. Furthermore, although the elastic modules 400 on adjacent slide rails engage with the same slide rail beam 52, the elastic modules 400 on adjacent slide rails can slide independently relative to each other, and their respective sliding do not affect each other. FIG. 62 shows a schematic view in which all the elastic modules 400 are already mounted on one main body unit 50*a* of the seat portion or backrest portion, and FIG. 63 shows a schematic view in which two main body units 50*a* of the seat portion or backrest portion are already mounted with all the elastic modules 400.

It should be appreciated that all the embodiments mentioned in the present invention can be combined, and the technical solutions obtained by combining any two or more embodiments fall within the scope of protection of the present invention. For example, there may be a sofa bed that has a bracket as shown in FIGS. 16-23 as well as the unit structure composed of the mesh panel and the unit frame as shown in FIGS. 24-26, as well as the foldable and detachable armrest frame as shown in FIGS. 30-37, and furthermore the elastic modules can be mounted in the manner shown in FIG. 38A-FIG. 49, and/or the elastic modules can be mounted in the manner shown in FIG. 50-FIG. 63. It should be further appreciated that the elastic module-mounting manner shown in FIG. 38A-FIG. 49 and the elastic module-mounting manner shown in FIG. 50-FIG. 63 do not conflict with each other and they may coexist, that is to say, the elastic modules can be mounted on the sofa bed in two manners.

The switching of the sofa bed provided by the present invention between two in-use states can be easily achieved with convenient operations. Furthermore, in the predetermined switching process and the predetermined use process, the angle between the seat portion and the backrest portion can be locked to improve the reliability of the operation; in the switching operation, with the pin sliding in the sliding groove in an extension direction having a transverse component and a vertical component, the user's operation burden can be reduced, and the switching operation can be achieved quickly and easily. In order to realize the switching of the main body frame between the sofa configuration and the bed configuration, a hinge in the form of three sections is provided at the connection between the backrest portion and the seat portion; the bottom supporting structure of the sofa bed is further provided with a support pipe, which can not only support the main body frame when the sofa bed is used as a sofa, but also support the main body frame when the sofa bed is used as a bed; the main body frame may include a bed plate frame and a steel mesh plate, which can be engaged and disengaged well; the armrest frame can also be detached and folded for easy storage and transportation. Furthermore, the sofa bed may be provided with a plurality of detachable elastic modules, the mounting of the elastic modules is relatively simple and easy to operate, and the user can manually mount the elastic modules to obtain a sofa bed with better comfort. In order to mount the elastic modules, the main body frame is set to be foldable in half, and the slideway for mounting the elastic modules is opened at the fold-in-half position to allow the elastic modules to enter the slideway, and the opening is closed when the main body frame is flattened to thereby prevent the elastic modules from disengaging; the elastic modules may also be configured to be pressed directly from top to bottom onto the rail, and such an arrangement may prevent adjacent elastic modules from interfering with each other.

The above depictions of various embodiments of the present invention are provided to those having ordinary skill in the art for a depiction purpose, and are not intended to exclude other embodiments from the present prevention or limit the present prevention to a single disclosed embodiment. As described above, various alternatives and modifications of the present prevention will be apparent to those of ordinary skill in the art. Accordingly, although some alternative embodiments have been described in detail, those having ordinary skill in the art will understand or readily develop other embodiments. The prevention is intended to cover all alternatives, modifications and variations of the present prevention described herein, as well as other embodiments falling within the spirit and scope of the present prevention described herein.

I claim:

1. A sofa bed, comprising:

a plurality of elastic modules each comprising a conical spring and a spring bracket holding the conical spring;

a main body frame formed with a plurality of slide rails configured to engage with a bottom portion of the spring bracket so that the plurality of elastic modules can slide on the slide rails;

an armrest frame on both sides of the main body;

the main body frame configured to be folded along a fold-in-half line perpendicular to an extending direction of the slide rail so as to switch between a folded state and an in-use state, the slide rail forming a slide rail opening at the fold-in-half line when the main body frame is in the folded state, and the slide rail opening closed when the main body frame is in the in-use state;

the slide rails on the main body frame configured such that when the main body frame is in the folded state, the plurality of elastic modules can be mounted on the slide rails from an outer side of the main body frame via the slide rail openings and slide toward ends of the slide rails, the plurality of elastic modules arranged on a front side of the main body frame facing when in the folded state.

2. The sofa bed according to claim 1 wherein the main body frame comprises a rectangular structure, and the slide rails extend in a longitudinal direction of the main body frame.

3. The sofa bed according to claim 2 wherein the fold-in-half line is located at a middle position in the longitudinal direction of the main body frame.

4. The sofa bed according to claim 3 wherein the slide rails are adapted to mount an even number of the elastic modules.

5. The sofa bed according to claim 2 wherein the fold-in-half line is offset from a middle position in the longitudinal direction of the main body frame.

6. The sofa bed according to claim 5 wherein the slide rails are adapted to mount an odd number of the elastic modules, and after the main body frame is folded along the fold-in-half line, the number of elastic modules that can be mounted at most on each side rail of a first portion of two portions of the main body frame which are folded in half is one larger than the number of elastic modules that can be mounted at most on each side rail of a second portion of the two portions.

7. The sofa bed according to claim 2 wherein the main body frame comprises at least two folded portions, each of which comprises:

a unit frame;

a plurality of parallel rail beams extending between two transversely extending beams of the unit frame, each adjacent pair of the rail beams forming the slide rail;

wherein in any two folded portions adjacent in the longitudinal direction among the at least two folded portions, a respective transversely extending beams abut against each other and are pivotable relative to each other about a transversely-extending axis to achieve the folding of the two adjacent folded portions towards each other.

8. The sofa bed according to claim 1 wherein the spring bracket of each of the elastic modules comprises a base having a spring mounting seat for fixing an end of the conical spring.

9. The sofa bed according to claim 1 wherein the spring bracket of each of the elastic modules further comprises:

an end cap disposed opposite to a corresponding spring mounting seat and cooperating with the corresponding spring mounting seat to hold the conical spring, wherein the end cap abuts against the other end of the conical spring opposite to an end of the conical spring fixed in the spring mounting seat; and one or more sets of flexible straps, each set of flexible straps including a plurality of flexible straps spaced from one another and evenly arranged between a corresponding pair of the spring mounting seat and end cap, the flexible straps being located outside the conical spring when the one conical spring is retained between the corresponding pair of the spring mounting seat and end cap.

10. The sofa bed according to claim 1 wherein each of the elastic modules further comprises a cover covering the conical spring of the elastic module.

11. The sofa bed according to claim 1 wherein the conical spring is mounted in the spring bracket with a predetermined initial compressive force.

12. The sofa bed according to claim 7 wherein the main body frame comprises a seat portion and a backrest portion disposed adjacently in a transverse direction, and the seat portion and the backrest portion are configured to be folded and flattened about a hinge mechanism, thereby allowing the main body frame to switch between a bed configuration and a sofa configuration;

wherein the seat portion and the backrest portion each comprise at least two folded portions arranged in the longitudinal direction.

13. The sofa bed according to claim 12 wherein each of the armrest frames is formed with a slideway facing the hinge mechanism, so that movement of the hinge mechanism is guided by the hinge mechanism;

wherein the sofa bed is configured to lock the backrest portion relative to the seat portion at a predetermined angle when the backrest portion and the seat portion pivot relative to each other about the hinge mechanism, and the armrest frame is connected with the main body frame through the hinge mechanism, so that in a locked state, a partial structure of the hinge mechanism can move the main body frame to guided by the slideway.

14. The sofa bed according to claim 13 wherein the hinge mechanism comprises:

a seat portion connecting rod attached to a transverse side edge of the seat portion and extending along the transverse side edge;

a backrest portion connecting rod attached to a transverse edge of the backrest portion on the same side as the transverse side edge of the seat portion and extending along the transverse edge of the backrest portion;

a pivot connecting the seat portion connecting rod with the backrest portion connecting rod such that the backrest portion and the seat portion can pivot relative to each other.

* * * * *